US006353435B2

(12) United States Patent
Kudo et al.

(10) Patent No.: US 6,353,435 B2
(45) Date of Patent: Mar. 5, 2002

(54) LIQUID CRYSTAL DISPLAY CONTROL APPARATUS AND LIQUID CRYSTAL DISPLAY APPARATUS

(75) Inventors: Yasuyuki Kudo, Fujisawa; Tsutomu Furuhashi, Yokohama; Hiroyuki Mano, Sagamihara; Shinji Uchida, Chiba-ken; Tatsuhiro Inuzuka, Odawara; Takeshi Maeda, Yokosuka; Satoshi Konuma, Fujisawa, all of (JP)

(73) Assignees: Hitachi, Ltd, Tokyo; Hitachi Video & Information Systems, Inc., Yokohama, both of (JP)

( * ) Notice: Subject to any disclaimer, the term of this patent is extended or adjusted under 35 U.S.C. 154(b) by 0 days.

(21) Appl. No.: 09/059,363

(22) Filed: Apr. 14, 1998

(30) Foreign Application Priority Data

Apr. 15, 1997 (JP) ..... 9-097216
Sep. 25, 1997 (JP) ..... 9-260530

(51) Int. Cl.[7] ..... G09G 5/00; G09G 3/36

(52) U.S. Cl. ..... 345/204; 345/87; 345/89; 345/690; 345/537; 348/714; 348/715; 348/716

(58) Field of Search ..... 345/204, 537, 345/112, 694, 600, 603, 605, 87, 89, 690–692; 348/714, 715, 716

(56) References Cited

U.S. PATENT DOCUMENTS 5,534,883 A * 7/1996 Koh ..... 345/3
5,900,857 A * 5/1999 Kuwata et al. ..... 345/100
5,953,002 A * 9/1999 Hirai et al. ..... 345/204
6,014,126 A 1/2000 Nishihara

FOREIGN PATENT DOCUMENTS

JP 8-87247 4/1996

* cited by examiner

*Primary Examiner*—Bipin Shalwala
*Assistant Examiner*—Jimmy H Nguyen
(74) *Attorney, Agent, or Firm*—Antonelli, Terry, Stout & Kraus, LLP

(57) ABSTRACT

A liquid crystal display control apparatus includes a display on/off data generation circuit for generating plural display on/off data per pixel corresponding to M (M>N, M and N being integers) frame periods of a video output signal in N frame periods of a video input signal on a unit pixel basis in response to gray-scale data of pixel units included in the video input signal, a write control circuit for writing display on/off data per pixel corresponding to M frames of the video output signal generated by the display on/off data generation circuit into a frame memory during N frame periods of the video input signal, and a read control circuit for sequentially reading out, from the frame memory, display on/off data corresponding to M frames of the video output signal written in the frame memory in synchronism with one display scan period of the video output signal, thereby the data written in the frame memory is not gray-scale data but display on/off data of one bit, therefore, a data bus width at a time of accessing the frame memory can be reduced.

17 Claims, 40 Drawing Sheets

(A) NORMAL MODE (B) MODE HAVING NO MEASURE TO LACKED LINES (C) MODE HAVING MEASURE TO LACKED LINES

LIQUID CRYSTAL DISPLAY CONTROL APPARATUS AND LIQUID CRYSTAL DISPLAY APPARATUS

BACKGROUND OF THE INVENTION

1. Field of the Invention

The present invention relates to a liquid crystal display control apparatus and a liquid crystal display apparatus and more particularly, to a liquid crystal display control apparatus of a passive matrix type and a liquid crystal display apparatus.

2. Description of the Related Art

In a liquid crystal display apparatus of a so-called passive matrix display type as a super-twisted nematic (STN) type wherein pixels are positioned at intersections between scan and data electrodes perpendicular to each other so that the light transmission factor of the pixel varies with a mean square of a difference between voltages applied to the scan and data electrodes; a drive frame frequency for obtaining the optimum contrast varies with the response time of liquid crystal material.

It is generally believed that the optimum contrast can be obtained when the response time of liquid crystal material (corresponding to an addition of a rise time until display on and a fall time until display off) is 300 ms and a drive frame frequency is between 90 and 120 Hz.

It is also believed that the optimum contrast can be obtained when the response time is 150 ms and the drive frame frequency is 150 Hz or when the response time is 100 ms and the drive frame frequency is 180 Hz or more.

These drive frame frequencies are higher than the drive frame frequencies of 60 to 75 Hz of a cathode-ray tube (CRT) display or thin film transistor (TFT) liquid crystal display.

Accordingly, in order to convert a display signal for the CRT display or TFT liquid crystal display to a display signal for an STN liquid crystal display, it is required to use a frame memory for saving of display data to convert it to a drive frame frequency.

In liquid crystal displays, predominant ones of driving methods for applying binary information (one bit data) of display on and off to the respective pixels of the liquid crystal display.

In order to provide a gray-scale for the liquid crystal display, special processing becomes necessary. As one of systems for implementing this special processing, there is a frame rate control (FRC) system which provides a gray-scale display by setting several frame periods as a unit period and setting the display on/off rate of each pixel in the unit period in terms of unit periods of frame periods.

FIG. 30 is a diagram for explaining an example of gray-scale processing of the FRC system.

In the example shown in FIG. 30, 4 frame periods are set as a unit period, and a pattern of display on and off (referred to as the FRC pattern, hereinafter) is switched on every unit period basis with respect to each certain size of matrix on the display screen.

In a liquid crystal display apparatus of an STN type, a means for implementing the drive frame frequency converting operation and the gray-scale processing operation of the FRC system is generally called liquid crystal controller.

FIGS. 31 and 32 schematically show block diagrams of liquid crystal controllers.

The liquid crystal controller shown in FIG. 31 is of such a type that executes the gray-scale processing operation prior to the drive frame frequency converting operation.

First, for each of colors of red (R), green (G) and blue (B), an input interface 311 accepts gray-scale data (usually, 6-to-8 bit data) of n bits per pixel.

A gray-scale processor 312 then executes the gray-scale processing operation of the FRC system according to the gray-scale data received from the input interface 311 to generate of one bit of indicate on/off data, and writes it into a frame memory 313.

Thereafter, the indicate on/off data are read out from the frame memory 313 in synchronism with the drive frame frequency of the liquid crystal output display data to be converted to a frame frequency, and then output to an STN liquid crystal display (not shown) through a liquid crystal output interface 314.

The liquid crystal controller shown in FIG. 32, on the other hand, is such a type that executes the frame frequency converting operation prior to the gray-scale processing operation.

First, for each of the colors R, G and B, an input interface 311 accepts gray-scale data (usually, 6-to-8 bit data) of n bits per pixel. After that, the gray-scale data are written into a frame memory 313.

Next, the gray-scale data are read out from the frame memory 313 in synchronism with the drive frame frequency of the liquid crystal output display data to be converted to a frame frequency, and thereafter a gray-scale processor 312 executes the gray-scale processing operation of the read gray-scale data to generate one bit of indicate on/off data.

And the gray-scale processor 312 outputs the indicate on/off data to an STN liquid crystal display (not shown) through a liquid crystal output interface 314.

Disclosed in Japanese Laid-Open Publication No. 8-87247 is a technique for displaying a video signal not conforming to a liquid crystal display of the passive matrix type.

SUMMARY OF THE INVENTION

It is therefore a first object of the present invention to provide a liquid crystal display control apparatus and liquid crystal display apparatus which can suppress moving and flickering of a gray-scale display portion and also can avoid increase in the number of pins when the apparatus is made in the form of a large scale integrated (LSI) circuit.

A second object of the present invention is to provide a liquid crystal display control apparatus and liquid crystal display apparatus which can prevent interference fringes generated when gray-scale display is carried out over upper and lower screens of an STN liquid crystal display of a so-called dual scan type.

A third object of the present invention is to provide a liquid crystal display control apparatus and liquid crystal display apparatus which, when digital gray-scale data generated from analog display data for a CRT display is used as an input signal, can suppress deterioration of quality of the gray-scale display due to an quantum error caused by conversion of the analog display data to the digital gray-scale data.

A fourth object of the present invention is to provide a liquid crystal display control apparatus and liquid crystal display apparatus which can display on a liquid crystal display a video signal with retrace lines removed therefrom.

In accordance with a first aspect of the present invention, there is provided a liquid crystal controller wherein, in accordance with gray-scale data of pixel units included in a video input signal, a display on/off rate at which pixels of units included in a video output signal to a liquid crystal display are indicated during a plurality of frame periods of the video output signal, is set in the pixel units of the video output signal in its one display scan period on a unit pixel basis to provide intermediate gray-scale display to the liquid crystal display, and which controller comprises:

a display on/off data generation circuit, in accordance with the gray-scale data of pixel units included in the video input signal, for generating display on/off data corresponding to M (M>N) frame periods of the video output signal in N frame periods of the video input signal on a unit pixel basis;

a write control circuit for writing display on/off data corresponding to M frames of the video output signal generated by the display on/off data generation circuit into a frame memory during N frame periods of the video input signal; and a read control circuit for sequentially reading out, from the frame memory, display on/off data corresponding to M frames of the video output signal written in the frame memory in synchronism with frame period of the video output signal.

In this case, the gray-scale data refer to, e.g., display data for a liquid crystal display of a thin film transistor (TFT) type.

The above arrangement, display on/off data corresponding to M (M>N) frames of the video output signal are written into the frame memory during an N frame period of the video input signal, and the written display on/off data of the M frames are sequentially read out from the frame memory in synchronism with the frame period of the video output signal.

In this way, since the data written in the frame memory is not gray-scale data but display on/off data of one bit, a data bus width at the time of accessing the frame memory can be reduced. Accordingly, an increase in the number of pins involved when it is desired to make the controller in the form of an LSI can be suppressed.

Further, since the frame period of the video output signal can be set faster than the frame period of the video input signal, the flow or flickering of the intermediate gray-scale display part can be lightened.

In addition, gray-scale data is data of usually 6 to 8 bits per pixel, whereas display on/off data is data of one bit per pixel.

Therefore, the total number of bits in the data written in the frame memory with one frame period of the video input signal as a unit is:

(1) When gray-scale data is written in the frame memory, [(the number of pixels in one frame)×6 to 8 bits].

(2) When display on/off data is written in the frame memory, [(the number of pixels in one frame)×1 bit× M/N bits].

Accordingly, by setting M/N to be smaller than 6 to 8, the memory capacity can be saved when compared with that when gray-scale data is written in the frame memory.

In accordance with a second aspect of the present invention, there is provided a liquid crystal controller wherein, in accordance with gray-scale data of units each having a plurality of pixels and included in a video input signal, display on/off change-over patterns of pixels during a plurality of frame periods of the video output signal to be output to a liquid crystal display, are set to provide intermediate gray-scale display for the liquid crystal display, the liquid crystal display is of a dual scan type in which the liquid crystal display is divided into upper and lower display to be simultaneously driven, and which comprises:

a first setting circuit for setting a display on/off change-over pattern of pixels during a plurality of frame periods of the video output signal according to gray-scale data of the pixel units located in the upper display and included in the video input signal; and a second setting circuit for setting a display on/off change-over pattern of pixels during a plurality of frame periods of the video output signal according to gray-scale data of the pixel units located in the upper display and included in the video input signal;

and wherein the second setting circuit sets the display on/off change-over data in such a manner that the display on/off change-over pattern of pixels located in the lower display is delayed by one frame of the video output signal with respect to the display on/off change-over pattern of pixels located in the upper display.

In the second aspect of the present invention having the above arrangement, the display on/off pattern of the lower display can be output as delayed by one frame with respect to that of the upper display.

In this way, since the display on/off data of pixels in the vicinity of a boundary between the upper and lower displays can be set to be included in the same frame, it can be prevented that interference fringes look like moving in the vicinity of the boundary between the upper and lower displays.

In accordance with a third aspect of the present invention, there is provided a liquid crystal controller wherein, in accordance with gray-scale data of pixel units generated by quantizing an analog gray-scale signal, display on/off change-over patterns of pixels during a plurality of frame periods of a video output signal to be output to a liquid crystal display are set to provide intermediate gray-scale display for the liquid crystal display, and the display on/off change-over patterns are previously set so that gray-scale data of pixels having adjacent values have a nearly common frame to be mutually turned on or off.

In this case, analog gray-scale signal refers to, e.g., display data for a cathode ray tube (CRT) type of display.

In the third aspect of the present invention having the above arrangement, with respect to display on/off data corresponding to one frame of the video output signal, change-over of display on/off of pixels caused by changes in the values of the gray-scale data can be smoothly made without providing an extreme change in the positional relationship between the pixel turned on and the pixel turned off.

Thus, when digital gray-scale data generated from such an analog gray-scale signal as analog display data for a CRT display are used as a video input signal, a quantization error generated a the time of converting the analog gray-scale signal to the digital gray-scale data enables suppression of image quality deterioration of intermediate gray-scale display.

In accordance with a fourth aspect of the present invention, there is provided a liquid crystal controller which comprises a vertical synchronous signal control circuit for converting a vertical synchronous signal inputted to the controller into a vertical synchronous signal having a frequency corresponding to Y (Y being a real number of 2 or more) times the frequency of the input vertical synchronous signal and supplying the converted vertical synchronous signal commonly to two scan driving circuits, and a data drive control circuit for reading out, from the frame memory, data of the video input signal stored in the memory at such a speed as readable by one frame during one period of the converted vertical synchronous signal with respect to each of 2 liquid crystal displays and supplying it to the associated data drive circuit.

Thereby a video signal corresponding to the video input signal but its retrace periods removed can be displayed on the liquid crystal displays.

DESCRIPTION OF THE PREFERRED EMBODIMENTS

Embodiments of the present invention will be described with reference to the accompanying drawings.

Figure 1:
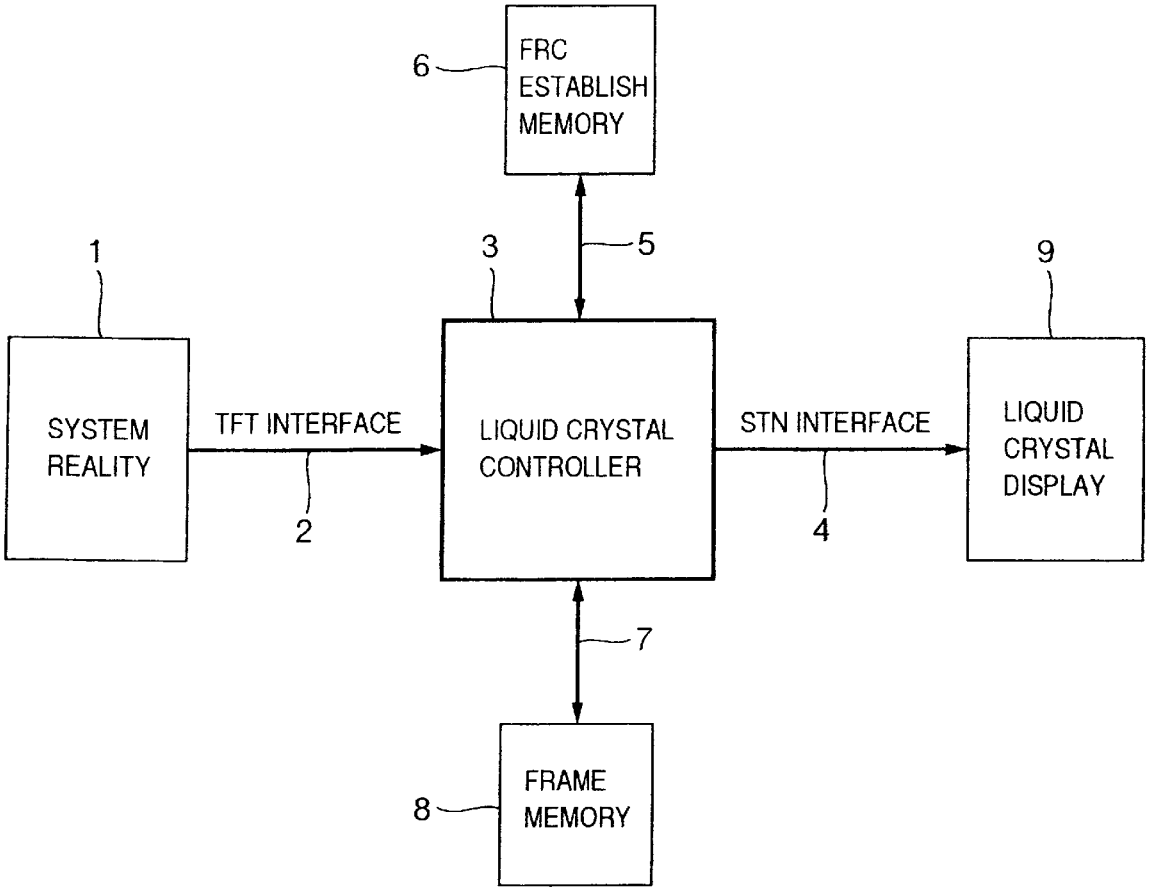
FIG. 1 is a block diagram of a general liquid crystal display apparatus in accordance with a first embodiment of the present invention.

FIG. 1 is a block diagram of a liquid crystal display system in accordance with the present invention. The illustrated liquid crystal display system enhances its image quality by converting a digital video signal 2 of an active matrix type to show it on a super twisted nematic (STN) liquid crystal display 9 of 2-reflection composition type. More specifically, the image quality is improved by setting a frame rate (repetition rate of display corresponding to one display screen) in a display mode to be twice that of the digital video signal 2 or more.

Referring to FIG. 1, reference numeral 1 denotes a system reality, numeral 3 denotes an STN liquid crystal controller for converting a digital video signal, 6 denotes a frame rate control (FRC) establish memory for storing therein gray-scale data for gray-scale control, 8 denotes a frame memory for storing therein indicate data included in the digital video signal, and 9 denotes a liquid panel of a 2 reflection composition type (of upper and lower reflections).

The above constituent elements other than the system reality 1 constitutes a liquid crystal display control apparatus. Of these elements, the STN liquid crystal controller 3 is implemented in the form of a one-chip large scale integrated circuit (LSI). The FRC establish memory 6 is implemented in the form of a flash memory. Of course, the above constituent elements including the system reality 1 may be disposed within a single casing.

The system reality 1 outputs the TFT digital video signal 2 of an active matrix type. Also contained in the TFT digital video signal 2 is, in addition to the indicate data, an input synchronous signals (vertical synchronous signal, horizontal synchronous signal and data synchronous signal.

The STN liquid crystal controller 3 inputs the TFT digital video signal 2, converts it to a digital video signal 4 conforming to the liquid panel or display 9 of the 2 reflection composition type, and outputs it. The digital video signal 4 contains output synchronous signals (vertical synchronous signal, horizontal synchronous signal and data synchronous signal) as well as indicate data and an indicate period signal compatible with the respective reflections of the liquid crystal display 9. The STN liquid crystal controller 3 can display, as shown in FIG. 33 (to be explained later), both a video signal (1024×768 pixels) of an extended graphics array (XGA) mode and a video signal (800×600 pixels) of a super video graphics array (SVGA), as the TFT digital video signal 2.

Figure 2:
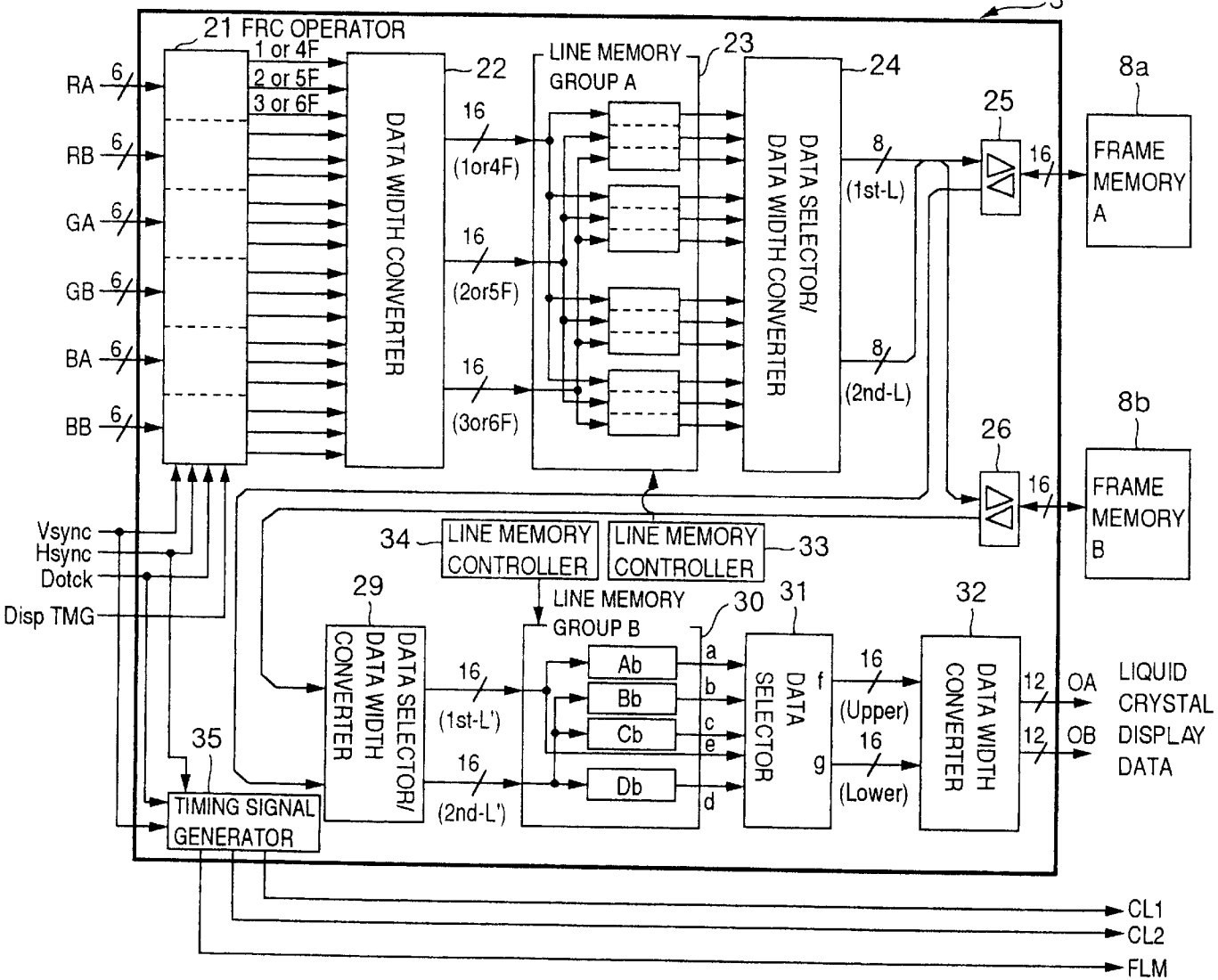
FIG. 2 is a block diagram of a liquid crystal controller in the embodiment of the present invention.

Shown in FIG. 2 is a schematic block diagram of the liquid crystal controller 3 in the first embodiment of the present invention.

The STN liquid crystal controller 3 shown in FIG. 2 is designed for such a super twisted nematic (STN) liquid crystal display of a passive matrix display, dual scan type wherein a pixel is positioned at each of intersections between scan and data electrodes perpendicular to each other, the light transmission factor of the pixel varies with a mean square of differences between voltages applied to the scan and data electrodes, a display screen is divided into upper and lower screens to be driven at the same time. It is assumed that the display screen is of an extended graphics array (XGA) type having a resolution of 1024×768 dots.

In FIG. 2, reference numeral 21 denotes an FRC operator for performing intermediate gray-scale operation based on the FRC system, 22 and 32 data width converters, 23 and 30 groups of line memories, 24 and 29 data selector/data width converters, 25 and 26 frame memory read/write controllers, 8*a* and 8*b* frame memories for conversion of drive frame frequency, 31 a data selector, 33 and 34 line memory controllers, 35 a timing signal generator.

In FIG. 2, reference symbols RA and RB denote red (R) gray-scale data of 6 bits per pixel, GA and GB denote green (G) gray-scale data of 6 bits per pixel, and BA and BB denote blue (B) gray-scale data of 6 bits per pixel. It is assumed here that RA, GA and BA indicate gray-scale data of the respective colors with respect to the odd-numbered pixels, while RB, GB and GB indicate gray-scale data of the respective colors with respect to the even-numbered pixels. In this connection, in FIG. 2, output signals of the respective circuits are illustrated to have 6, 16, 8 and 12 bits.

Reference symbol DotCK denotes a synchronous signal synchronized with the gray-scale data, Hsync denotes a horizontal synchronous signal indicative of a change-over of the horizontal period, Vsync denotes a vertical synchronous signal (frame period signal) indicative of a change-over of the vertical (frame) period, and DispTMG denotes a signal DispTMG indicative of an effective indicate period.

Reference symbol OA denotes liquid crystal display data of 12 bits in parallel associated with the upper display screen of the liquid crystal display 9, while symbol OB denotes liquid crystal display data of 12 bits in parallel associated with the lower display screen of the liquid crystal display 9.

Reference symbol CL2 denotes a synchronous signal CL2 synchronized with the liquid crystal display data, CL1 denotes a horizontal synchronous signal indicative of a change-over of the horizontal period, and FLM denotes a frame period signal (vertical synchronous signal) indicative of a change-over of the frame period (vertical period).

In the present embodiment, the frequency of the frame period signal FLM to be output to the liquid crystal display 9 is set to be 2.5 times the frequency of the frame period signal Vsync of the input signals. Accordingly, 5 frame periods in the output signal are completed with 2 frame periods in the input signal.

In the present embodiment, access control to the frame memories 8*a* and 8*b* is carried out with 2 frame periods of the input signal as a unit.

The respective parts of FIG. 2 will be explained in detail.

Explanation will first be made as to the timing signal generator 35.

The timing signal generator 35, on the basis of the synchronous signals DotCK, Hsync, Vsync and DispTMG applied to the liquid crystal controller 3, generates the signals FLM, CL1, CL2 and other control signals (such as read/write clocks).

Figure 27:
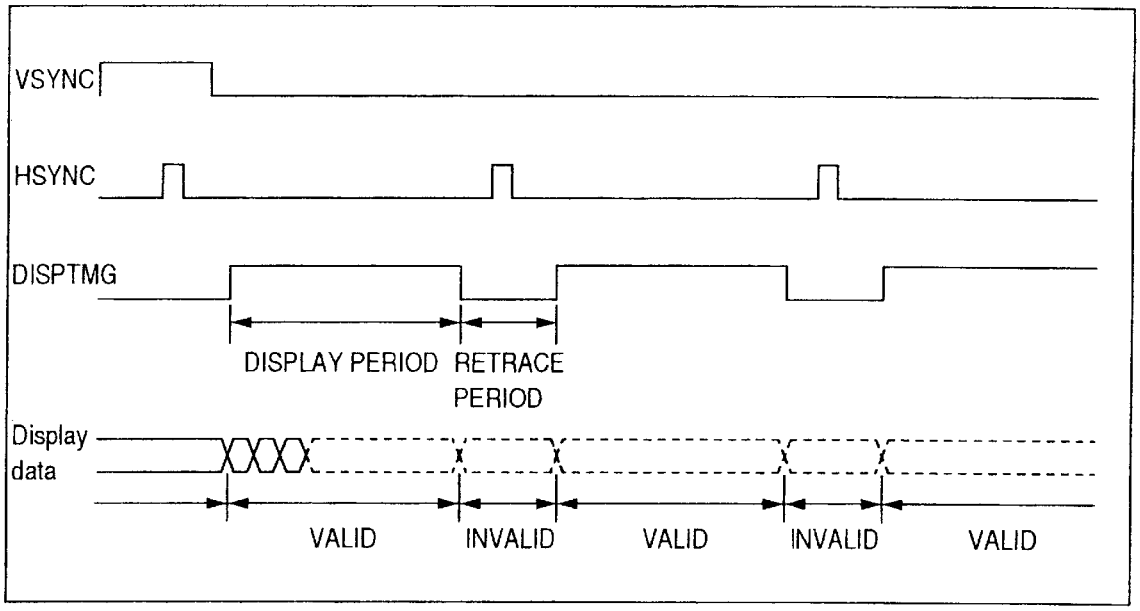
FIG. 27 is a timing chart for explaining exemplary timing of input signals DotCK, Hsync, Vsync and DispTMG of a liquid crystal controller.
Figure 28:
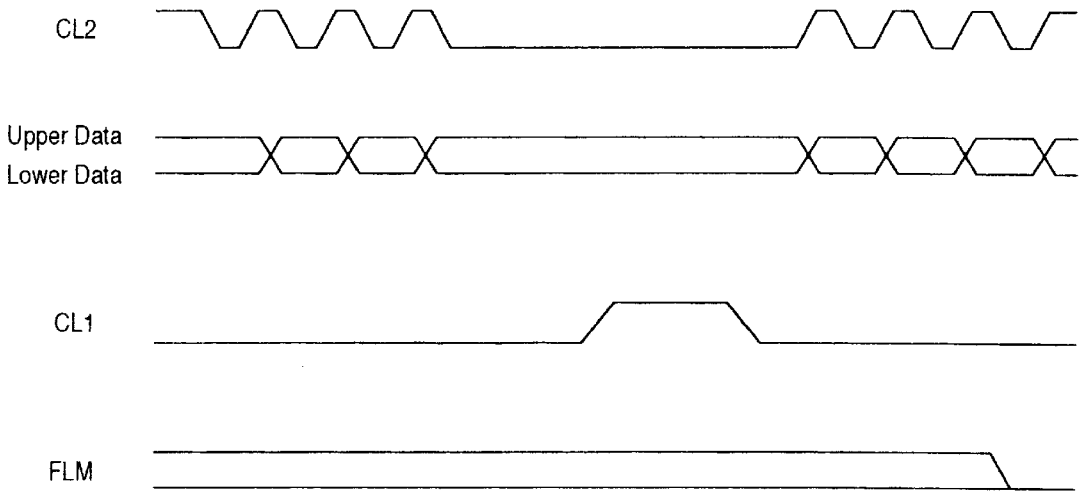
FIG. 28 is a timing chart for explaining exemplary timing of signals CL2, CL1 and FIM generated in a timing signal generator in FIGS. 2 and 16.
Figure 29:
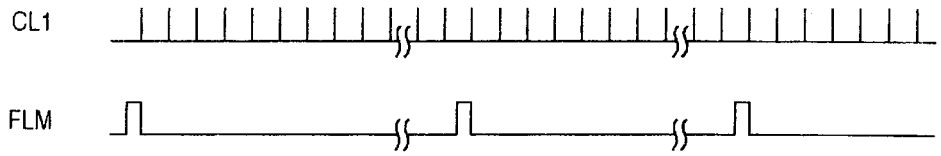
FIG. 29 is a timing chart for explaining exemplary timing of the signals CL2, CL1 and FLM generated in the timing signal generator in FIGS. 2 and 16.
Figure 30:
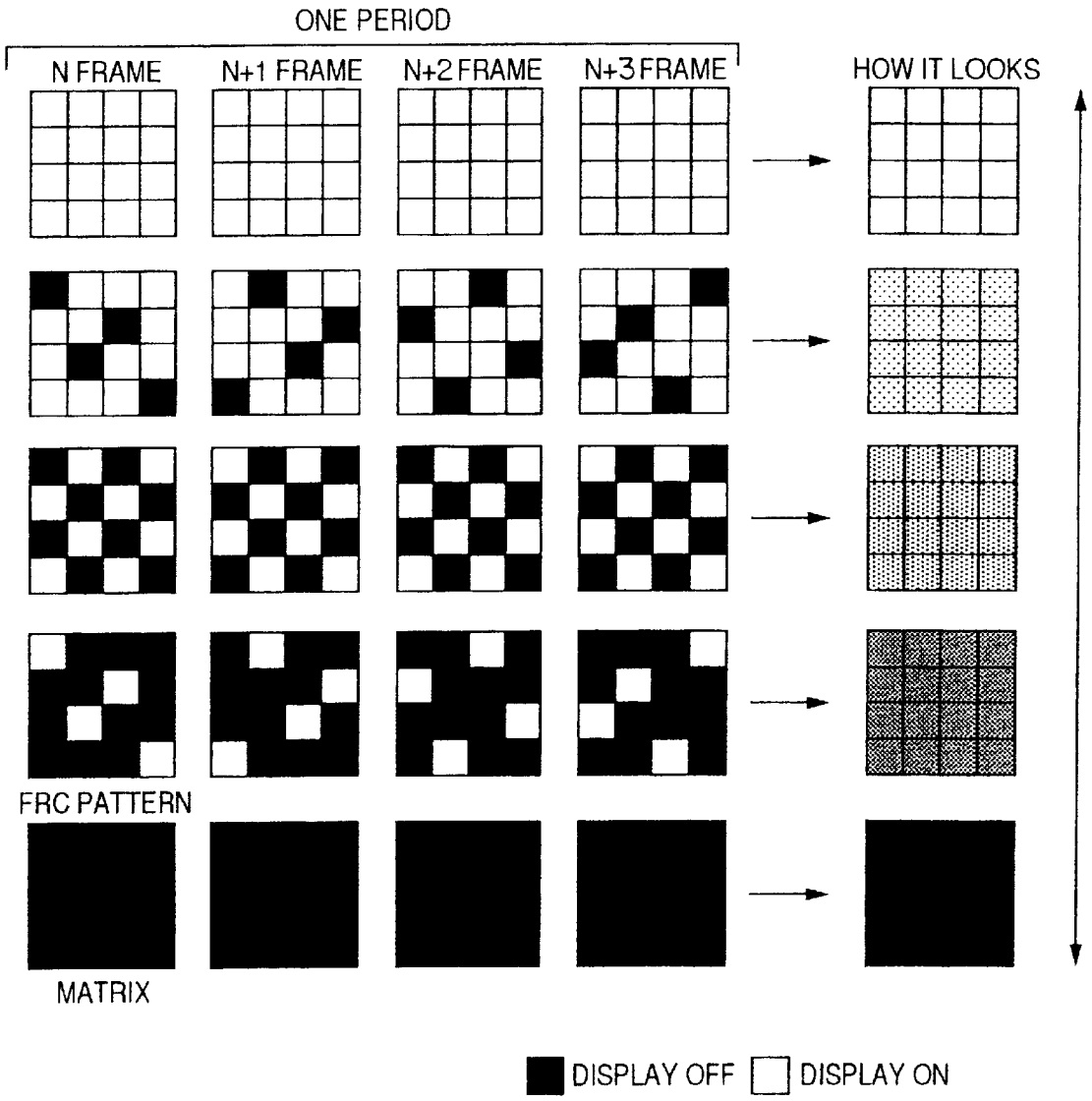
FIG.30 (PRIOR ART)
FIG. 30 is a diagram for explaining a related art of gray-scale operation of the FRC system.
Figure 31:
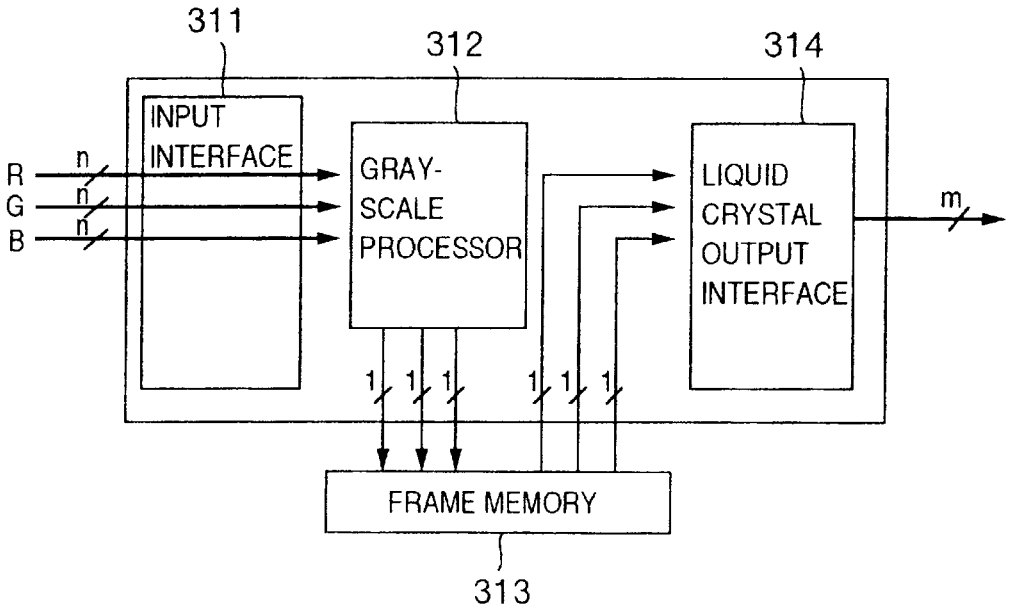
FIG.31 (PRIOR ART)
FIG. 31 is a schematic block diagram of a liquid crystal controller for explaining its related art.
Figure 32:
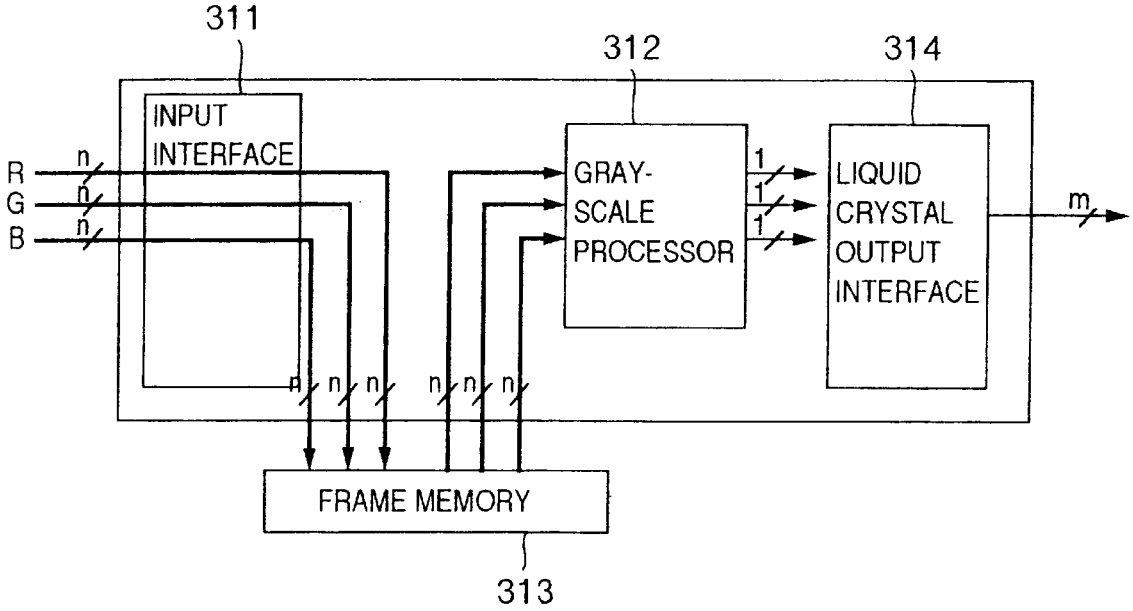
FIG.32 (PRIOR ART)
FIG. 32 is a schematic block diagram of a liquid crystal controller for explaining its another related art.

In this connection, the signals DotCK, Hsync, Vsync and DispTMG as the input signals of the STN liquid crystal controller 3 may have timing as that of signals shown in Hitachi LCD controller/driver LSI data book, p. 1001, published by Hitachi Ltd. as shown in FIG. 27.

Further, the signals CL2, CL1 and FLM generated by the timing signal generator 35 may have timing as that of signals CL2, CL1 and FLM shown in the same data book as the above, p. 1028. The timing signal generator 35 will be explained later in more detail.

Explanation will next be made as to the FRC operator 21.

The FRC operator 21 generates 3 types of indicate on/off data per pixel for the gray-scale data RA, RB, GA, GB, BA and BB. This causes the indicate on/off data corresponding to 3 frames of the video output signal, i.e., 3 FRC patterns to be generated from the gray-scale data corresponding one frame of the video input signal.

The FRC operator 21 has FRC processing circuits provided as associated with the respective gray-scale data RA, RB, GA, GB, BA and BB.

Each of the FRC processing circuits generates 3 types of indicate on/off data per pixel for the associated gray-scale data.

Figure 3:
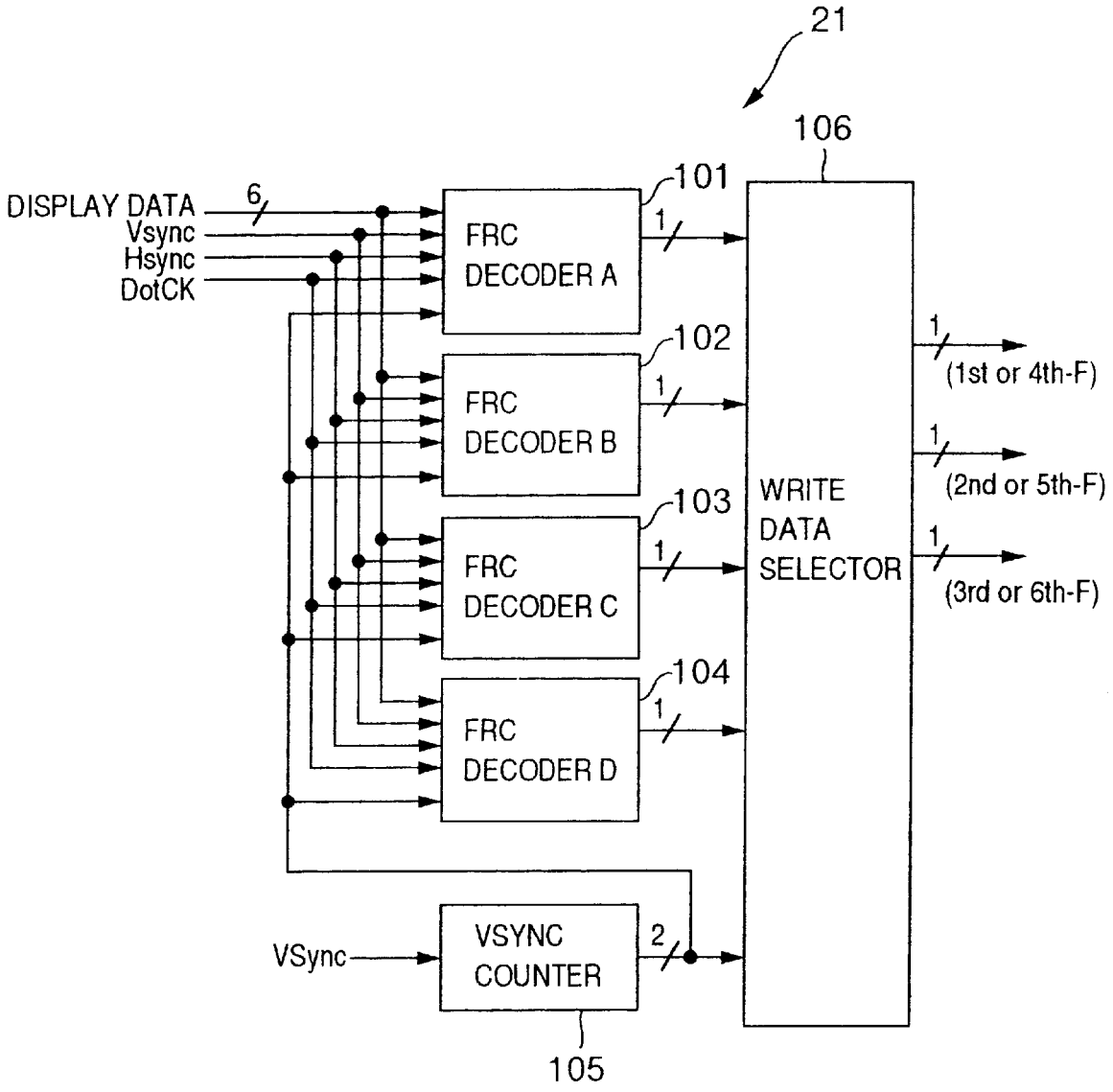
FIG. 3 schematically shows a block diagram of a circuit used in an FRC operator processor in FIG. 2.

FIG. 3 is a schematic block diagram of FRC processing circuits or decoders 101 to 104.

Reference numeral 105 denotes a Vsync counter and numeral 106 denotes a write data selector.

The Vsync counter 105 counts the vertical synchronous signal Vsync and outputs a Vsync count value of 2 bits. Thus Vsync count value can take a value of 0 to 3.

The FRC decoders 101 to 104, with respect to the input gray-scale data of a pixel, generate indicate on/off data associated with the value of the gray-scale data.

Figure 4:
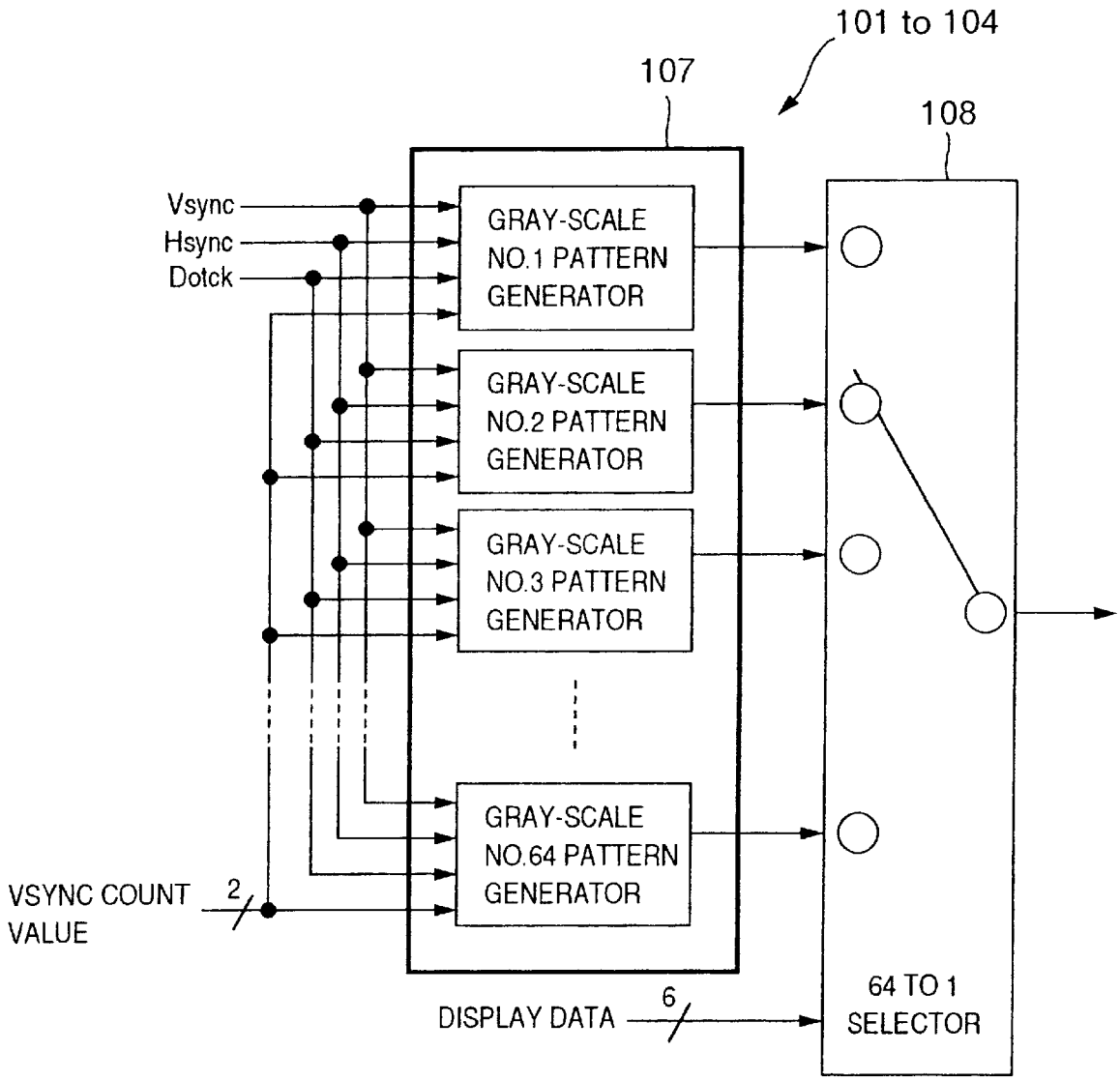
FIG. 4 schematically shows a block diagram of a circuit used in an FRC decoder in FIG. 3.

Shown in FIG. 4 is a schematic block diagram of other FRC decoders 101 to 104.

The FRC decoders 101 to 104 include an FRC pattern generator 107 for generating indicate on/off data for generation of 64 types of FRC patterns associated with bits (6 bits) of the gray-scale data per pixel, and a selector 108 for selecting one of the 64 types of indicate on/off data generated by the FRC pattern generator 107.

Explanation will be directed to a relationship between the indicate on/off data generated by the FRC decoders 101 to 104.

Figure 5:
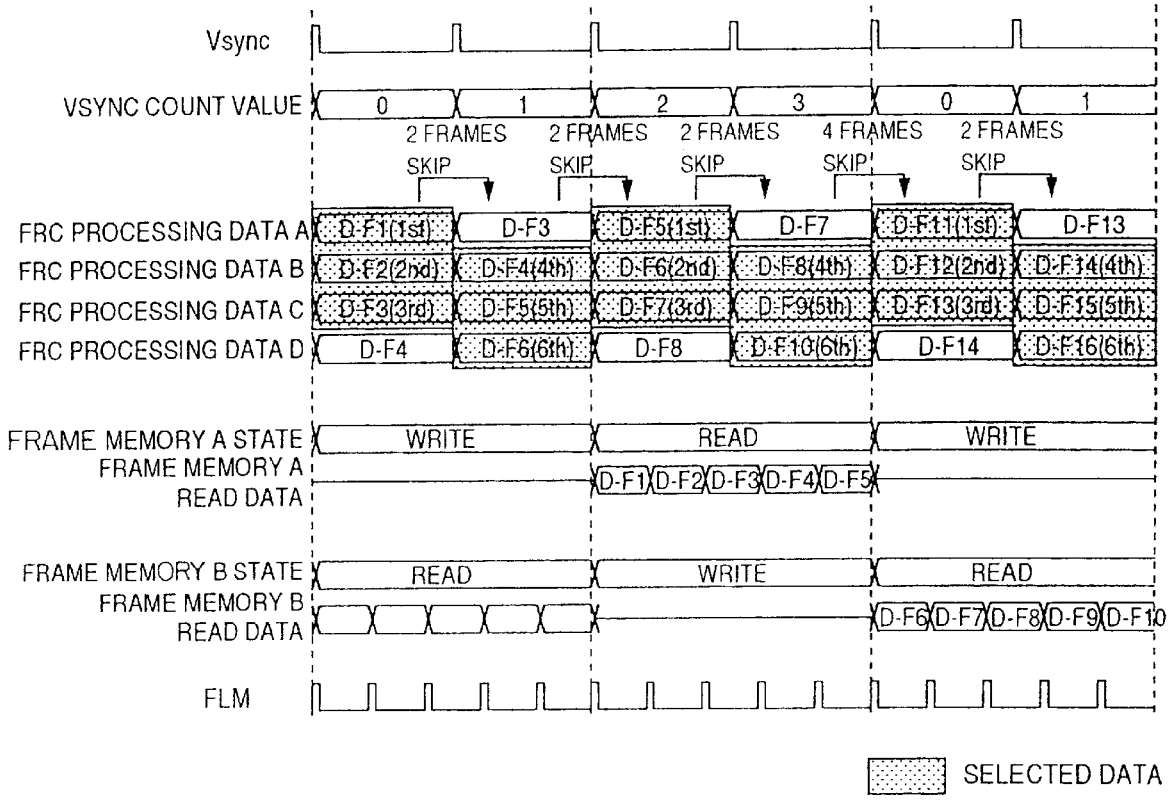
FIG. 5 is a timing chart for explaining indicate on/off data issued from the FRC decoder of FIG. 4 and read/write control of frame memories in FIG. 2.

FIG. 5 is a timing chart for explaining the output indicate on/off data of the FRC decoders 101 to 104 as well as read/write control of the frame memories 8*a* and 8*b*.

Referring to FIG. 5, FRC processing data A is illustrated therein as the indicate on/off data issued from the FRC decoder 101, FRC processing data B is as the indicate on/off data issued from the FRC decoder 102, FRC processing data C is as the indicate on/off data issued from the FRC decoder 103, and FRC processing data D is as the indicate on/off data issued from the FRC decoder 104. A plurality of D-FNs (N being an integer) mean indicate on/off data of the FRC pattern to be output at the N-th frame.

As shown in FIG. 5, assuming that the indicate on/off data generated by the FRC decoder 101 form an FRC pattern to be output at the N-th frame, then the FRC decoder 102 generates indicate on/off data for formation of an FRC pattern to be output at the (N+1)-th frame, the FRC decoder 103 generates indicate on/off data for formation of an FRC pattern to be output at the (N+2)-th frame, and the FRC decoder 104 generates indicate on/off data for formation of an FRC pattern to be output at the (N+3)-th frame.

As shown in FIG. 3, further, the FRC decoders 101 to 104 generates indicate on/off data for formation of an FRC pattern to be output at a frame previous by 2 frames each time the Vsync count value issued from the Vsync counter 105 is incremented by 1; and generates indicate on/off data for formation of an FRC pattern to be output at a frame previous by 4 frames each time the Vsync count value is reset, i.e., is switched from "3" to "0".

The present embodiment is designed to FRC patterns corresponding in number to the number of frames (Vsync) included in one period (sometimes referred to as the FRC period) of the FRC operation.

This is realized, for example, when 10 frames are included in the FRC period, by setting the FRC decoders 101 to 104 in such a manner as to be explained below.

That is, the 64 types of gray-scale pattern generators of the FRC pattern generator 107 (see FIG. 4) of the FRC decoder 101 corresponding in number to the gray-scale data bits are set to generate, according to the Vsync count value, indicate on/off data for formation of FRC patterns to be output at the first (Vsync count value=0), third (Vsync count value=1), fifth (Vsync count value=2) and seventh (Vsync count value=3) ones of frames included in the FRC period, with respect to pixels specified by the signals Vsync, Hsync and DotCK applied to the FRC decoder 101.

The 64 types of gray-scale pattern generators of the FRC pattern generator 107 (see FIG. 4) of the FRC decoder 102 corresponding in number to the gray-scale data bits are set to generate, according to the Vsync count value, indicate on/off data for formation of FRC patterns to be output at the second (Vsync count value=0), fourth (Vsync count value=1), sixth (Vsync count value=2) and eighth (Vsync count value=3) ones of frames included in the FRC period, with respect to pixels specified by the signals Vsync, Hsync and DotCK applied to the FRC decoder 101.

The 64 types of gray-scale pattern generators of the FRC pattern generator 107 (see FIG. 4) of the FRC decoder 103 corresponding in number to the gray-scale data bits are set to generate, according to the Vsync count value, indicate on/off data for formation of FRC patterns to be output at the third (Vsync count value=0), fifth (Vsync count value=1), seventh (Vsync count value=2) and ninth (Vsync count value=3) ones of frames included in the FRC period, with respect to pixels specified by the signals Vsync, Hsync and DotCK applied to the FRC decoder 101.

The 64 types of gray-scale pattern generators of the FRC pattern generator 107 (see FIG. 4) of the FRC decoder 104 corresponding in number to the gray-scale data bits are set to generate, according to the Vsync count value, indicate on/off data for formation of FRC patterns to be output at the fourth (Vsync count value=0), sixth (Vsync count value=1), eighth (Vsync count value=2) and tenth (Vsync count value=3) ones of frames included in the FRC period, with respect to pixels specified by the signals Vsync, Hsync and DotCK applied to the FRC decoder 101.

Figure 6:
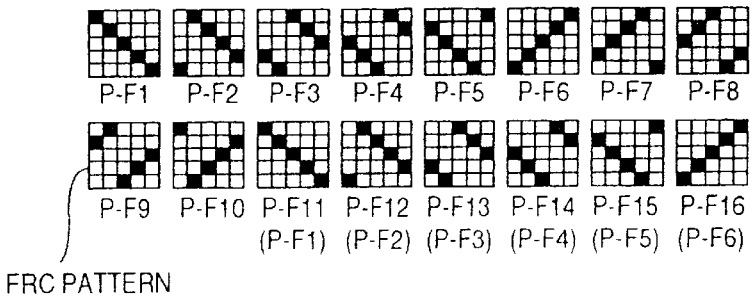
FIG. 6 is a diagram showing a relationship between indicate on/off data outputted from the FRC decoder of FIG. 4 for more easier understanding of the invention, showing an example of FRC patterns to be displayed on a liquid crystal display.

For more understanding of the relationship between the indicate on/off data issued from the FRC decoders 101 to 104, consider a case that gray-scale data of pixels of the display screen form such matrix-like FRC patterns as shown in FIG. 6.

In the drawing, a plurality of P-FNs denote the FRC patterns to be output at the N-th frame.

The FRC patterns shown in FIG. 6 are arranged to be switched on a frame basis with use of 10 frames as one FRC period. Accordingly, the FRC patterns shown by P-F11 to P-F16 are the same as the FRC patterns shown by P-F1 to P-F6.

Figure 7:
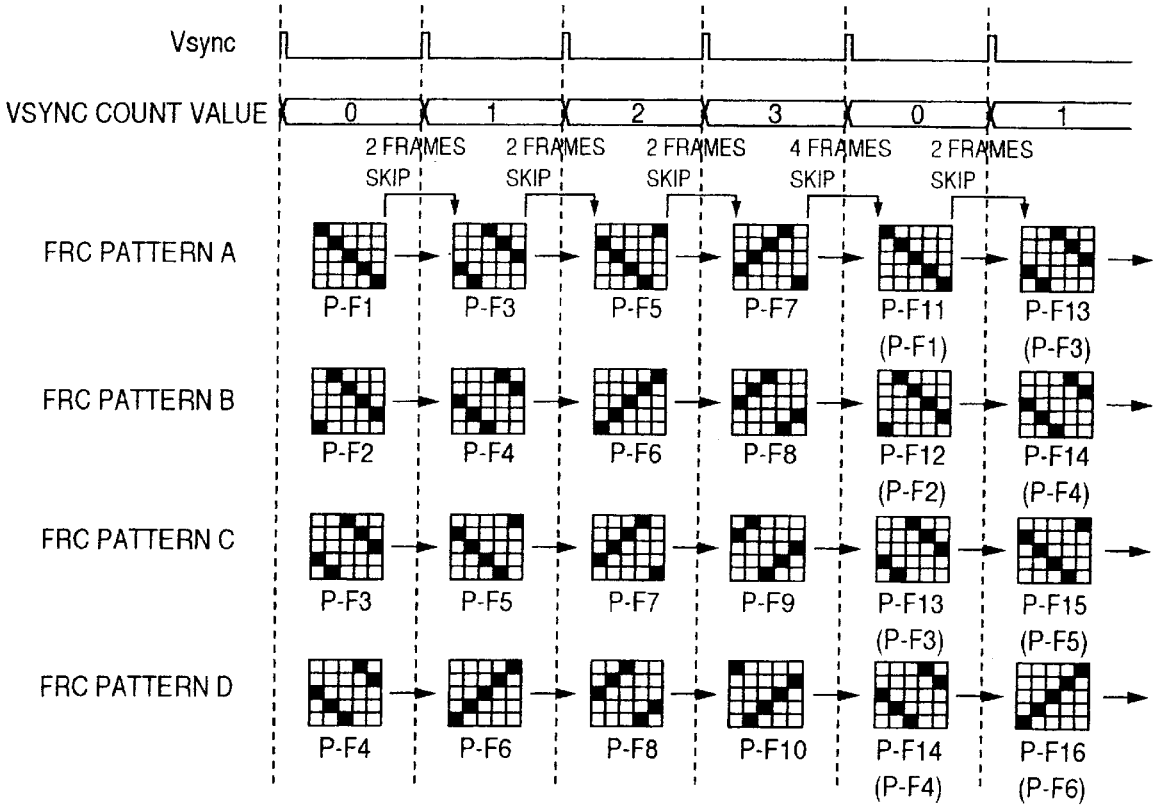
FIG. 7 shows FRC patterns constituted by the indicate on/off data generated by the FRC decoder in order to form such FRC patterns as shown in FIG. 6.

In this case, the FRC decoders 101 to 104 (see FIG. 3) are set to generate indicate on/off data for formation of such FRC patterns as shown in FIG. 7, with respect to input pixels.

As shown in FIG. 7, the FRC pattern A is made up of indicate on/off data issued from the FRC decoder 101, the FRC pattern B is made up of indicate on/off data issued from the FRC decoder 102, the FRC pattern C is made up of indicate on/off data issued from the FRC decoder 103, and the FRC pattern D is made up of indicate on/off data issued from the FRC decoder 104.

Turning back to FIG. 3, explanation will be continued.

The write data selector 106, according to the Vsync count value issued from the Vsync counter 105, selects indicate on/off data corresponding to 3 of 4 FRC patterns issued from the FRC decoders 101 to 104.

More in detail, as shown in FIG. 5, when the Vsync count value is even ("0" or "2"), the write data selector 106 selects the indicate on/off data (which form the first FRC pattern denoted by D-F1 (1st)) issued from the FRC decoder 101, selects the indicate on/off data (which form the second FRC pattern denoted by D-F2 (2nd)) issued from the FRC decoder 102, and selects the indicate on/off data (which form the first FRC pattern denoted by D-F3 (3rd)) issued from the FRC decoder 103.

When the Vsync count value is odd ("1" or"3"), on the other hand, the write data selector 106 selects the indicate on/off data (which form the fourth FRC pattern denoted by D-F4 (4th)) issued from the FRC decoder 102, selects the indicate on/off data (which form the fifth FRC pattern denoted by D-F5 (5th)) issued from the FRC decoder 103, and selects the indicate on/off data (which form the sixth FRC pattern denoted by D-F6 (6th)) issued from the FRC decoder 104. The respective indicate on/off data will be also denoted by 1st to 6th.

As has been mentioned above, FRC operator 21 (refer to FIG. 2) in the present embodiment has such FRC processing circuits as shown in FIG. 3, with respect to the respective gray-scale data (RA, RB, GA, GB, BA, BB) applied to the liquid crystal controller 3.

Therefore, with respect to the respective gray-scale data (RA, RB, GA, GB, BA, BB), the FRC operator 21 can generate indicate on/off data (1st, 2nd, 3rd or 4th, 5th, 6th) corresponding to 3 frames on the basis of gray-scale data corresponding to one frame.

More specifically, within one frame period, the indicate on/off data of 3 types of FRC patterns are output in 2-bit parallel, for each color R, G or B.

Explanation will then be made as to the data width converter 22.

The data width converter 22 converts 3 types of indicate on/off data (1st, 2nd, 3rd or 4th, 5th, 6th) of 2-bit parallel issued from the FRC operator 21 for each color R, G or B into indicate on/off data of 16-bit parallel.

Figure 8:
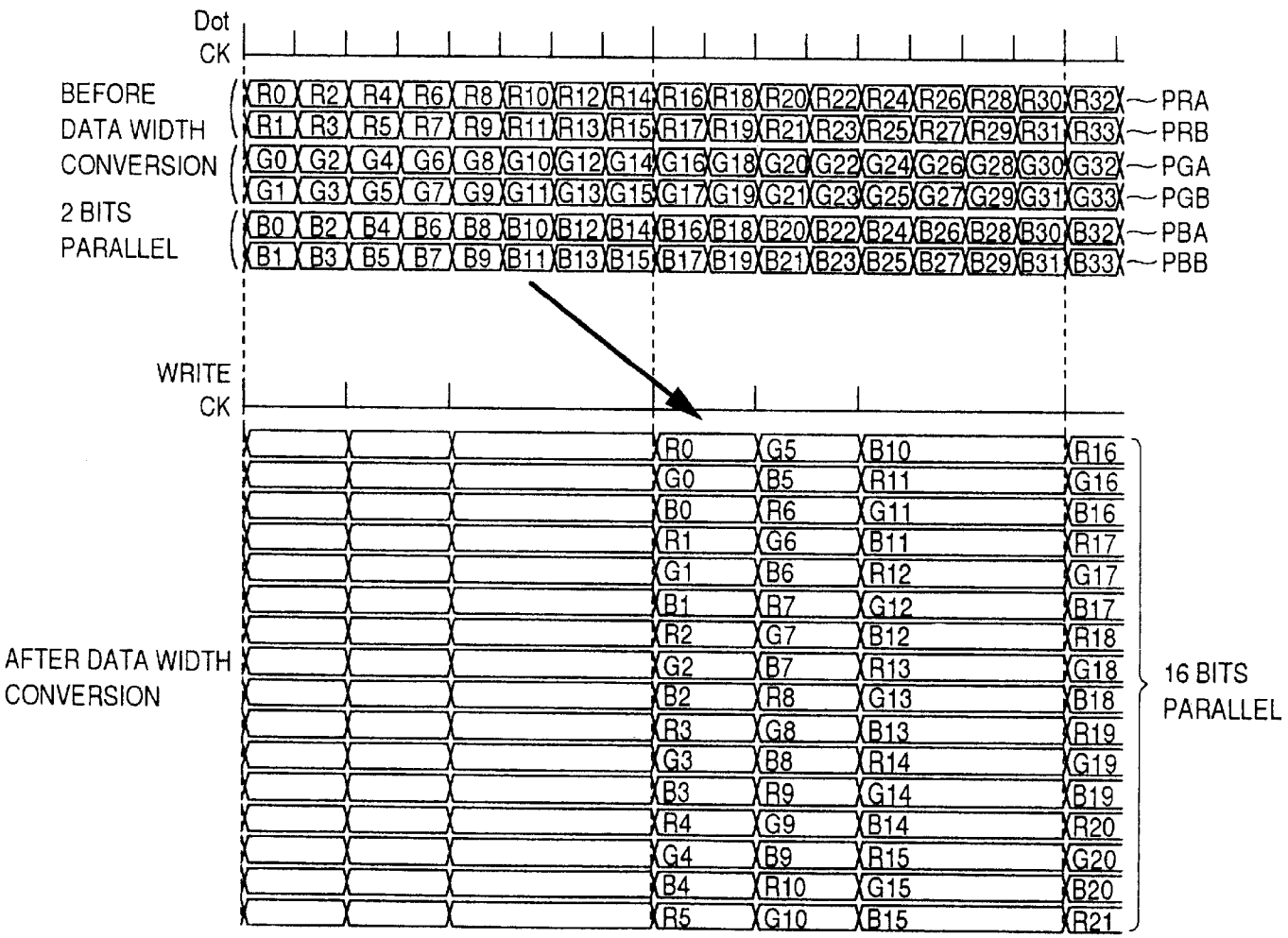
FIG. 8 is a timing chart for explaining the operation of an indicate data width converter shown in FIG. 2.

FIG. 8 shows a timing chart for explaining the operation of the data width converter 22 shown in FIG. 2.

Reference symbol PRA denotes indicate on/off data corresponding to the gray-scale data RA, symbol PGA denotes indicate on/off data corresponding to the gray-scale data GA, PGB denotes indicate on/off data corresponding to the gray-scale data GB, PBA denotes indicate on/off data corresponding to the gray-scale data BA, PBB denotes indicate on/off data corresponding to the gray-scale data BB.

Further, symbols RN, GN and BN (N being integer) denote indicate on/off data corresponding to the gray-scale data of the N-th pixel.

In FIG. 8, for the convenience of explanation, only any one of the 3 types of indicate on/off data (1st, 2nd, 3rd or 4th, 5th, 6th) of 2-bit parallel issued for each color R, G or B will be illustrated as processed.

The data width converter 22 rearranges the indicate on/off data of the respective colors issued from the FRC operator 21 in such a manner that the pixels are in order and the colors in the pixels are in the order of R, G and B, e.g., in such an order as R0, G0, B0, R1, G1, B1, R2, . . . , as shown in FIG. 8. And the data width converter 22 outputs a plurality of pieces of data (corresponding to 16 data in the illustrated example) on a parallel basis.

Such operation as mentioned above can be realized, for example, by using a plurality of buffers or the like and controlling writing and reading operations of the indicate on/off data to and from the buffers.

Next the line memory group 23 and line memory controller 33 will be explained.

The line memory group 23 is arranged as shown in FIG. 2, so that a plurality of line memories having a 16-bit bus width are connected in parallel.

The line memory controller 33 writes therein the 3 types of indicate on/off data (1st, 2nd, 3rd or 4th, 5th, 6th) of 16-bit parallel issued from the data width converter 22 sequentially by an amount corresponding to every 2 lines, and reads out it after a time corresponding to twice that of the write signal Hsync.

In this case, a read clock from the line memory group 23 is controlled to be faster than a write clock to the line memories.

Explanation will next be made as to the data selector/data width converter 24.

Figure 9:
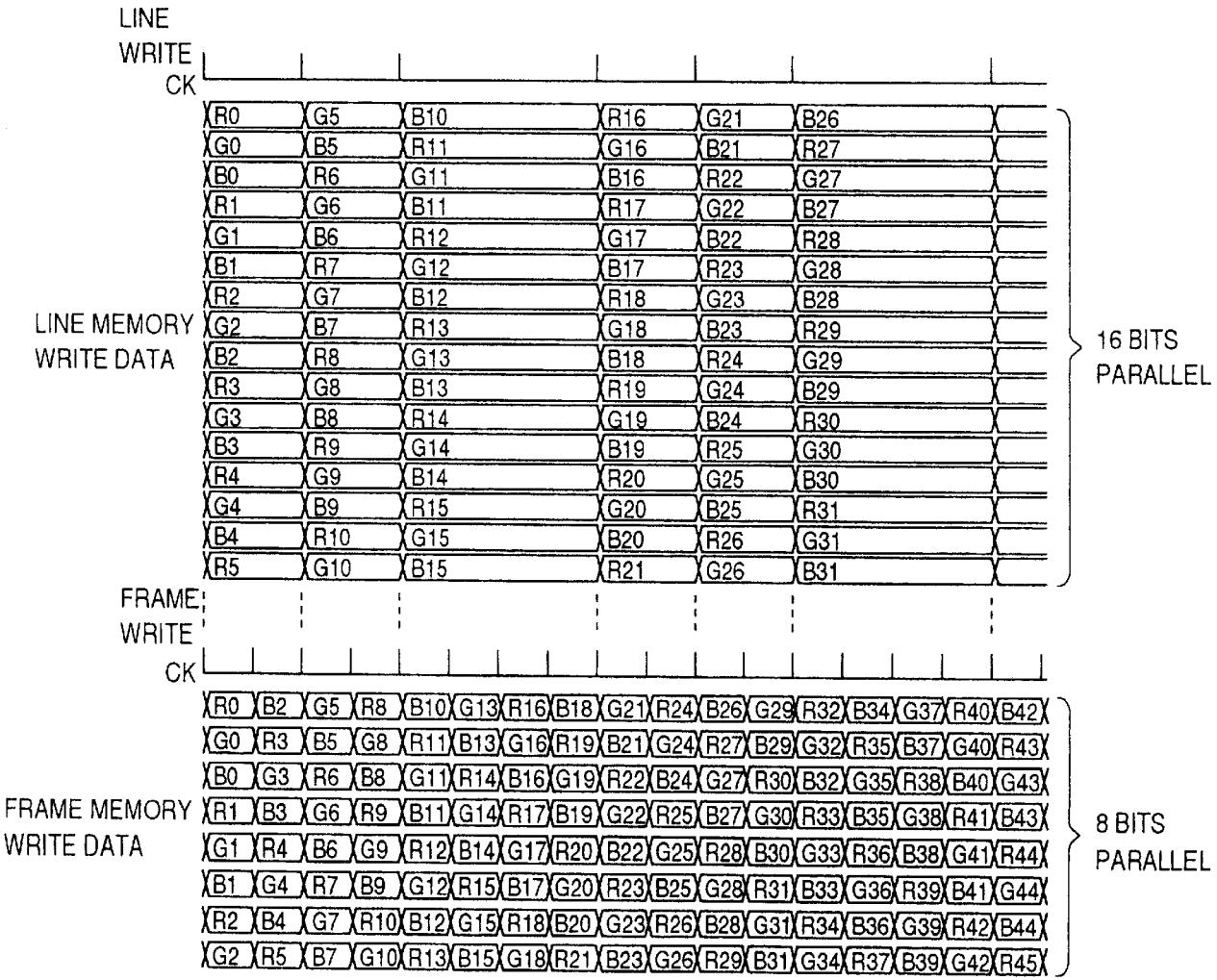
FIG. 9 is a timing chart for explaining the output bus width converting operation of he indicate on/off data of a data selector/data width converter.
Figure 10:
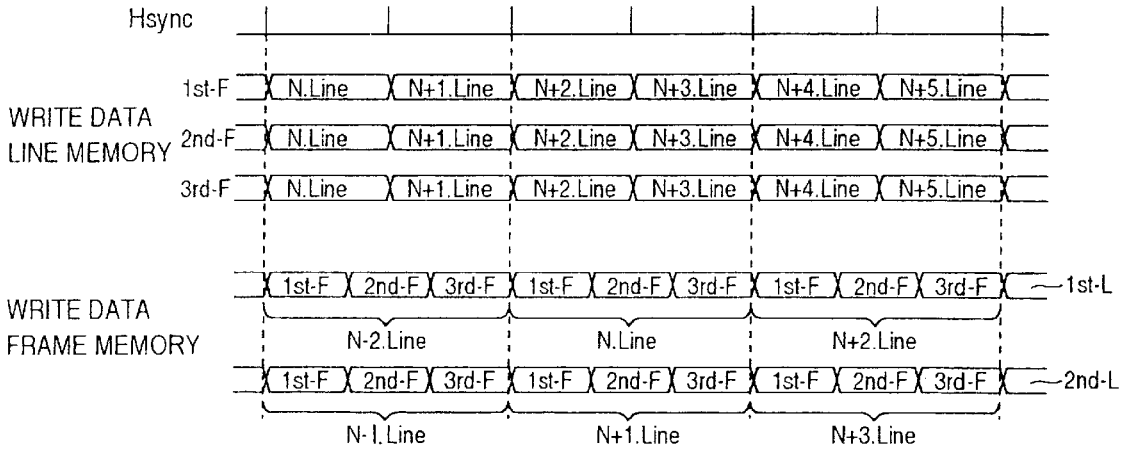
FIG. 10 is a timing chart for explaining the order re-arranging operation of the indicate on/off data of the data selector/data width converter of FIG. 2.
Figure 11:
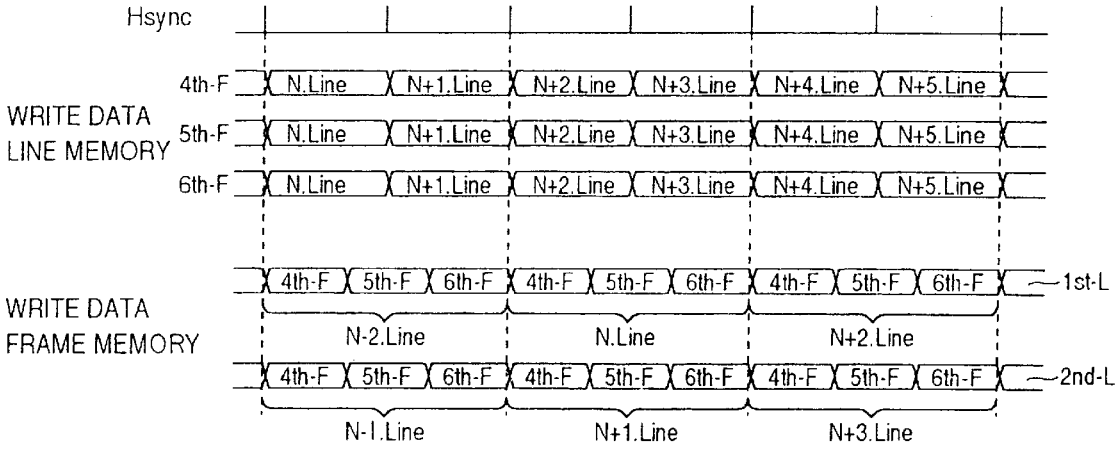
FIG. 11 is another timing chart for explaining the order re-arranging operation of the indicate on/off data of the data selector/data width converter of FIG. 2.

FIG. 9 is a timing chart for explaining the indicate on/off data output bus width converting operation of the data selector/data width converter 24, and FIGS. 10 and 11 are timing charts for explaining the indicate on/off data order rearranging operation of the data selector/data width converter 24.

The data selector/data width converter 24, as shown in FIG. 9, converts the indicate on/off data of 16-bit parallel read out from the line memory group 23 to indicate on/off data of 8-bit parallel.

In the present embodiment, as mentioned above, the line memory controller 33 controls the line memory group 23 in such a manner that the read clock of the indicate on/off data from the line memory group 23 is faster than the write clock into the line memory group 23.

As a result, as shown in FIG. 9, the transmission rate of indicate on/off data subjected to the data width conversion by the data selector/data width converter 24 is set to be 4/3 times the transmission rate of the indicate on/off data applied to the line memory group 23.

Illustrated in FIG. 9, for the convenience of explanation, is the operation of only the indicate on/off data of any one of the 3 types of indicate on/off data (1st, 2nd, 3rd or 4th, 5th, 6th) read out on a 2-line basis from the line memory group 23.

The data selector/data width converter 24, as shown in FIGS. 10 and 11, read out the indicate on/off data from the line memory group 23 on every 2-line basis, rearranges the order of the 3 types of indicate on/off data (1st, 2nd, 3rd or 4th, 5th, 6th) having a data width converted to 8-bit parallel, and then convert them to indicate even-number-th lines of on/off data 1st-L and odd-number-th lines of indicate on-off data 2nd-L. And the data selector/data width converter 24 outputs the converted indicate on/off data during a period corresponding to twice that of the signal Hsync.

FIG. 10 shows an example when 3 types of indicate on/off data read out from the line memory group 23 on every 2-line basis are 1st, 2nd and 3rd indicate on/off data, are converted to even-numbered lines of indicate on/off data 1st-L and odd-number-th lines of indicate on-off data 2nd-L, and then output during a next period corresponding to twice that of the horizontal synchronous signal Hsync.

FIG. 11 shows an example when 3 types of indicate on/off data read out from the line memory group 23 on every 2-line basis are 4th, 5th and 6th indicate on/off data, are converted to even-numbered lines of indicate on/off data 1st-L and odd-number-th lines of indicate on-off data 2nd-L, and then output during a next period corresponding to twice that of the horizontal synchronous signal Hsync.

As shown in FIGS. 10 and 11, the transmission rate of the indicate on/off data 1st-L and 2nd-L issued from the data selector/data width converter 24 are 3/2 times the transmission rate of the indicate on/off data applied to the line memory group 23.

That is, the transmission rate of the indicate on/off data applied to the line memory group 23 shown in FIG. 9 is faster than 4/3 times of the transmission rate of the indicate on/off data subjected to the data width conversion.

This is because so-called horizontal retrace (blanking) periods as periods other than non-transmission periods of input effective indicate data are intended to be present.

For example, in the case where a liquid crystal display is of a so-called extended graphics array (XGA) type wherein the display has a screen resolution of 1024×768 dots, a horizontal retrace period corresponding to 64 or more signals DotCK is set to be provided in the input signals, while no horizontal retrace period is to be provided in write data to the frame memories 8*a* and 8*b*.

In this case, there is satisfied a relationship which follows.

$$(512+\text{horizontal retrace period of 64 dots})\times 2\times \text{signal Hsync}\times 4/3 \geqq 512\times 3\times \text{signal Hsync}$$

In this case, 512 is obtained by dividing the number 1024 of clocks in the signal Dot during the signal sync by the number 2 of bits of the indicate on/off data. Meanwhile 4/3 indicates a ratio of the transmission rate of the indicate on/off data applied to the line memory group 23 with respect to the transmission rate of the indicate on/off data subjected to the data width conversion.

It will be seen from the above relationship that 3 lines of indicate on/off data can be read out during a period corresponding to twice that of the signal Hsync.

Explanation will next be made as to the frame memory controllers 25 and 26.

The frame memory controllers 25 and 26 perform alternate switching between the read and write operations from and to the frame memories 8*a* and 8*b* on every unit time basis of twice the period of the signal Vsync.

More concretely, as shown in FIG. 5, the frame memory 8*a* is controlled to be put in its write state and the frame memory 8*b* is to be put in its read state when the Vsync count value is "0" or "1"; whereas, the frame memory 8*a* is controlled to be put in its read state and the frame memory 8*b* is to be put in its write state when the Vsync count value is "2" or "3".

As has been explained above, the data selector/data width converter 24, as shown in FIGS. 10 and 11, rearranges the order of 3 types of indicate on/off data (1st, 2nd, 3rd or 4th, 5th, 6th) of 8-bit parallel, converts them to even-number-th lines of indicate on/off data 1st-L and odd-number-th lines of indicate on/off data 2nd-L, and then output during a period corresponding to twice the period of the signal Hsync.

Accordingly, even-number-th lines of indicate on/off data 1st-L of 8-bit parallel and odd-number-th lines of indicate on/off data 2nd-L of 8-bit parallel are written into the frame memories 8*a* and 8*b*, when the Vsync count value is "0" or "1" and "0" or "1", respectively.

This results in that indicate on/off data corresponding to 6 frames are written into the frame memories 8*a* and 8*b* during a period corresponding to twice that of the signal Vsync.

Figure 12A:
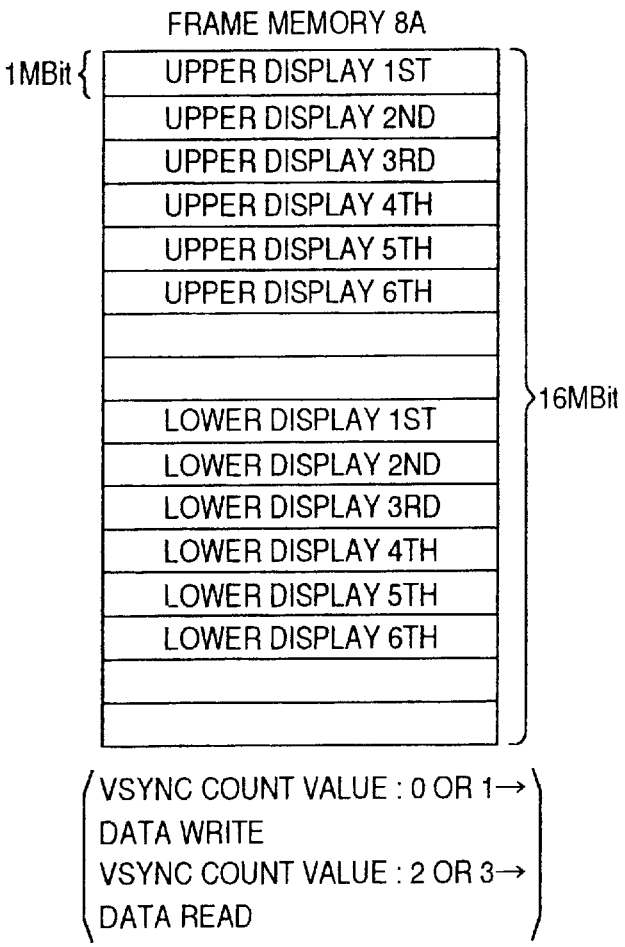
FIGS. 12A and 12B show examples of storage locations of indicate on/off data in the frame memories shown in FIG. 2.
Figure 12B:
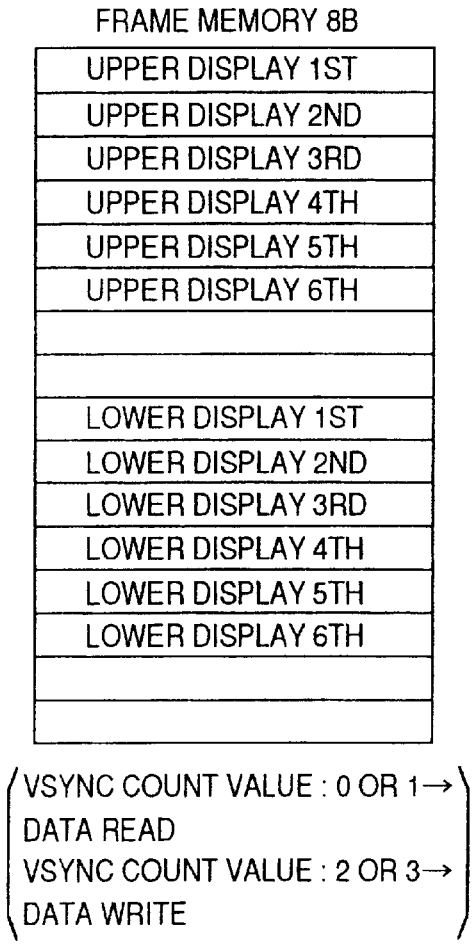

Shown in FIGS. 12A and 12B is an example of storage locations of the indicate on/off data in the frame memories 8*a* and 8*b*.

As has been explained above, in the present embodiment, the liquid crystal controller 3 is supposed to be used for the STN liquid crystal display 9 of a so called dual scan type wherein upper and lower divisions of a display screen are driven at the same time.

In the example of FIGS. 12A and 12B, the indicate on/off data of pixels forming the display screen are stored in the frame memories 8*a* and 8*b* as divided into two pieces of data for the upper and lower display screens.

With respect to the upper and lower display screens, the indicate on/off data are stored on a frame basis. In FIGS. 12A and 12B, for example, '1st' denotes a group of indicate on/off data forming the first display frame, and '2nd' denotes a group of indicate on/off data forming the second display frame.

Such allocation of storage locations to the frame memories 8*a* and 8*b* can be realized by referring to the signals Vsync and Hsync.

Usable as the frame memories 8*a* and 8*b* is, for example, HM5216165 (manufactured by Hitachi Ltd. and explained in a book entitled "IC memory data book", pp. 1023–1071).

The data selector/data width converter 29 will next be explained.

The data selector/data width converter 29 adjusts read timing of the indicate on/off data from the frame memories 8*a* and 8*b* so that the indicate on/off data can be transmitted at a transmission rate corresponding to 4/5 times the transmission rate when the indicate on/off data were written into the frame memories 8*a* and 8*b*.

Figure 13:
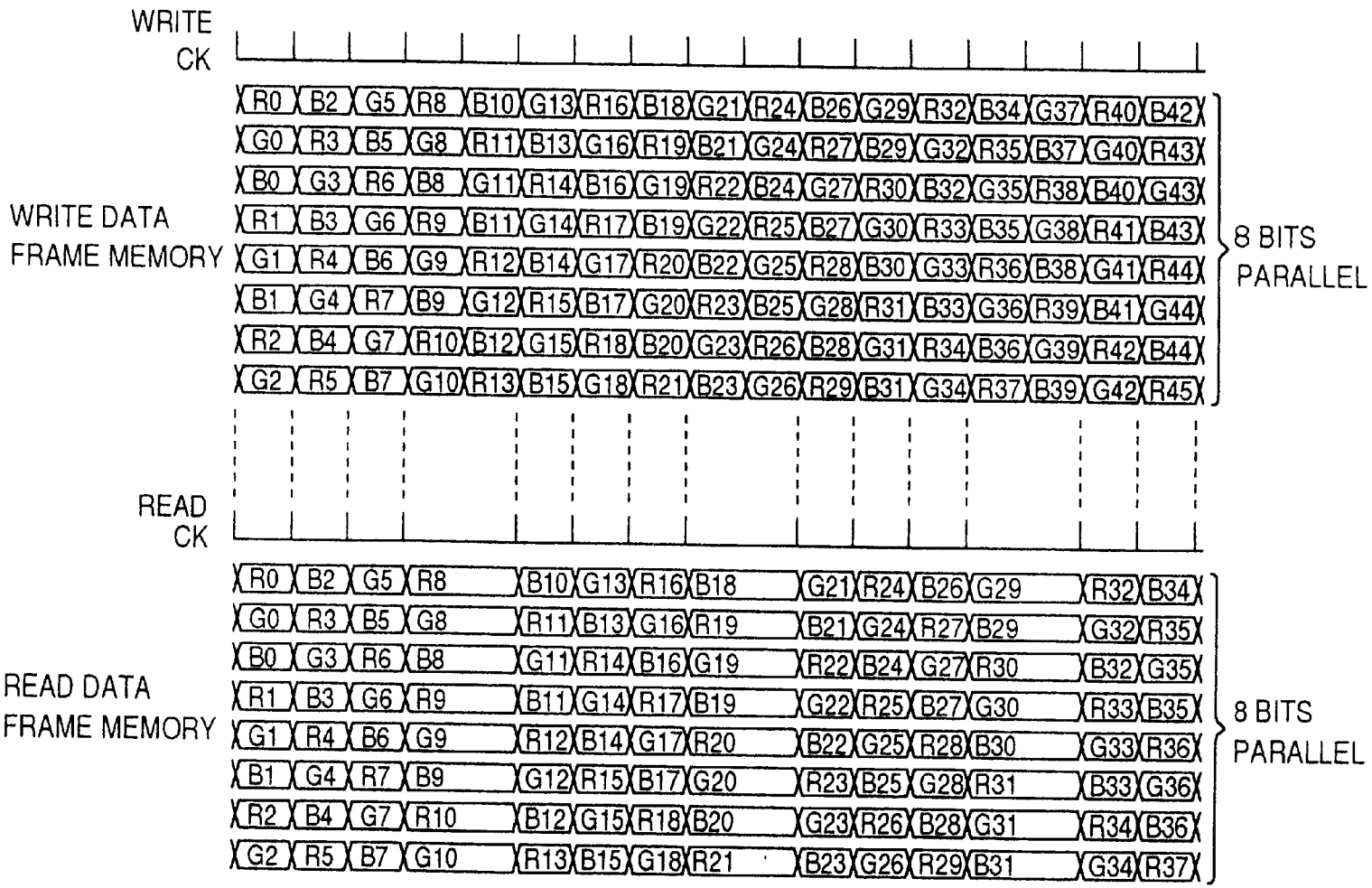
FIG. 13 is a timing chart showing read timing of the indicate on/off data from the frame memories in FIG. 2, with write and read clocks to and from the frame memories as its time axis.

FIG. 13 is a timing chart showing the read timing of the indicate on/off data from the frame memories 8*a* and 8*b*, with write and read clocks to the frame memories 8*a* and 8*b* used as its time axis.

In reality, indicate on/off data of 2 lines (one line being 8-bit parallel) are alternately read from the frame memories 8*a* and 8*b* at intervals of a period corresponding to twice the period of the signal Vsync. In the drawing, for easy understanding, however, timing of only indicate on/off data of one line is illustrated.

The data selector/data width converter 29 reads the indicate on/off data of the upper display and the indicate on/off data of the lower display from the frame memories 8*a* and 8*b*.

Figure 14:
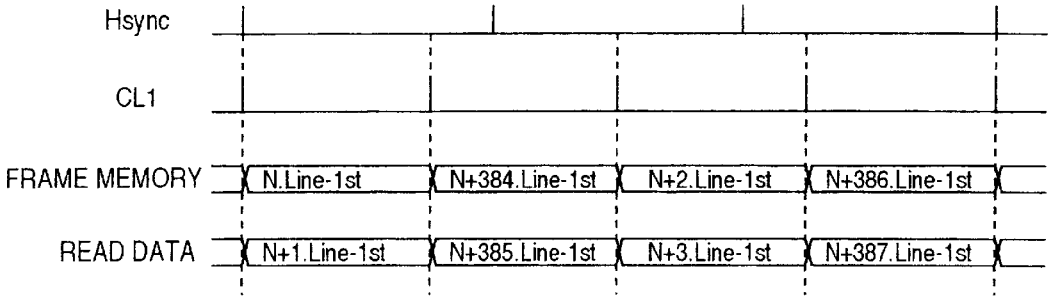
FIG. 14 is a timing chart showing read timing of the indicate on/off data from either one of the frame memories of FIG. 2, with signals Hsync and CL1 as its time axis.

FIG. 14 is a timing chart showing read timing of the indicate on/off data from either one of the frame memories 8*a* and 8*b*, with the signals Hsync and CL1 used as its time axis. In the drawing, N+384.LINE and subsequent data indicate the indicate on/off data of lines for the lower display.

In this connection, as has been explained above, indicate on/off data of 6 frames are written in the frame memories 8*a* and 8*b* during a period corresponding to twice the period of the signal Vsync by the data selector/data width converter 24. And the indicate on/off data read out during a next period corresponding to twice the period of the signal Vsync by the data selector/data width converter 29 correspond to 5 frames in the timing chart of FIG. 5.

More in detail, as shown in FIG. 5, when the Vsync count value is "0" or "1", frame indicate on/off data are read out from the frame memory 8*b in the order of* 2nd, 3rd, 4th, 5th and 6th. When the Vsync count value is "2" or "3", frame indicate on/off data are read out from the frame memory 8*a* in the order of 1st, 2nd, 3rd, 4th and 5th. between the horizontal period of the horizontal synchronous signal Hsync and the horizontal period of the horizontal synchronous signal CL1 of liquid crystal output data in the input signals is 5 times the period of the signal CL1 to 4 times the period of the signal Hsync. This is because, as shown in FIG. 13, the transmission rate of indicate on/off data read out from the frame memories 8*a* and 8*b* is set to be 4/5 times the transmission rate (corresponding to twice the period of the signal Vsync and thus to 6 frames) when the indicate on/off data were written in the frame memories 8*a* and 8*b*. As a result, the drive frame frequency FLM of liquid crystal output data becomes;

$$\text{Vsync} \times 5/4 \times 2 \text{ (for driving of two upper and lower displays)} = 2.5 \text{ Vsync}$$

Accordingly, the drive frame frequency to be output to the STN liquid crystal display is 2.5 times the drive frame frequency of the input signal.

Further, the data selector/data width converter 29 converts the data width of the respective indicate on/off data of the upper and lower displays read out alternately from the frame memories 8*a* and 8*b* on every 2-line basis, from 8-bit parallel to 16-bit parallel.

In FIG. 2, reference symbol 1st-L' denotes 16-bit parallel indicate on/off data associated with the indicate on/off data of the upper and lower displays read out from the frame memory 8*a;* reference symbol 2nd-L' denotes 16-bit parallel indicate on/off data associated with the indicate on/off data of the upper and lower displays read out from the frame memory 8*b*.

Explanation will then be made as to the line memory group 30 and line memory controller 34.

The line memory group 30, as shown in FIG. 2, is made up of line memories Ab to Db of a 16-bit bus width.

The line memory controller 34 controls write and read operations of the 16-bit parallel indicate on/off data 1st-L' and 2nd-L' issued from the data selector/data width converter 29.

Of the 16-bit parallel indicate on/off data 1st-L' and 2nd-L' issued from the data selector/data width converter 29, indicate on/off data corresponding to predetermined lines are passed through the line memory group 30 and then sent to the data selector 31.

Figure 15:
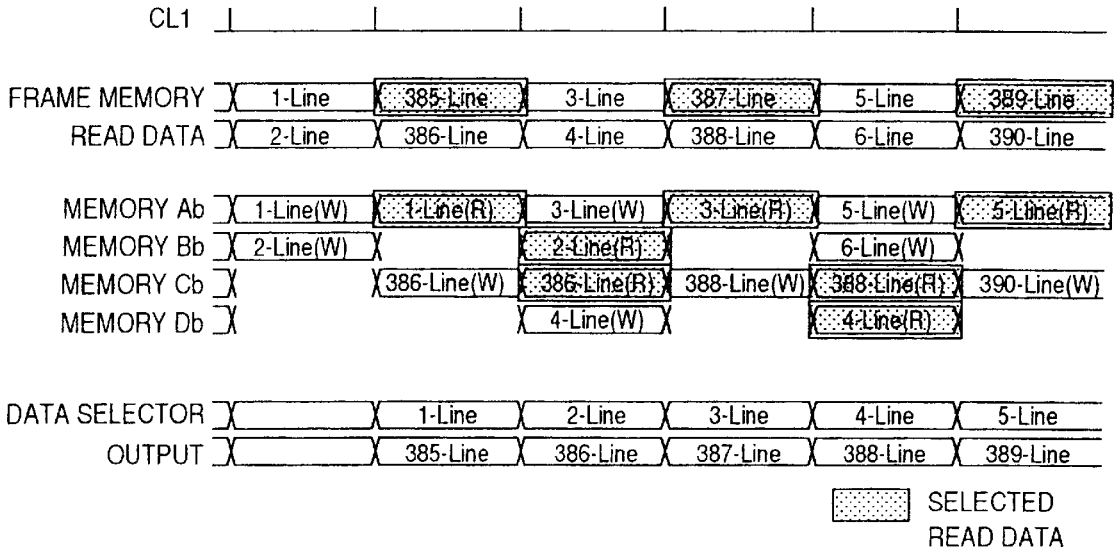
FIG. 15 is a timing chart showing timing between write and read operation of the indicate on/off data to and from a group of line memories and the indicate on/off data outputted to a data selector shown in FIG. 2.

FIG. 15 is a timing chart showing write and read operations of indicate on/off data to and from the line memory group 30 as well as timing of indicate on/off data issued to the data selector 31.

As shown in FIG. 15, the data selector/data width converter 29 alternately outputs 2 lines of 16-bit parallel indicate on/off data with respect to the upper and lower displays.

The line memory controller 34 controls the write and read operations of 2 lines of 16-bit parallel indicate on/off data sequentially issued from the data selector/data width converter 29 with respect to the line memory group 30, to thereby output the indicate on/off data of lines of the upper and lower displays from any two of output terminals a to e of the line memory group 30 simultaneously.

The aforementioned operation will be explained in detail with use of FIG. 15.

(1) First of all, the first Line of indicate on/off data 1-Line of the upper display as well as the second Line of indicate on/off data 2-Line of the upper display, simultaneously sent from the data selector/data width converter 29, are written into the respective Line memories Ab and Bb.

(2) With respect to the 385-th and 386-th Lines of indicate on/off data 385-Line and 386-Line of the lower display, simultaneously sent from the data selector/data width converter 29; the data 385-Line is passed through the Line memories and output from its output terminal e, while the data 386-Line is written into the Line memory Cb.

Further, the data 1-Line written in the Line memory Ab is read out therefrom and output from the output terminal a, in synchronism with the output of the data 385-Line from the output terminal e.

(3) The 3-rd and 4-th Lines of indicate on/off data 3-Line 4-Line of the upper display simultaneously sent from the data selector/data width converter 29 are written into the Line memories Ab and Db respectively.

Simultaneously with the above, the data 2-Line written in the Line memory Bb as well as the data 386-Line written in the line memory Cb are read out therefrom and output simultaneously from the respective output terminals b and c.

Through the repetition of the operations similar to those of (1) to (3), the indicate on/off data of lines of the upper display as well as the indicate on/off data of lines of the lower display are output at the same time.

Explanation will next be made as to the data selector 31.

The data selector 31 controls, as shown in FIG. 2, the indicate on/off data of lines of the upper and lower displays simultaneously issued from any two of the output terminals a to e of the line memory group 30 in such a manner that the indicate on/off data of lines of the upper display is output from the output terminal f and the indicate on/off data of lines of the lower display is output from the output terminal g.

The data width converter 32 will then be explained.

The data width converter 32 converts the data width of the indicate on/off data of lines of the upper and lower displays issued from the data selector 31, to 12-bit parallel data for the liquid crystal 9, respectively.

The 12-bit parallel data (24 bits in total) of the upper and lower displays are output to the liquid crystal display 9, together with the signals CL1, CL2 and FLM generated in the timing signal generator 35.

In this embodiment of the present invention, indicate on/off data of 3 frames of the output signals are written in the frame memories 8*a* and 8*b,* and the 3 lines of indicate on/off data written therein are sequentially read out therefrom in synchronism with the frame period FLM of the output signal.

In this manner, the data written in the frame memories 8*a* and 8*b* are one bit of indicate on/off data subjected to the FRC operation, whereby the data bus width at the time of accessing the frame memories can be reduced to 16 lines per one frame memory.

Since 3 frames of indicate on/off data are sequentially written within one-frame period of the input signal, the FRC patterns can be switched for every frame period FLM of the output signal having a frame frequency corresponding to 2.5 times the input frame frequency.

Therefore, the object of the present invention, that is, the reduction of flow of the intermediate gray-scale display portion and increase in the number of pins caused by formation of it in the form of an LSI can be suppressed.

Further, when one frame period in the input signal is used as a unit, the total number of bits in the data written in the frame memories 8*a* and 8*b* becomes (number of pixels of one frame)×(3 frames)×(one bit).

Meanwhile, when 6-bit gray-scale data are written directly into the frame memories 8*a* and 8*b*, the total number of bits in the data written in the frame memories 8*a* and 8*b* during one frame period of the input signal becomes (the number of pixels in one frame)×(6 bits).

Accordingly, when compared to the case of writing the gray-scale data directly in the frame memories 8*a* and 8*b*, the memory capacity can be saved.

Next, a second embodiment of the present invention will be explained.

Figure 16:
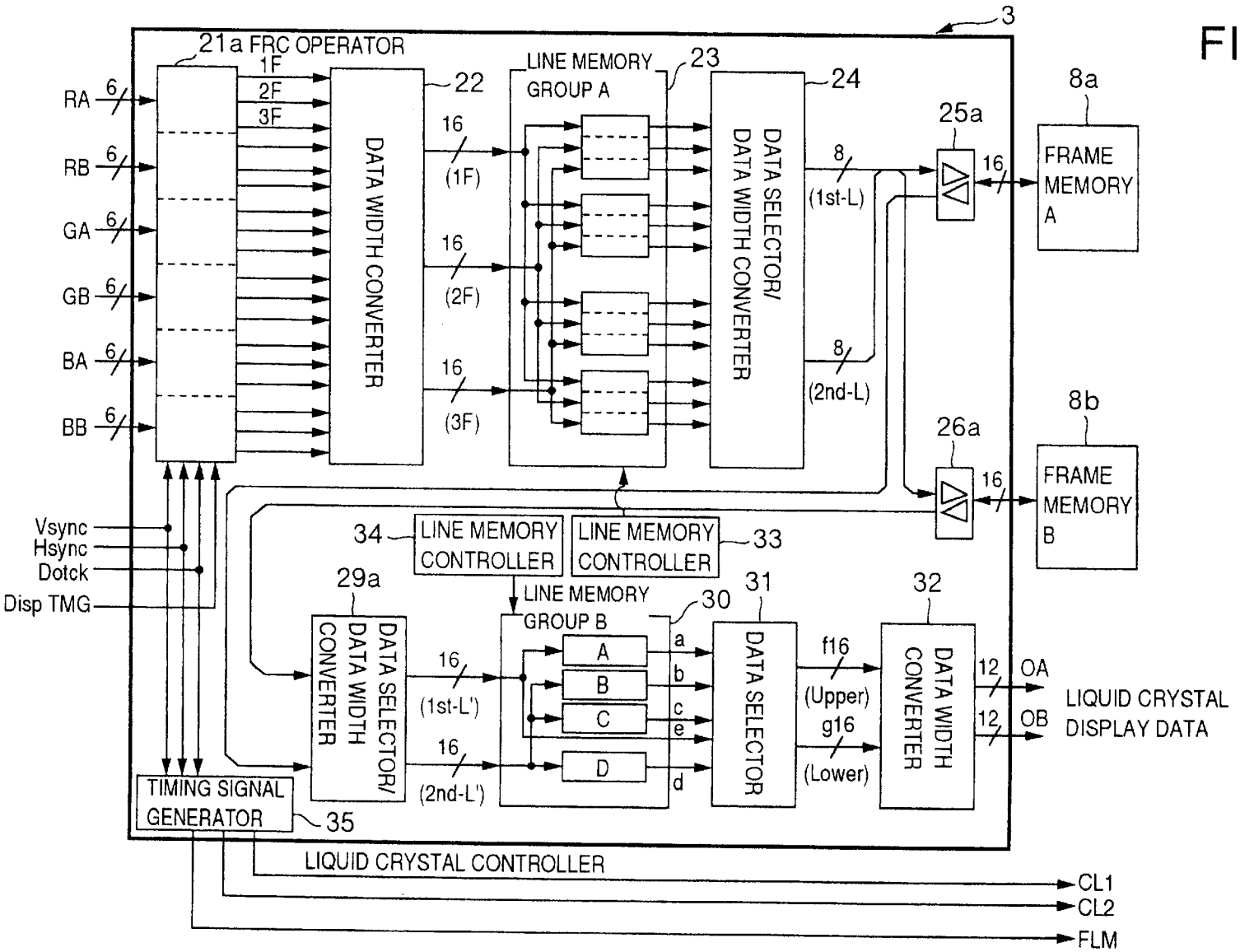
FIG. 16 is a schematic block diagram of a liquid crystal controller in accordance with a second embodiment of the present invention.

Referring to FIG. 16, there is shown a schematic block diagram of a liquid crystal controller in the second embodiment of the present invention.

The liquid crystal controller 3 shown in FIG. 16, similar to that of the first embodiment shown in FIG. 2, is intended for use with an STN liquid crystal display of a so-called dual scan type wherein upper and lower screens of a display are driven simultaneously. The display screen is of a so-called XGA type having a resolution of 1024×768 dots.

In FIG. 16, reference symbol 21*a* denotes an FRC operator for performing the intermediate gray-scale operation of an FRC system, symbols 25*a* and 26*a* denote frame memory controllers, symbol 29*a* denotes a data selector/data width converter.

The other arrangement is the same as that of the first embodiment of FIG. 2 and thus detailed explanation thereof is omitted with the same reference numbers or symbols attached thereto.

In the liquid crystal controller 3 in the first embodiment of FIG. 2, the drive frame frequency FLM of liquid crystal output data is set to be 2.5 times the frame frequency Vsync of the input signal (gray-scale data); whereas, in the liquid crystal controller 3 of the present embodiment of FIG. 16, the drive frame frequency FLM of the liquid crystal output data is set to be 3 times the frame frequency Vsync of the input signal (liquid crystal data).

Accordingly, one frame period of the input signal corresponds to 3-frame period of the output signal.

In the present embodiment, access control to the frame memories 8*a* and 8*b* is carried out with use of one frame period of the input signal as a unit.

Explanation will next be made in detail as to an arrangement of the liquid crystal controller 3 of the present embodiment different from that of the first embodiment of FIG. 2.

The FRC operator 21*a* will first be explained.

With respect to gray-scale data RA, RB, GA, GB, BA and BB applied to the liquid crystal controller 3; the FRC operator 21*a* generates 3 types of indicate on/off data per pixel. This causes 3 frames of indicate on/off data, i.e., 3 FRC patterns to be generated from one frame of gray-scale data.

The FRC operator 21*a* has FRC processing circuits provided for the respective gray-scale data RA, RB, GA, GB, BA and BB.

The FRC processing circuits generate 3 types of indicate on/off data per pixel, with respect to the corresponding gray-scale data.

Figure 17:
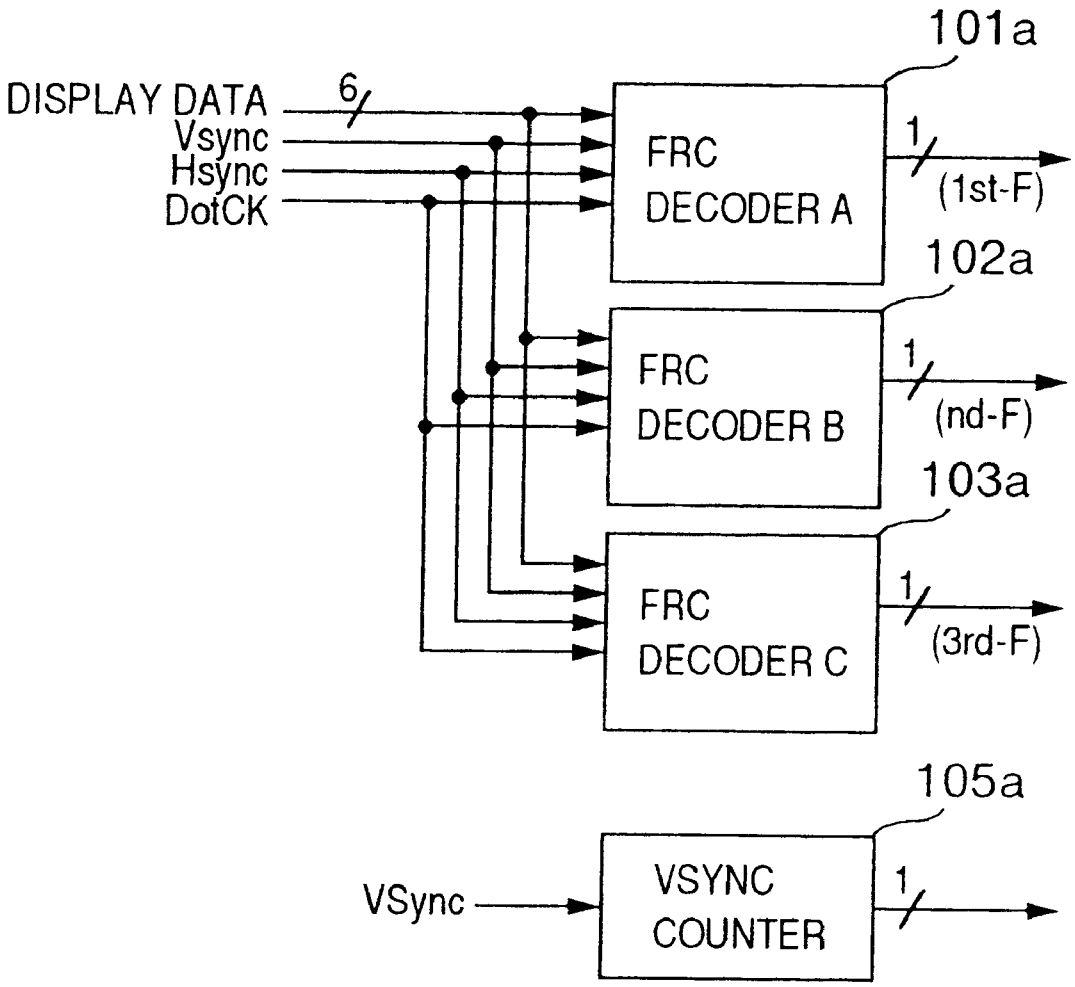
FIG. 17 is a schematic block diagram of an FRC operator for use in FIG. 16.

Shown in FIG. 17 is a schematic block diagram of the FRC processing circuits.

In the drawing, reference symbols 101*a* to 103*a* denote FRC decoders, and symbol 105*a* denotes a Vsync counter.

The Vsync counter 105*a* counts the signal Vsync and outputs one bit of Vsync count value. Accordingly, the Vsync count value can take "0" or "1".

With respect to the input gray-scale data of a pixel, the FRC decoders 101*a* to 103*a* generate indicate on/off data corresponding to the value of the gray-scale data.

Figure 18:
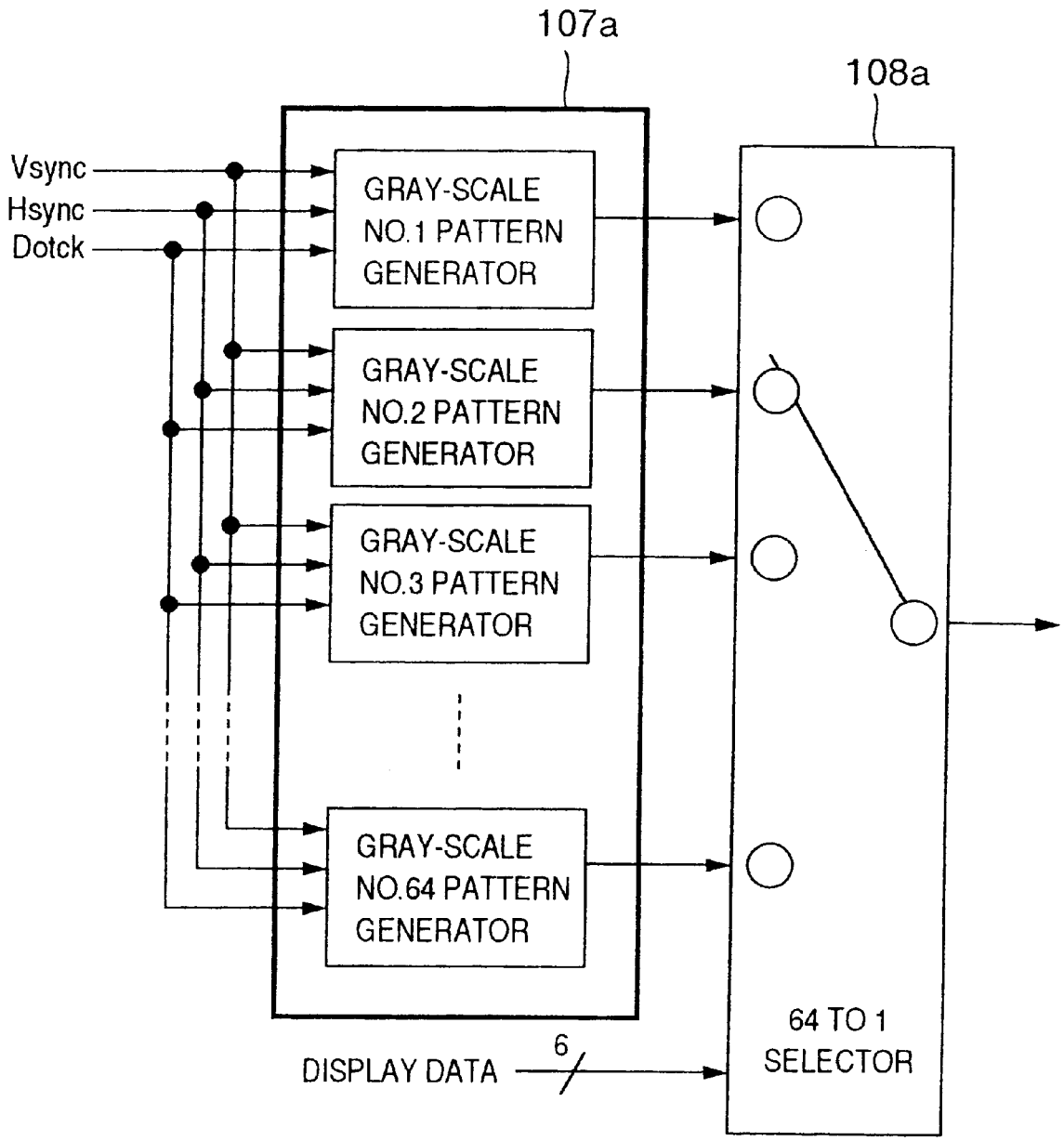
FIG. 18 is a schematic block diagram of FRC decoders in FIG. 17.

FIG. 18 is another schematic block diagram of the FRC decoders 101*a* to 103*a*.

The FRC decoders 101*a* to 103*a* include an FRC pattern generator 107*a* for generating indicate on/off data for formation of 64 types of FRC patterns associated with bits (6 bits) of gray-scale data per pixel and also include a selector 108*a* for selecting indicate on/off data of one of the 64 types of indicate on/off data generated by the FRC pattern generator 107*a* according to the value of the input gray-scale data of a pixel.

Now explanation will be made as to relationships between indicate on/off data issued from the FRC decoders 101*a* to 103*a*.

Figure 19:
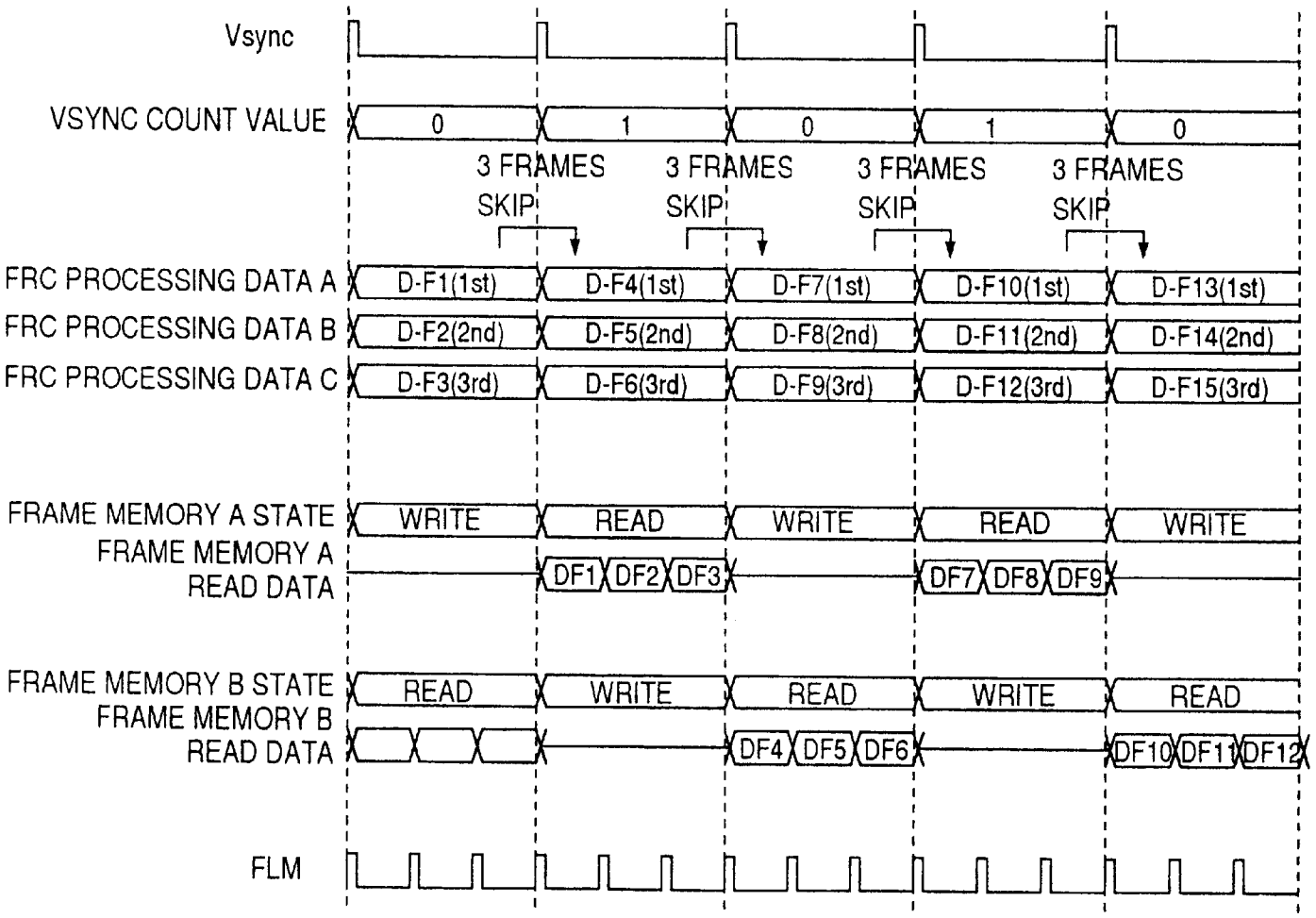
FIG. 19 is a timing chart for explaining indicate on/off data outputted from the FRC decoders of FIG. 18 and read/write control of frame memories in FIG. 16.

FIG. 19 is a timing chart for explaining indicate on/off data issued from the FRC decoders 101*a* to 103*a* as well as read/write control of the frame memories 8*a* and 8*b*.

In the drawing, FRC processing data A is indicate on/off data issued from the FRC decoder 101*a*, FRC processing data B is indicate on/off data issued from the FRC decoder 102*a*, and FRC processing data C is indicate on/off data issued from the FRC decoder 103*a*. Reference symbol D-FN (N being an integer) denotes indicate on/off data forming FRC patterns to be issued at the N-th frame.

As shown in FIG. 19, assuming that indicate on/off data generated by the FRC decoder 101*a* form FRC patterns to be output at the N-th frame, then the FRC decoder 102*a* generates indicate on/off data for formation of FRC patterns to be output at (N+1)-th frame, and the FRC decoder 103*a* generates indicate on/off data for formation of FRC patterns to be output at the (N+2)-th frame.

Each of the FRC decoders 101*a* to 103*a* generates indicate on/off data to be output at a frame previous by 3 frames each time the Vsync count value issued from the Vsync counter 105*a* varies.

As has been explained above, the FRC operator 21*a* of the present embodiment has such FRC processing circuits as shown in FIG. 17 provided for the respective gray-scale data RA, RB, GA, GB, BA and BB applied to the liquid crystal controller 3.

Accordingly, the FRC operator 21*a* generates indicate on/off data of 3 frame, that is, 3 FRC patterns, from the gray-scale data of one frame for each of the gray-scale data RA, RB, GA, GB, BA and BB.

That is, during one frame period, the indicate on/off data of the 3 types of FRC patterns are respectively output in a 2-bit parallel manner for each color of R, G or B.

Explanation will next be made as to the frame memory controllers 25*a* and 26*a*.

The frame memory controllers 25*a* and 26*a* alternately switch the read/write operations from and to the frame memories 8*a* and 8*b* for every signal Vsync.

More specifically, as shown in FIG. 19, the frame memory controllers 25*a* and 26*a* control the frame memories 8*a* and 8*b* in such a manner that the frame memory 8*a* is put in its write state and the frame memory 8*b* is put in its read state when the Vsync count value is "0", and that the frame memory 8*a* is put in its read state and the frame memory 8*b* is put in its write state when the vsync count value is "1".

Next the data selector/data width converter 29*a* will be explained.

The data selector/data width converter 29*a* controls read timing of the indicate on/off data from the frame memories 8*a* and 8*b* in such a manner that the indicate on/off data can be transmitted at the same transmission rate as that at the time of writing the indicate on/off data in the frame memories 8*a* and 8*b*.

Figure 20:
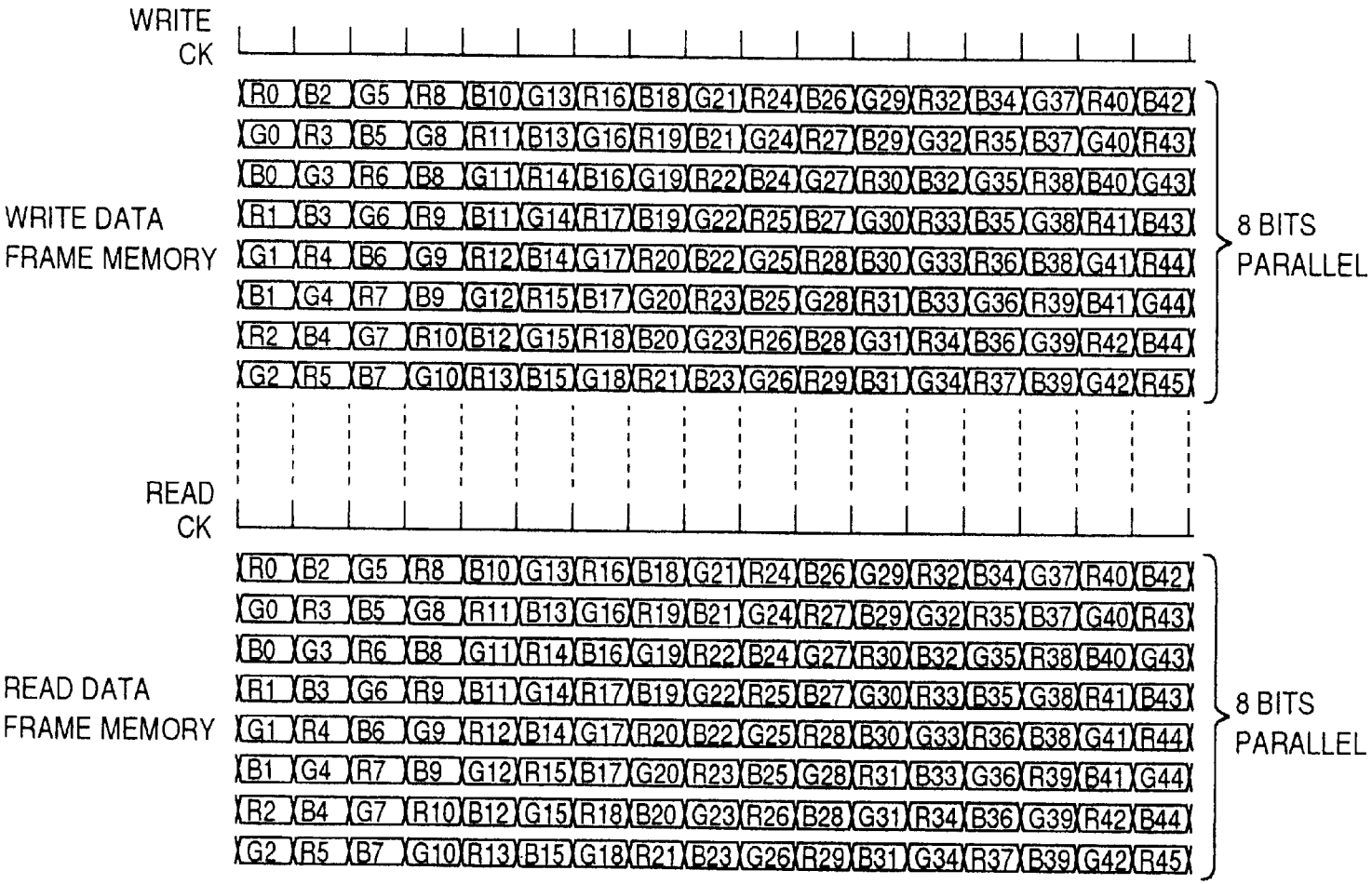
FIG. 20 is a timing chart showing read timing of indicate on/off data from the frame memories shown in FIG. 16, with write and read clocks of the frame memories as its time axis.

FIG. 20 is a timing chart showing the read timing of the indicate on/off data from the frame memories 8*a* and 8*b*, with use of write and read clocks to the frame memories 8*a* and 8*b* as its time axis.

In reality, indicate on/off data of 2 lines (one line being 8-bit parallel) at the same time are alternately read out from the frame memories 8*a* and 8*b* for every period corresponding to twice the period of the signal Vsync. In the illustrated example, however, for easy understanding, the timing of the indicate on/off data of only one line is illustrated.

The data selector/data width converter 29*a* alternately reads out 2 lines of indicate on/off data of the upper and lower displays from the frame memories 8*a* and 8*b*.

Figure 21:
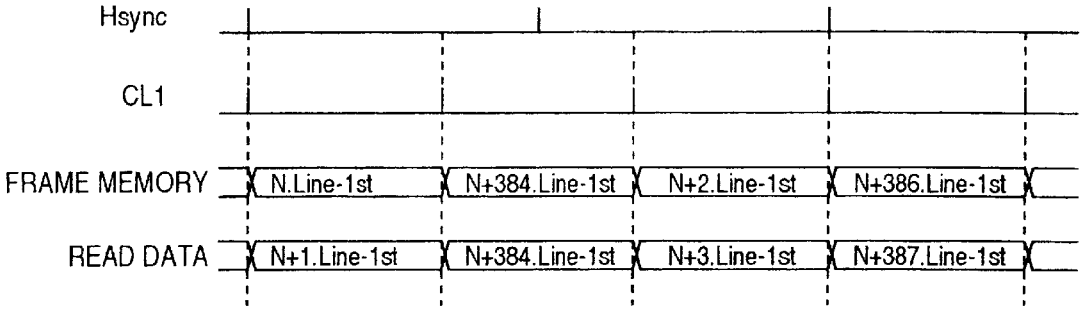
FIG. 21 is a timing chart showing read timing of indicate on/off data from either one of the frame memories shown in FIG. 16, with read timing signals Hsync and CL1 from either one of the frame memories as its time axis as its time axis.

FIG. 21 is a timing chart showing read timing of the indicate on/off data from either one of the frame memories 8*a* and 8*b*, with use of the signals Hsync and CL1 as its time axis. In this case, data (N+384.LINE) and subsequent data correspond to the indicate on/off data of lines of the lower display.

In the illustrated example, a ratio between the horizontal period of the horizontal synchronous signal Hsync and the horizontal period of the horizontal synchronous signal CL1 of liquid crystal output data in the input signal is 4 times the period of the signal Hsync and 6 times the period of the signal CL1. This results from the fact that, as shown in FIG. 20, the transmission rate at the time of reading the indicate on/off data from the frame memories 8*a* and 8*b* is set to be equal to the transmission rate (corresponding to 3 frames of the signal Vsync) at the time of writing the indicate on/off data in the frame memories 8*a* and 8*b*. As a result, the drive frame frequency FLM of the liquid crystal output data becomes:

$$\text{Vsync}\times 6/4\times 2 \text{ (for driving of upper and lower displays)}=3\times\text{Vsync}$$

Accordingly, the drive frame frequency to be output to the liquid crystal display 9 becomes 3 times the drive frame frequency of the input signal.

Further, the data selector/data width converter 29*a* converts the data width of the respective indicate on/off data of the upper and lower displays from 8-bit parallel to 16-bit parallel.

In FIG. 16, symbol "1st-L" denotes 16-bit parallel indicate on/off data corresponding to the indicate on/off data of the upper and lower displays read out from the frame memory 8*a*, while symbol "2nd-L" denotes 16-bit parallel indicate on/off data corresponding to the indicate on/off data of the upper and lower displays read out from the frame memory 8*b*.

In the second embodiment of the present invention, during one frame period of the input signal, 3 frames of indicate on/off data are written in the frame memories 8*a* and 8*b*, and the 3 frames of indicate on/off data written are sequentially read out therefrom in synchronism with the frame period FLM of the output signal.

In this manner, data to be written in the frame memories 8*a* and 8*b* is subjected to the FRC processing to form one bit of indicate on/off data, whereby the data bus width at the time of accessing the frame memories can be reduced to 16 per frame memory.

By sequentially writing 3 frames of indicate on/off data during one frame period of the input signal, the FRC pattern can be switched for every frame period FLM of the output signal having a frequency corresponding to 3 times the frequency of the input frame frequency.

Further, data stored in the frame memories 8*a* and 8*b* has 3 bits per pixel.

Accordingly, the flow of the intermediate gray-scale display part can be lightened and an increase in pins caused by the formation of an LSI can be suppressed.

When compared to the case where all gray-scale display data of 6 bits are written in the frame memories 8*a* and 8*b*, the memory capacity can be made smaller.

In the above first and second embodiments, the foregoing explanation has been made in connection with the case where the frame frequency of the liquid crystal output data is 2.5 times and 3 times the frame frequency of the input signal. However, the present invention is not limited to the specific example, but the same concept as in the above first and second embodiments may be realized, for example, even when the frame frequency of the liquid crystal output data is set to be twice the frame frequency of the input signal.

Further, although the liquid crystal controller for the STN liquid crystal display of a so-called dual scan type has been explained, the present invention may be widely applied as the liquid crystal controller for a liquid crystal display of a passive matrix type.

By the way, the liquid crystal controller 3 in the first and second embodiments may be made in the form of an LSI. In this case, the liquid crystal controller 3 in the form of an LSI is disposed, together with the frame memories 8*a* and 8*b*, within a liquid crystal module, e.g., on a printed circuit board having a liquid crystal driver mounted thereon or on a rear side thereof.

In this manner, the interface of the liquid crystal module can be made to be the same as the interface of a digital RGB or TFT liquid crystal having a plurality of bits of gray-scale information. Further, the liquid crystal controller 3 in the first and second embodiments of the present invention may be arranged to incorporate the frame memories 8*a* and 8*b*, in which case additional space saving can be realized.

In the first and second embodiments, by sharing constituent elements having the same functions, the single liquid crystal controller 3 can be commonly used to the first and second embodiments. In this case, mode change-over between the first and second embodiments can be implemented, e.g., with use of signal input terminals or the like.

A third embodiment of the present invention will next be explained.

As has been explained above, when the liquid crystal controller 3 is used for the so-called dual scan type of STN liquid crystal display to provide intermediate gray-scale display over the upper and lower displays, it sometimes appears that the interference fringes of the FRC display look like moving at a boundary between the upper and lower displays.

The cause of such interference fringes will be explained in connection with FIG. 22.

Figure 22:
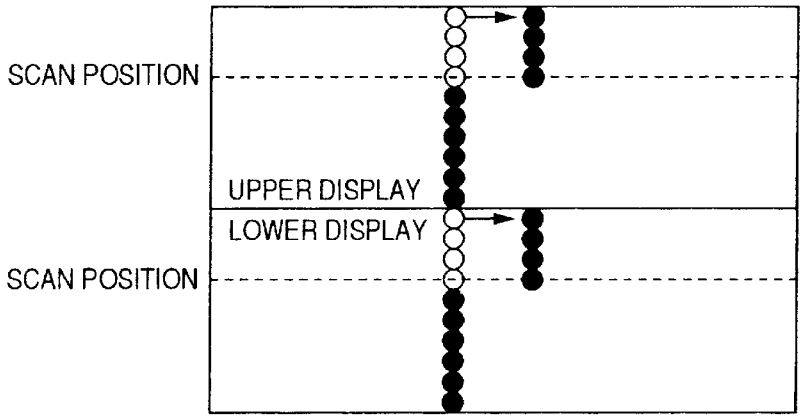
FIG. 22 is a diagram for explaining interference fringes generated when the FRC patterns are displayed over upper and lower screens of an STN liquid crystal display of a dual scan type under control of a liquid crystal controller.

FIG. 22 is a diagram for explaining interference fringes generated when the liquid crystal controller 3 is used to display FRC patterns over the upper and lower display screens of a dual scan type of STN liquid crystal display 9.

The illustrated example shows a manner vertical FRC patterns move for each frame.

As shown in FIG. 22, scanning is carried out on line-after-line basis on the STN liquid crystal display 9, so that, even the leading line of the lower display is already scanned, the last line of the upper display is not scanned yet, still leaving the pattern of the previous line.

As a result, the vertical line of the lower display looks like moving somewhat forwardly and thus the upper and lower displays lose the continuity in its looking manner of the display data.

This is the cause of such a phenomenon that interference fringes look like moving at the boundary between the upper and lower displays.

Figure 23:
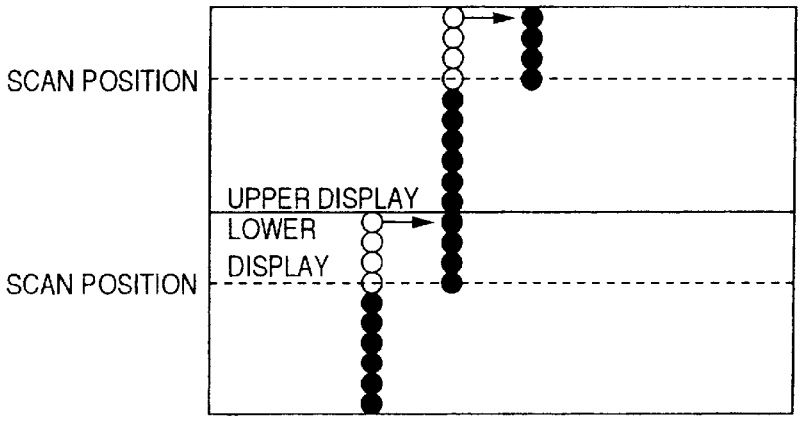
FIG. 23 is a diagram for explaining changes in FRC patterns in a third embodiment of the present invention.

For the purpose of solving the above problem, the liquid crystal controller 3 of the present embodiment is arranged, as shown in FIG. 23, to output the FRC patterns of the lower display as delayed by one frame when compared with those of the upper display.

Figure 24:
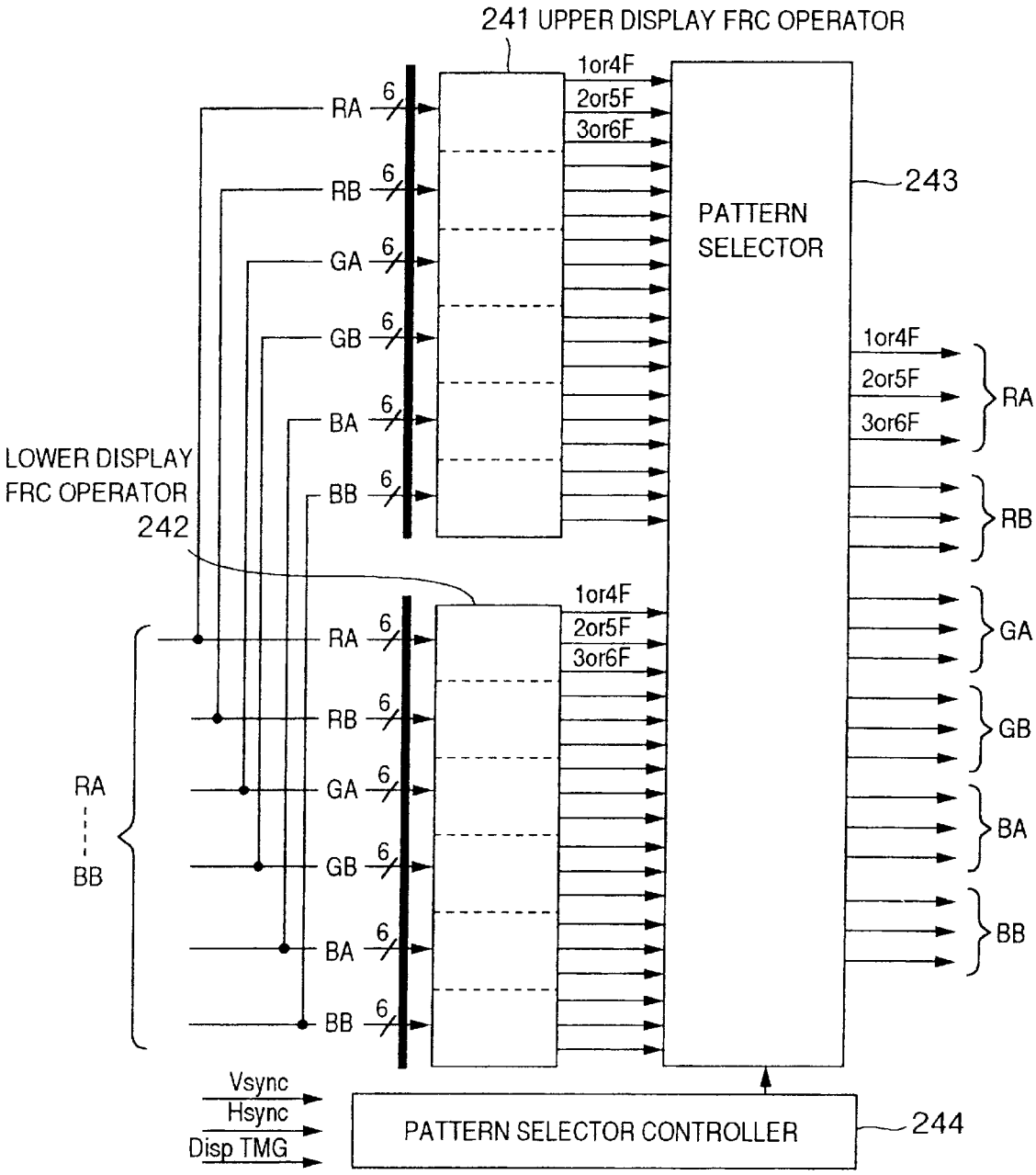
FIG. 24 is a block diagram of a major structure of the liquid crystal controller in the third embodiment of the present invention.

Shown in FIG. 24 is a block diagram of a major arrangement of the liquid crystal controller 3 in the third embodiment of the present invention.

In the drawing, reference numeral 241 denotes an FRC operator for the upper display, numeral 242 denotes an FRC operator for the lower display, 243 denotes a pattern selector, and 244 denotes a pattern selector controller.

The liquid crystal controller 3 of the present embodiment corresponds to the liquid crystal controller 3 of the first embodiment of the present invention but the FRC operator 21 is replaced by such an arrangement as shown in FIG. 24.

Accordingly, arrangements other than the arrangement of the present embodiment shown in FIG. 24 are substantially the same as those shown in FIG. 2 and thus detailed explanation thereof is omitted.

The FRC operator 241 for the upper display and the FRC operator 242 for the lower display are basically the same as those in the first embodiment of FIG. 2, except that the FRC operator 242 for the lower display is set to generate indicate on/off data delayed by one frame with respect to the FRC operator 21 for the upper display.

The pattern selector controller 244 counts the number of clocks in the input signal Hsync immediately after the input signal DispTMG becomes active. And the pattern selector controller 244 controls the pattern selector 243 to cause the pattern selector 243 to select outputs of the FRC operator 241 for the upper display until the count value becomes half of the resolution of the gray-scale data (e.g., 0–384 counts for an XGA type having a resolution of 1024×768 dots).

After the count number became half of the resolution (e.g., 385 to 768 counts for XGA of a resolution of 1024×768 dots), on the other hand, the pattern selector 243 selects the output of the FRC operator 242 for the lower display.

The count value of the signal Hsync is reset by the signal Vsync.

In the present embodiment, the FRC patterns of the lower display can be output ag delayed by one frame with respect to those of the upper display with the aforementioned arrangement. This enables prevention of such a phenomenon that interference fringes look like moving at the boundary between the upper and lower displays.

Although the arrangement shown in FIG. 24 has been explained in the present embodiment in connection with the case of applied to the first embodiment of the present invention, this arrangement can be applied to a liquid crystal controller for the ordinary dual type of STN display.

Explanation will next be made as to a liquid crystal display apparatus as a fourth embodiment of the present invention using the liquid crystal controller 3 of the above first to third embodiments.

Figure 25:
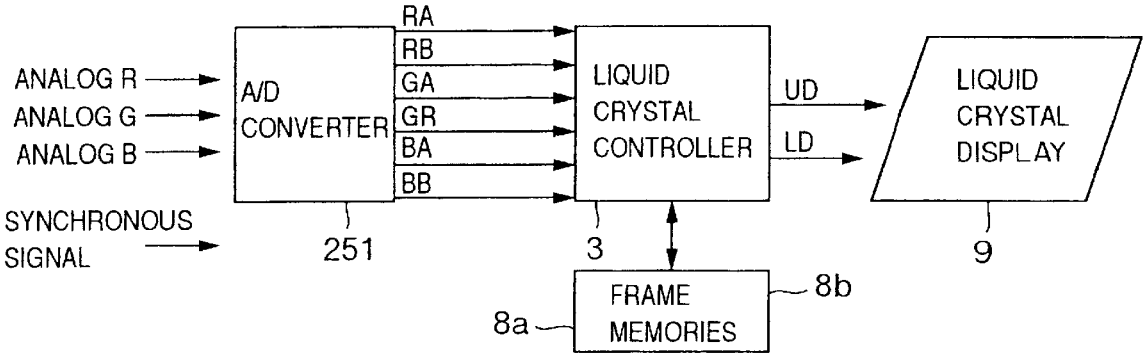
FIG. 25 schematically shows of an arrangement of a liquid crystal display apparatus in accordance with a fourth embodiment of the present invention.

FIG. 25 schematically shows an arrangement of the liquid crystal display apparatus in accordance with the fourth embodiment of the present invention.

In the drawing, reference numeral 251 denotes an A/D converter, numeral 3 denotes the liquid crystal controller already used in the first to third embodiments, reference symbols 8*a* and 8*b* denote the frame memories already explained in the foregoing explanation, and numeral 9 denotes the liquid crystal display of the dual scan type already explained above.

The A/D converter 251, on the basis of analog display data of red (R), green (G) and blue (B) for use in a CRT monitor, generates gray-scale data RA, RB, GA, GB, BA and BB of 6 bits per pixel.

More in detail, the A/D converter extracts the analog display data of R, G and B in units of pixel and converts it to gray-scale data of 6 bits. And the converter outputs the data RA, GA and BA when the order of the pixel specified by the gray-scale data is even; while it outputs the data RB, GB and BB when the order of the pixel specified by the gray-scale data is odd.

In this case, the pixel order can be found by providing such a counter that increments the pixel order according to the signal DotCK and resets it according to the signal Vsync.

In such a liquid crystal display apparatus as shown in FIG. 25, when the input signal is the same as that of the interface of the TFT liquid crystal, that is, when the input signal is of a digital RGB type having a plurality of bits of gray-scale information, the above A/D converter 251 can be made unnecessary.

As already explained above, when the analog display data is converted by the A/D converter 251 to quantum data, its quantization error may sometimes cause the gray-scale data, in particular, the lowest bit of gray-scale data to fluctuate. In this case, when a solid display of, e.g., an intermediate gray scale ratio is carried out, FRC patterns of gray scale ratios larger or smaller than the intermediate gray scale ratio are present as mixed, which undesirably results in such a problem that image quality deterioration such as interference fringes or flickering takes place.

As a result of various tests of the present invention, it has been confirmed that the above image quality deterioration becomes remarkable as FRC patterns of adjacent intermediate gray scale ratios become large and the deterioration becomes small as the FRC patterns become close to each other in size.

In order to solve the above problem, in the present embodiment, when the frame memory controller 25 is sued to convert analog display data to digital gray-scale data with use of the A/D converter 251, FRC patterns generated by the liquid crystal controller 3 are set as follows.

Figure 26:
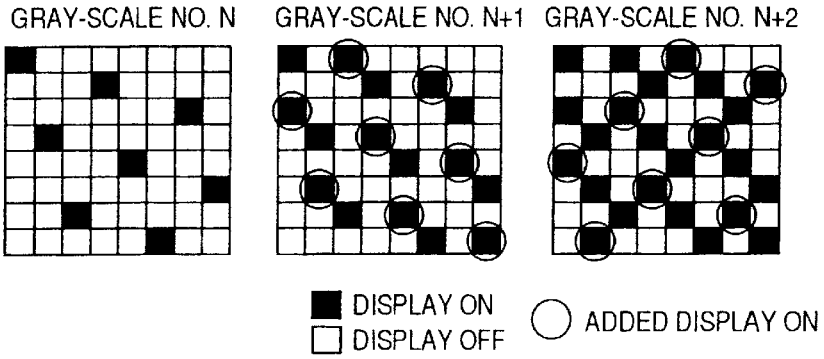
FIG. 26 is a diagram for explaining FRC patterns generated in the fourth embodiment of the present invention.

FIG. 26 is a diagram for explaining FRC patterns generated in the fourth embodiment of the present invention.

In the present embodiment, as shown in FIG. 26, when it is desired to increase the gray scale ratio by one step, the number of ON indicates is added while keeping the positions of ON and OFF indicates in the FRC pattern of the current gray scale ratio at their initial positions. Even when the frame is changed to another frame, the FRC pattern is set so that this relationship is always kept.

In this manner, when the apparatus inputs digital gray-scale data generated from analog display data for a CRT display, a quantization error generated at the time of converting the analog display data to the digital gray-scale data enables suppression of image quality deterioration of intermediate gray-scale display.

In usual FRC patterns, it is often that a reversed pattern is used from a gray scale ratio at a position between ON and OFF indicates as a boundary. For this reason, at the gray scale ratio as the boundary point, the positions of ON and OFF indicates change largely, which tends to cause image quality deterioration.

Accordingly, it becomes important that the reversed pattern is not simply used but the positions of ON and OFF indicates be not changed as possible even at the boundary point, e.g., by shifting the entire pattern in the horizontal or vertical direction.

Figure 48:
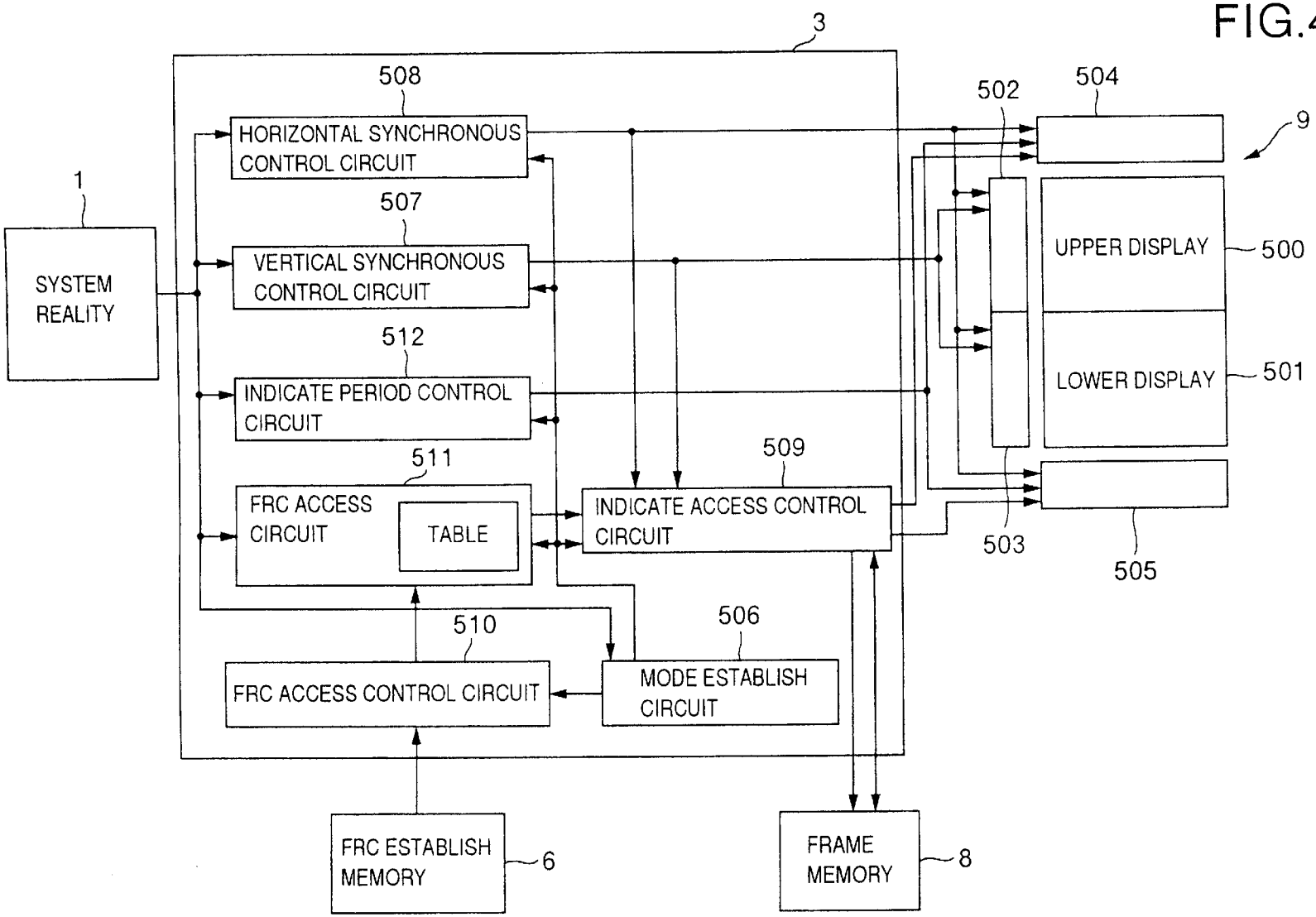
FIG. 48 is a schematic arrangement of a liquid crystal display system.

A sixth embodiment of the present invention will next be explained. The sixth embodiment is directed to the timing signal generator 35 in the liquid crystal controller 3 shown in FIGS. 2 and 16. That is, the present embodiment generates a video signal corresponding to an input video signal but its retrace periods removed therefrom, and subsequent circuit configurations are all included in the timing signal generator 35. Explanation of the sixth embodiment will start with how a video signal is displayed on the liquid crystal display 9, by referring to FIG. 48 corresponding to FIG. 1. As shown in FIG. 48, an upper display 500 of the liquid crystal display 9 is driven by a scan driver 502 and a data driver 504. A lower display 501 is driven by a scan driver 503 and a data driver 505. The data drivers receive supply of a plurality of levels of gray-scale voltages and apply to data lines the gray-scale voltages of levels corresponding to the received display data. The scan drivers apply select pulses to scan lines to be displayed.

The liquid crystal controller 3, as shown in FIG. 48, includes, as its major functional blocks, a mode establish circuit 506 for mode setting, a vertical synchronous control circuit 507, a horizontal synchronous control circuit 508 for generating a horizontal synchronous signal, an indicate access control circuit 509 for accessing of the frame memories, an FRC access control circuit 510 for accessing of an FRC setting memory, an FRC access circuit 511 for gray-scale display control of display data, and an indicate period control circuit 512 for coping with change in the number of lines in the display data.

The vertical synchronous control circuit 507, on the basis of an input synchronous signals received from the system reality 1, generates and outputs a vertical synchronous signal faster than the received vertical synchronous signal. An the vertical synchronous signal is commonly supplied from the vertical synchronous control circuit 507 to the respective drivers of the liquid crystal display 9. In the present embodiment, mode setting data taken in by the mode establish circuit 506 cause the speed of the generated vertical synchronous signal to becomes either one of 2, 2.5 and 3 times the speed of the received vertical synchronous signal. Accordingly, even on the screen of the liquid crystal display 9, its frame rate becomes either one of 2, 2.5 and 3 times, thus providing a high quality of image display.

The horizontal synchronous control circuit 508, on the basis of the input synchronous signals received from the system reality 1, generates and outputs a horizontal synchronous signal equal to or faster than the received horizontal synchronous signal. And the horizontal synchronous signal is also supplied commonly to the respective drivers of the liquid crystal display 9. The mode setting data taken in by the mode establish circuit 506 cause the speed of the generated horizontal synchronous signal to become equal to or faster than the speed of the received horizontal synchronous signal. When the frame rate is twice, the speed of the horizontal synchronous signal becomes unity. When the frame rate is 2.5 or 3 times, the speed of the horizontal synchronous signal becomes higher than unity. The speed up of the horizontal synchronous signal is realized by shortening the retrace period (in which valid display data is not output).

The data synchronous signal received from the system reality 1 is used as a reference clock for driving of circuits in the liquid crystal controller 3. The data synchronous signal of the same speed as the reference clock is also supplied to the data drivers of the liquid crystal display 9. Even when the speed of the horizontal synchronous signal is made faster, all valid display data can be displayed during one frame period without any need for making fast the speed of the data synchronous signal, because the retrace period is made short.

The FRC access circuit 511 holds in its internal register the gray-scale pattern data read out from the FRC establish memory 6 by the FRC access control circuit 510, changes the values of the display data received from the system reality 1 according to a pattern specified by the held gray-scale pattern data to thereby provide intermediate gray-scale display. More specifically, display of a single piece of the input display data is carried out with use of a plurality of frames, and at least two pieces of display data corresponding to the display data are selectively output. This results in that, even when the number of gray-scale levels in the input display data is larger than the number of gray-scales (the number of gray-scale voltage levels) displayable by usual driving of the liquid crystal display 9 for example, the display of the intermediate gray scale corresponding to the input display data can be realized. In this connection, this function may be used also as a function of correcting display characteristics of the liquid crystal display 9.

The indicate access control circuit 509 sequentially writes the display data subjected to the gray scale control by the FRC access circuit 511 into the frame memory 8 by an amount corresponding to one frame on every scan line basis. Concurrently with the above operation, the indicate access control circuit 509 individually reads out display data of the upper display and display data of the lower display from the frame memory 8 according to the above output synchronous signals, and outputs it to the associated data drivers 504 and 505. In this case, reading of the respective display data of the upper and lower displays starts with respective predetermined head addresses of the upper and lower displays. The head address of the lower display corresponds to an addition of the capacity of all display data of the upper display to the head address of the upper display.

The indicate period control circuit 512 detects the number of valid display lines in the TFT digital video signal 2 (see FIG. 1) from the input synchronous signals, and when the number of valid display lines is changed, the circuit 512 finds respective display periods of the upper and lower displays in one frame through calculation. And the circuit 512 outputs an indicate period signal to the respective data driver of the upper and lower displays to specify the respective indicate periods.

The mode establish circuit 506, which is connected to a terminal of the liquid crystal controller 3 to provide an address signal to an address terminal of the frame memory 8, takes in various sorts of setting data from the terminal and holds it in its internal register at the time of starting the system. And thereafter, the mode establish circuit 506 opens the terminal for output of the address signal. The mode setting data held in the register are supplied to the associated constituent elements. The mode setting data include display mode (XGA, SVGA) and double-speed mode for specification of how many times higher than the frame rate.

Explanation will then be made as to the operation of the liquid crystal display control apparatus.

At the time of starting the system, in the liquid crystal controller 3, the mode establish circuit 506 takes in mode setting data. As a result, the FRC access control circuit 510 causes gray-scale pattern data to be read out from the FRC establish memory 6 and to be written in a table within the FRC access circuit 511.

Thereafter, when the supply of the TFT digital video signal 2 (see FIG. 1) is started, the vertical synchronous control circuit 507 and horizontal synchronous control circuit 508, on the basis of the input synchronous signals of the TFT digital video signal 2, generate vertical and horizontal synchronous signals to form output synchronous signals and to output them to the drivers of the liquid crystal display 9. In this case, when a double-speed mode is specified by the mode setting, the speed of the vertical synchronous signal is doubled while the speed of the horizontal synchronous signal remains as it is. The scan drivers 502 and 503 of the upper and lower displays sequentially scan lines respectively at the same timing from top to bottom according to the supplied output synchronous signals, and this is repeated.

Meanwhile, display data included in the TFT digital video signal 2 (see FIG. 1) are subjected to gray-scale display control by the FRC access circuit 511, and then sequentially written into the frame memory 8 by the indicate access control circuit 509. Concurrently with this, the indicate access control circuit 509, according to the output synchronous signals, individually reads out the upper display data and lower display data of the liquid crystal display 9 from the frame memory 8. The display data are output to the associated display data drivers 504 and 505.

Figure 40A:
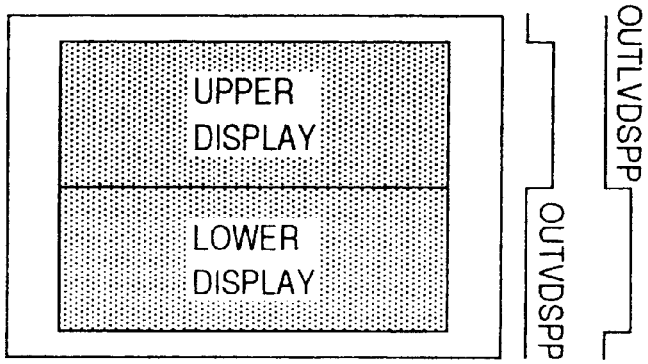
FIGS. 40A, 40B and 40C are display images of an input video signal on a liquid panel of a passive matrix type with respect to the number of display lines.

The data drivers 504 and 505 takes in the above display data and holds therein on a line basis according to the supplied output synchronous signals. And gray-scale voltages associated with the display data of scan lines selected by the scan drivers are, all together, applied to the data lines. This enables simultaneous display of the first scan lines of the upper and lower displays 500 and 501 of the liquid crystal display 9. And sequential shift of lines to be displayed enables the entire display 9 to be fully displayed as shown in FIG. 40A during one period of the output vertical synchronous signal.

Figure 40B:
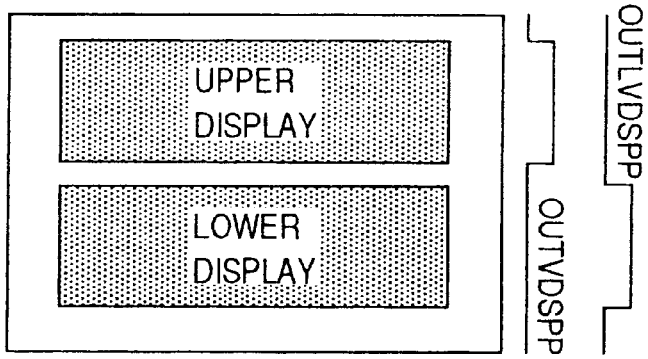
Figure 40C:
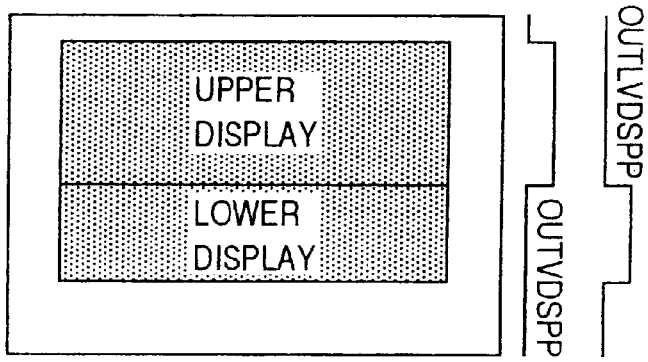

When the TFT digital video signal 2 is changed, e.g., from the SVGA mode to the XGA mode, the indicate period control circuit 512 detects a change (from 768 to 600 lines) in the number of valid display lines and sets a subtraction of the number of all display lines in the upper display from the number of valid display lines as the display line number of the lower display. And the indicate period signal causes indicate periods of the respective display lines to be specified in the data driver. Thus, such an image separation between the upper and lower displays as shown in FIG. 40B can be avoided and display of invalid display data in the frame memory 8 can be avoided, whereby such a continuous display as shown in FIG. 40C can be realized.

As has been explained above, the liquid crystal display control apparatus of the present embodiment can display a good quality of image with use of the reference clock and without involving any modification of the speed of the data synchronous signal. Since the need for speeding up the data synchronous signal can be eliminated, it becomes unnecessary to operate the internal circuits and various drivers at high speed, thus eliminating the need for a complicated delay design. As a result, there can be inexpensively implemented a liquid crystal display control apparatus.

Further, when the number of lines in the TFT digital video signal 2 is changed, the respective indicate periods of the upper and lower displays can be found through calculation and individual display control can be realized for the respective displays, which results in that normal display can be attained in response to a change in the number of lines in the input video signal.

In the liquid crystal controller 3, further, output of the address signal and input of the mode setting data can be carried out through the common terminal, the total number of necessary terminals can be reduced, enabling miniaturization of the liquid crystal controller 3.

Further, the liquid crystal controller 3 realizes all the functions mentioned above in the form of the operation of a pure hardware circuit. Thus, processing delay can be made smaller than the delay when the above functions are realized through program control, thus easy and inexpensive realization of the apparatus.

Detailed explanation will be made as to its major parts.

First explanation will be directed to the principle of speeding up the output synchronous signals in the present embodiment.

Figure 33A:
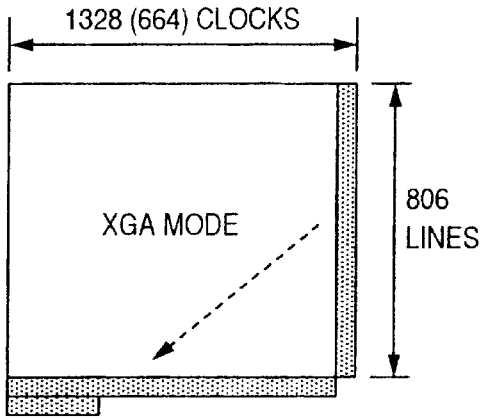
FIGS. 33A and 33B schematically show a relationship between a total sum of horizontal clocks and a total sum of vertical lines with respect to XGA and SVG mode displays.
Figure 33B:
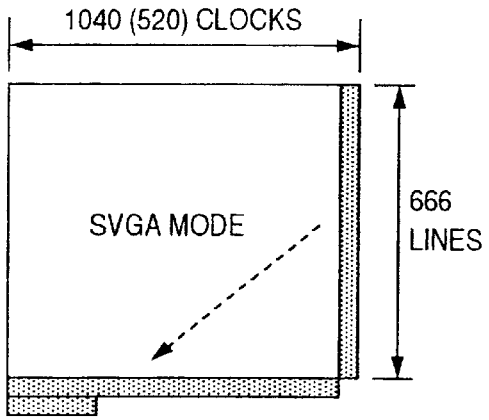

A video signal for a liquid crystal display apparatus has XGA and SVGA modes as its main modes. The period of the input synchronous signal is a product of the total number of horizontal clocks (the total number of clocks in the data synchronous signal per one period of the horizontal synchronous signal) and the total number of vertical lines (the total number of clocks in the horizontal synchronous signal per one period of the vertical synchronous signal). Thus, as shown in FIGS. 33A and 33B, the period of the input synchronous signal has 1328×806 dots for the XGA mode and has 1040×666 dots for the SVGA mode. The number of valid display data is 1024×768 dots for the XGA mode and 800×600 dots for the SVGA mode. The residual durations in the respective periods are retrace periods. In the drawings, numbers placed in parentheses denote clock numbers when a pair of display data are transmitted in a parallel manner.

When a 2-dot duration (clock) is reduced in one period of the horizontal synchronous signal, for example, (vertical one-line duration+about-300-clock duration) can be used as an idle duration for each of the XGA and SVGA modes, as given by the following expressions (1) and (2). In the present embodiment, such an idle duration is used to beforehand display the next frame.

$$\text{XGA mode: } (806\times2)\div1326\approx1.26\rightarrow\text{one horizontal line duration}+286\text{-clock duration} \quad (1)$$

$$\text{SVGA mode: } (666\times2)\div1038\approx1.28\rightarrow\text{one horizontal line duration}+294\text{-clock duration} \quad (2)$$

However, realization of the calculations of the above expressions in the form of a circuit involves a large scale of circuit, which is not practical. In order to avoid this, in the present embodiment, the output horizontal duration (the period of the horizontal synchronous signal of the output synchronous signals) is found in accordance with an equivalent expression to generate the output synchronous signals on the basis of the found output horizontal duration.

$$\text{Output horizontal duration}=[(\text{input horizontal total clock number}-\alpha)+(\text{input total line number}-\text{input display line number}-\beta)]\div\text{multiple-speed mode }\gamma \quad (3)$$

The output horizontal duration found according to the above expression is recalculated only when the number of lines in one input frame is changed, in order to always be stabilized even when the input horizontal duration varies. This is for the purpose of preventing uneven display caused by fluctuations of the liquid crystal driver select/non-select durations based on fluctuations of the output horizontal duration. In the above expression, $\alpha$ and $\beta$ are fixed values determined based on the secure reservation of the retrace period and circuit operational restrictions, are 10 and 4 respectively in the present embodiment. The subtraction of (input total line number−input display line number) in the above expression means to convert the input retrace period to an output horizontal clock number, whereby the retrace period of the output synchronous signals is compressed. The multiple-speed mode $\gamma$ in the above expression takes a value of 1, 1.25 or 1.5 for the double-speed, 2.5-time-speed mode or triple-speed mode specified by the mode setting, respectively. Half of each mode multiple-speed is set as each mode value. This is because the liquid crystal controller 3 scan the 2 upper and lower displays at the same time, which means the already doubling operation.

Figure 34:
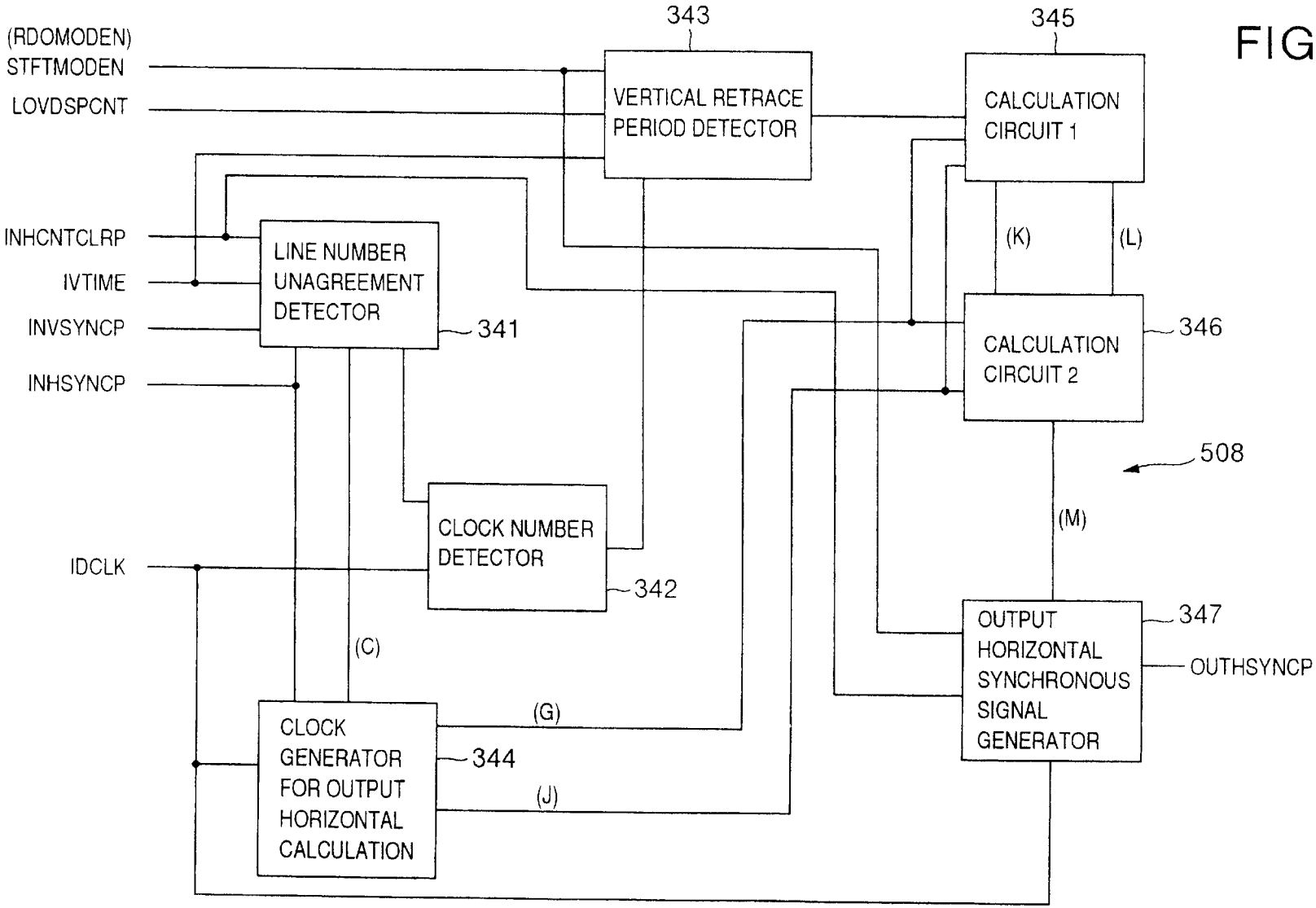
FIG. 34 schematically shows an arrangement of a horizontal synchronous control circuit.

Schematically shown in FIG. 34 is an arrangement of the horizontal synchronous control circuit 508.

In FIG. 34, reference numeral 341 denotes a line number unagreement detector for each one input frame period, numeral 342 denotes a clock number detector during one input horizontal period, 343 denotes a vertical retrace period detector during one input frame period, 344 denotes a clock generator for calculation of output horizontal period, 345 denotes an output horizontal period calculation circuit 1, 346 denotes a calculation circuit 2, and 347 denotes an output horizontal synchronous signal generator for generating a horizontal synchronous signal on the basis of calculation results of the output horizontal period calculation circuits 345 and 346.

Figure 35:
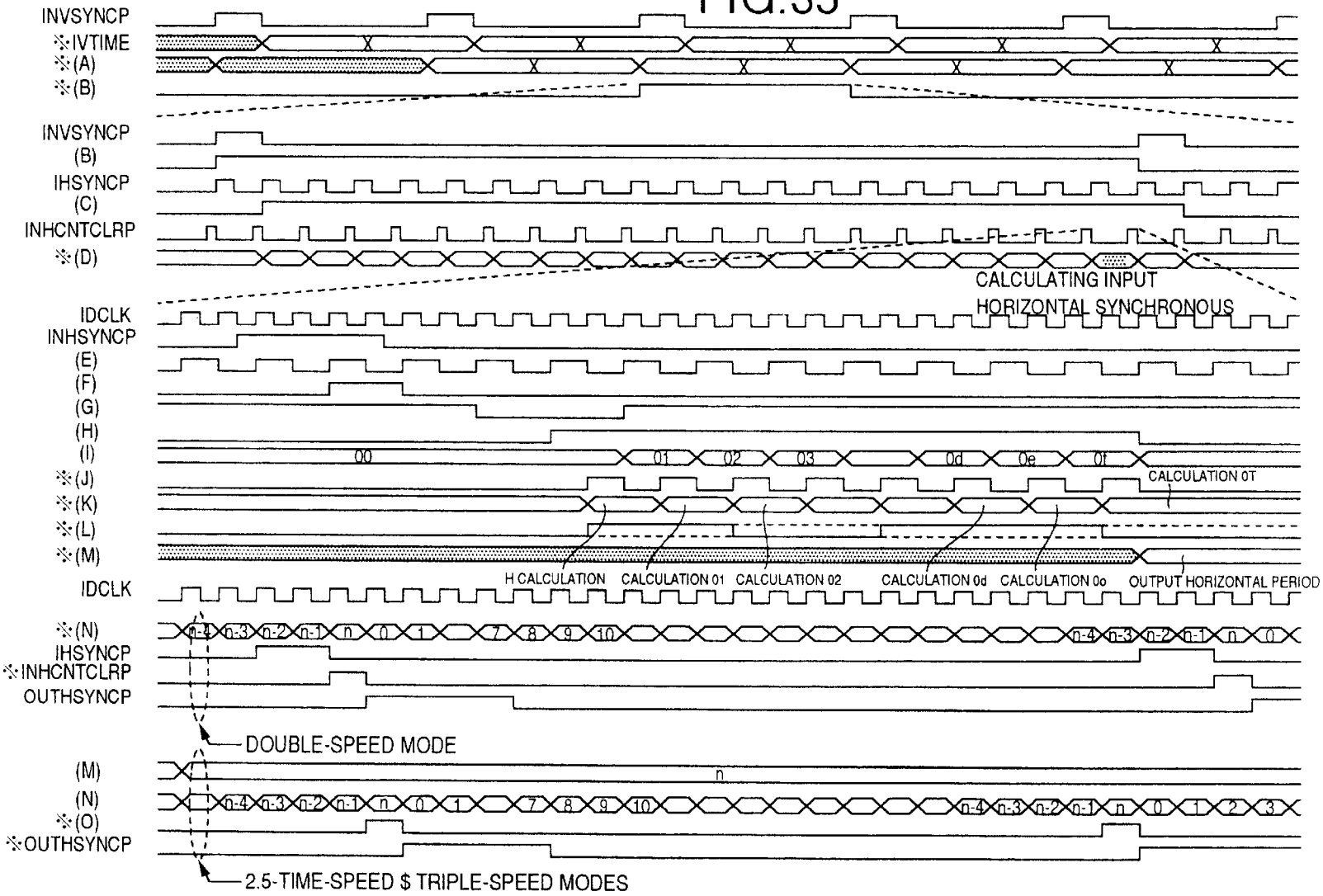
FIG. 35 is a timing chart of operation of the horizontal synchronous control circuit.

The brief operation of the horizontal synchronous control circuit 508 will be explained with use of a timing chart of FIG. 35. First of all, the line number unagreement detector 341 compares the number (IVTIME) of lines in each one input frame with the number (A) of lines in the one-previous frame. When detecting an unagreement therebetween as a comparison result (B), the line number unagreement detector 341 latches the current frame line number and at the same time, outputs a line number unagreement signal by one frame period to the clock number detector 342. In accordance with the unagreement signal, the clock number detector 342 latches (D) hand holds the input horizontal clock number received from the input horizontal counter during one frame duration of the valid unagreement signal. On the basis of the latched input horizontal clock number (D), calculation is carried out in accordance with the above expression (3) in a hardware manner.

In the calculation, first, the clock number detector 342 subtracts the clock number $\alpha$ (10 in the illustrated example) from the input horizontal clock number (D) to obtain a subtraction and outputs the subtraction to the vertical retrace period detector 343. The vertical retrace period detector 343 subtracts the fixed value $\beta$ (4 in the illustrated example) based on the circuit operational restrictions, from a subtraction (i.e., vertical retrace period) of an input display line number (LIVDSPCNT) from an input one-frame line number (IVTIME), adds to its subtracted result the subtraction result received from the clock number detector 342, and outputs a result of twice or 4 times the addition to the output horizontal period calculation circuit 345. In this case, selection of twice or 4 times the addition is determined by the multiple-speed mode setting at the time of starting the system. Four times is selected for the 2.5-time-speed mode and twice is selected for the triple-speed mode. This data is used for the subsequent calculation. In the present embodiment, the calculation employs a pull-back method based on subtraction. In other words, the calculation circuit 346 latches the doubled or quadrupled input data at the same timing as the horizontal period, and shifts the data at the timing of a horizontal calculation clock (J) issued from the clock generator 344 for calculation of the output horizontal period. The calculation circuit 346 for calculation of the output horizontal period subtracts "5" or "3" from upper 4-bit data (K) received from the output horizontal period calculation circuit 345. The subtraction uses an addition circuit of 2's complement. The subtraction result is positive when a carrier output (L) of the addition circuit is "1", while the subtraction result is negative when the carrier output is "0". Selection of "5" or "3" in the subtraction is determined by the multiple-speed mode setting at the time of starting the system. That is, "5" is selected in the subtraction for the 2.5-time-speed mode, and "3" is selected for the triple-speed mode. When the carrier output (L) of the addition circuit is "1", remainder data after the subtraction is returned to the shift circuit of the output horizontal period calculation circuit 345 for its reflection in the subsequent calculation. When the carrier output (L) is "0", the data is not returned and the shift circuit of the output horizontal period calculation circuit 345 performs only data shifting operation. Latch data (M) of the calculation circuit 346 for calculation of the output horizontal period at the time point of the shift completion becomes a final output horizontal period set value, which is output to the output horizontal synchronous signal generator 347. The output horizontal synchronous signal generator 347 compares the latch data (M) with an output (N) of the output horizontal counter, and generates an output horizontal synchronous signal (OUTHSYNCP) by clearing the output horizontal counter with the coincided timing signal (O).

In this way, in the 2.5-time-speed mode, the division of $\gamma$ (=1.25) is carried out with the quadrupling and the division of "5". In the triple-speed mode, the division of $\gamma$ (=1.5) is carried out with the doubling and the division of "3".

When the multiple-speed mode is the double-speed mode, double-speed is realized only with simultaneous scanning of the upper and lower displays, for which reason the aforementioned calculation circuit is not used and the input horizontal period is used as it is, as the output horizontal period. That is, an input horizontal counter clear signal (INHCNTCLRP) is used for clear control of the output horizontal counter of the output horizontal synchronous signal generator 347. In FIG. 35, only waveforms marked by * are explained and the other waveforms are illustrated only for the sake of reference.

The vertical synchronous control circuit 507 will then be explained in connection with FIG. 36.

Table 1 shows a relationship between the number of lines in one output frame and how to process residual lines with respect to the respective multiple-speed modes in the present embodiment.

TABLE 1

| operational mode | number of lines in one output frame | remaining line processing |
|---|---|---|
| double-speed | number of input lines in one input frame | remaining lines → second output frame |
| 2.5-time-speed | (number of output lines in 2 input frames) ÷ 5 | one remaining line → fifth output frame<br>2 remaining lines → each one line for second and fifth output frames<br>3 remaining lines → one line for second output frame and two for fifth frame<br>4 remaining lines → each 2 lines for |

TABLE 1-continued

| | | |
|---|---|---|
| triple-speed | (number of output lines in one input frames) ÷ 3 | second and fifth output frames remaining lines → third output frame |

As given in Table 1, in the double-speed mode, in order to make the input horizontal period equal to the output horizontal period, the number of lines in one output frame is set to be a division of the number of input lines in one input frame by 2, remaining lines are assigned to the second output frame, and input and output are completed for each frame. Accordingly, when the number of lines in one input frame is odd, the number of lines in the second output frame is larger by one line than the number of lines in the first output line.

Even in the triple-speed mode, similarly to the double-speed mode, input and output are completed for each frame, remaining lines are assigned to the third frame as the final output frame. The number of lines in one output frame is set to be a division by "3" of the found number of lines in one input frame for the output horizontal period based on the output horizontal period calculation result.

In the 2.5-time-speed mode, when it is desired to perform each frame completion control, division by "2.5" is required. For this reason, input is completed for each 2 frames and division by "5" is carried out. In this case, 5 output frames are generated for 2 input frames. When remaining lines are assigned to the fifth frame as the last frame, the fifth frame assigned to the remaining lines is generated for each 2 input frames, with a large generation period. In addition, since the number of remaining lines is as large as maximum 4, this has bad influences on the quality of display image. In order to avoid this problem, in the 2.5-time-speed mode, remaining lines are subjected to a dispersing operation. More specifically, as shown in Table 1, an output frame to be assigned is switched depending on the number of remaining lines. That is, when the number of remaining lines is 1, it is assigned to the fifth frame as the last frame; when the remaining line number is 2, the remaining lines are assigned to the second and fifth frames; when the remaining line number 3, one line is assigned to the second frame and the remaining 2 lines are assigned to the fifth frame; when the remaining line number is 4, each 2 lines are assigned to the second and fifth frames. Thereby adverse influences of the remaining lines in the 2.5-time-speed mode on the display image quality can be suppressed.

Figure 36:
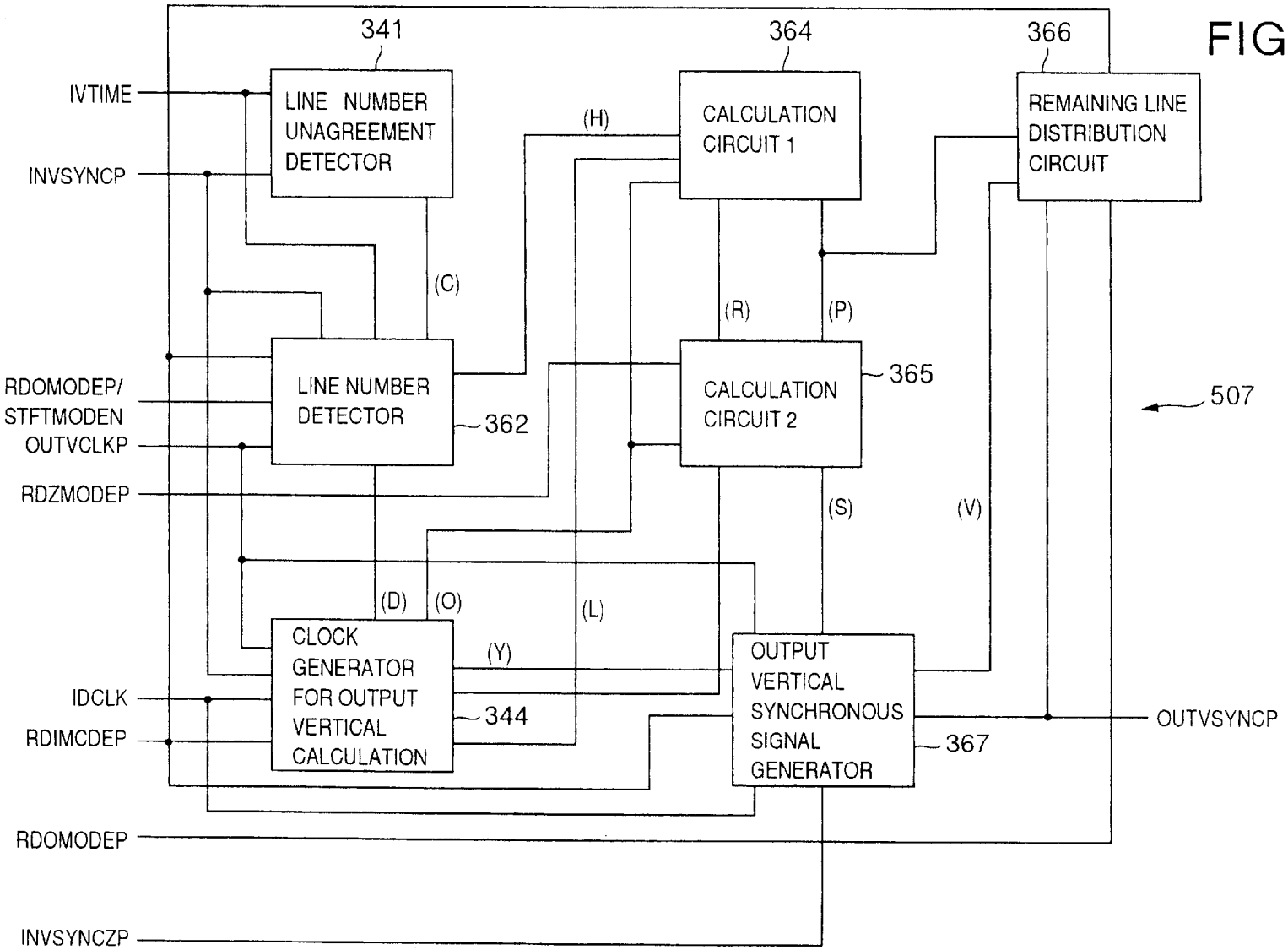
FIG. 36 schematically shows an arrangement of a vertical synchronous control circuit.

FIG. 36 is a schematic arrangement of the vertical synchronous control circuit 507. In FIG. 36, reference numeral 341 denotes the same line number unagreement detector as in FIG. 34, numeral 362 denotes a line number detector for detecting the number of output horizontal period lines in one input frame, 363 denotes a clock generator for calculation of output vertical period, 364 denotes an output vertical period calculation circuit, 365 denotes an output vertical period calculation circuit, 366 denotes a remaining line distribution circuit functioning at the time of setting the 2.5-time-speed mode, and 367 denotes an output vertical synchronous signal generator.

Figure 37:
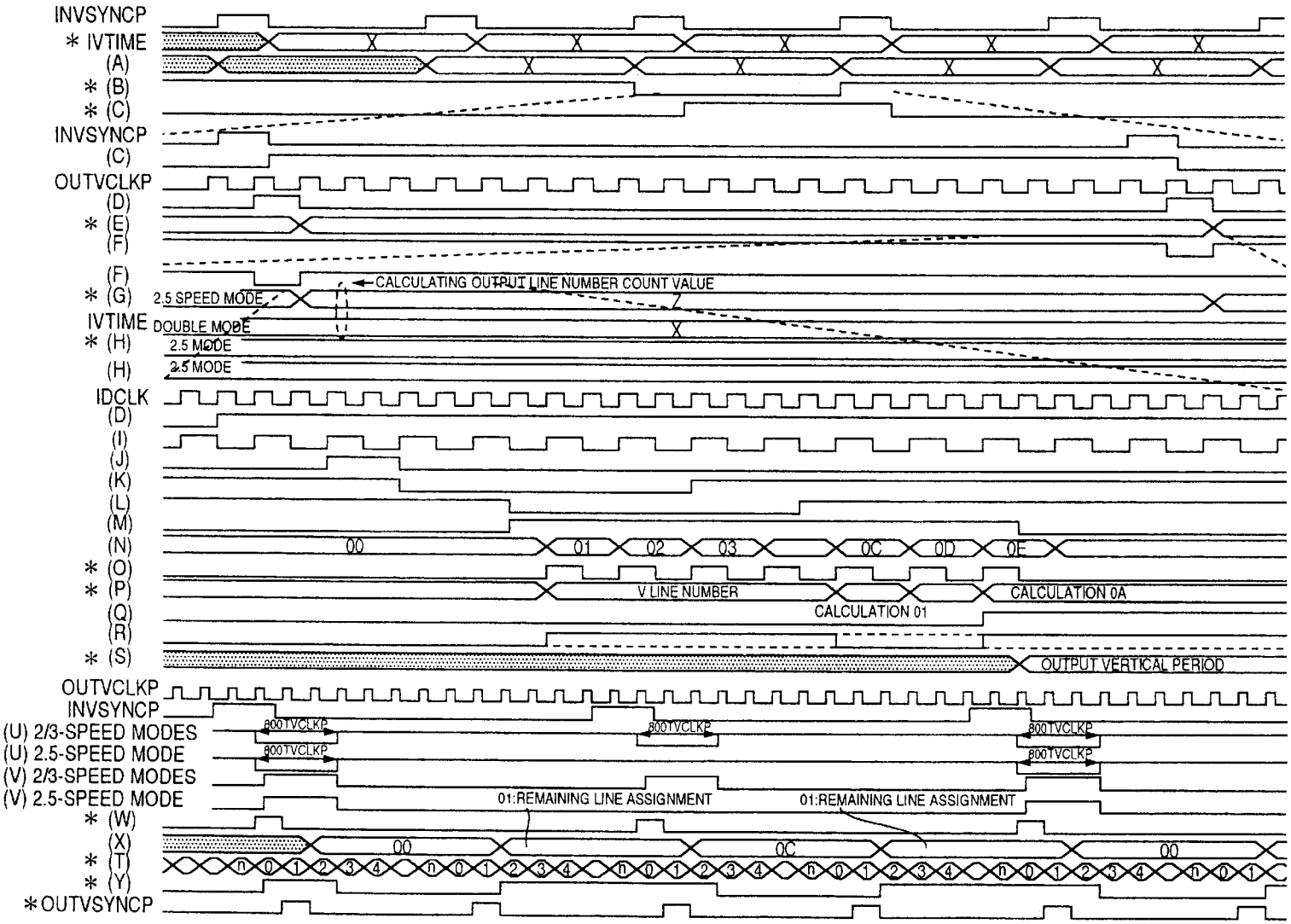
FIG. 37 is a timing chart of operation of the vertical synchronous control circuit in its double-speed mode.

Referring to FIG. 37, when the line number unagreement detector 341 detects an unagreement (B) of input line number="L"; the vertical synchronous control circuit 507, similarly to the output horizontal synchronous signal generator 347, outputs a line number take signal (C) to the line number detector 362. The line number detector 362 triggers this signal to newly take in an output line number count value (E) in one input frame from an output line number counter as a new output line number count value (G). The output line number count value (G) taken in is selected at the time of setting 2.5-time-speed and triple-speed modes; while an input line number count value (IVTIME) in one input frame is selected at the time of setting the double-speed mode. The line number count value selected according to the multiple-speed mode setting is added by +1, the line number count value is output as it is to the output vertical period calculation circuit 364 at the time of setting the double-speed and triple-speed modes of every frame completion type, and the line number count value is doubled at the time of setting the 2.5-time-speed mode of 2-frame completion type and then output to the output vertical period calculation circuit 364, respectively calculation data (H). The subsequent calculation is carried out with use of the pull-back method similar to the output horizontal synchronous signal generator 347 and at the timing of an operational clock (O) issued from the clock generator 363 for calculation of output vertical period. In addition, division control of remaining lines is carried out by outputting latch data (P) of the output vertical period calculation circuit 364 indicative of remaining lines at the end of the operation to the remaining line distribution circuit 366. The remaining line distribution circuit 366 performs distribution control of remaining lines over the second output frame at the time of setting the 2.5-time-speed mode. Accordingly, the distribution of remaining lines over the final frame in all multiple-speed modes given in Table 1 is realized by outputting (synchronizing the input and output) a next input vertical synchronous signal (W) as an output vertical synchronous signal (OUTVSYNCP) according to an output synchronous signal select/change-over signal (Y) issued from the clock generator 363 for calculation of output vertical period. In the distribution control of remaining lines to the second output frame at the time of setting the 2.5-time-speed mode, the latch data (P) is compared with "2", "3" and "4". Since the coincided value becomes the total number of remaining lines, when the latch data coincides with "2" or "3", the output vertical synchronous signal generator 367 adds "1" to an output vertical period calculation value (S) issued from the output vertical period calculation circuit 365 at the timing of the second output frame, compares the value added by "1" with a count value (T) of the output vertical counter, and outputs an output vertical synchronous signal (OUTVSYNCP) at the matched timing. Further, when the total number of remaining lines is "4", the output vertical synchronous signal generator 367 adds "2" to the output vertical period calculation value (S) at the timing of the second output frame. In this manner, with use of the output vertical synchronous signal (OUTVSYNCP) generated based on the output vertical period set value which corresponds to an addition of the output vertical period (S) found by the output vertical period calculation circuits 364 and 365 to the remaining line distribution value for each set multiple-speed mode; the output frame frequency higher than the input frame frequency can be generated, whereby the liquid panel of the passive matrix type can provide a high quality of image display. In this connection, only waveforms given by marks * in FIG. 37 are explained and the other waveforms are given only for the sake of reference.

Figure 38:
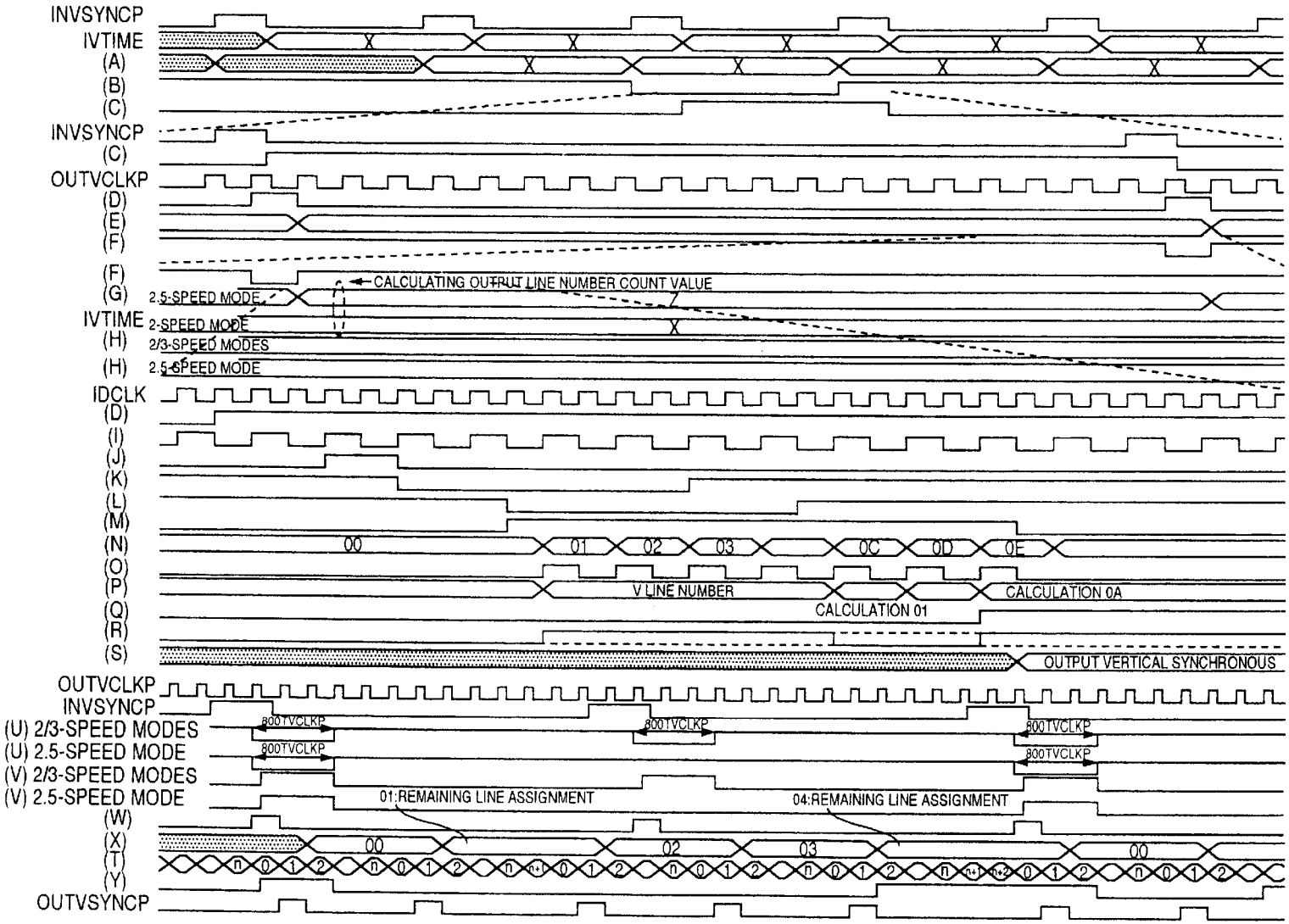
FIG. 38 is a timing chart of operation of the vertical synchronous control circuit in its 2.5-time-speed mode.
Figure 39:
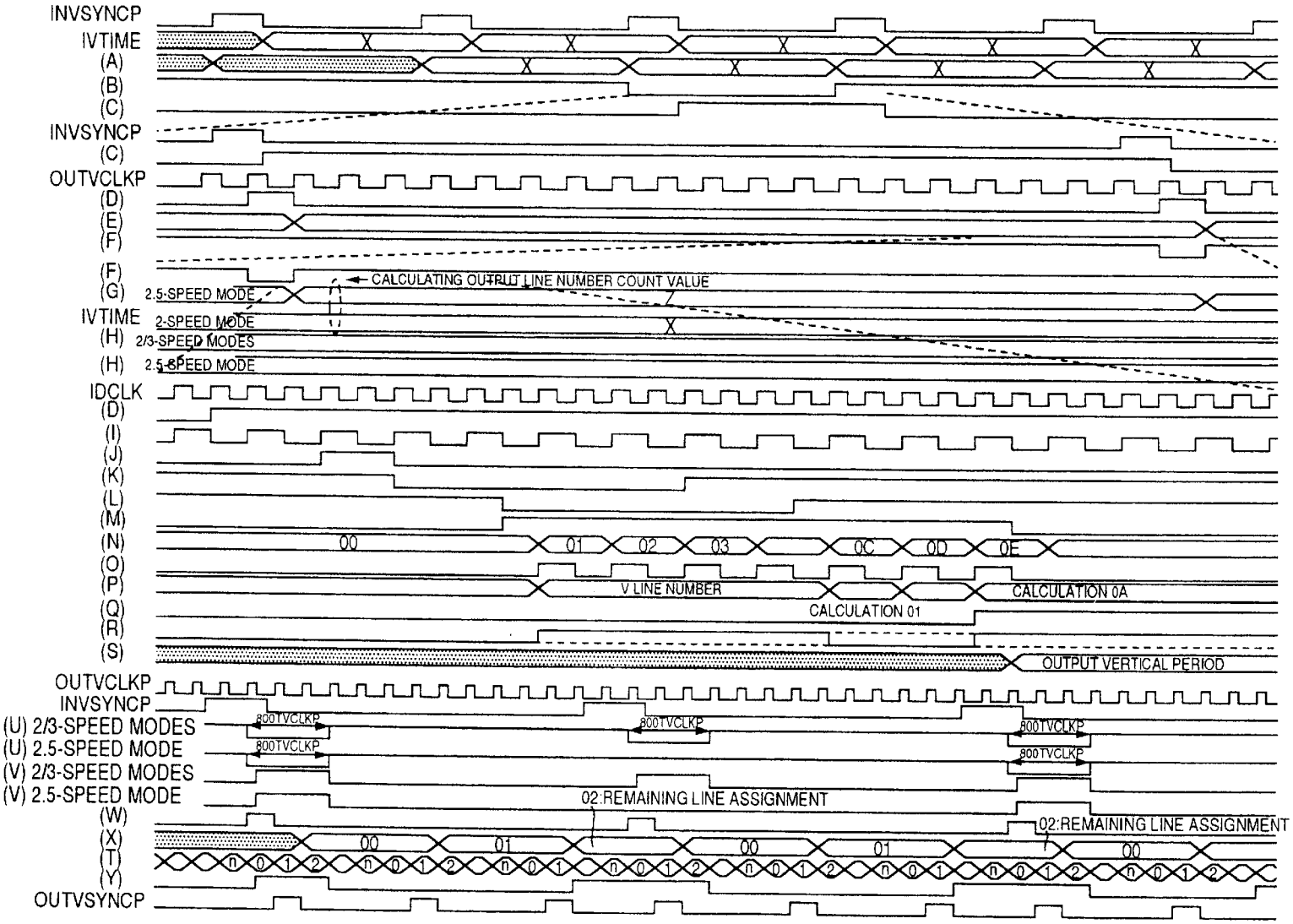
FIG. 39 is a timing chart of operation of the vertical synchronous control circuit in its triple-speed mode.

FIGS. 37, 38 and 39 show waveforms of signals for explaining the operations of 2-, 2.5- and 3-time-speed modes as examples of high output frame frequency, respectively.

The operational waveforms are the operations when the vertical synchronization control circuit shown by a schematic arrangement circuit in FIG. 36 is set at the operational modes at the time of starting the system.

In the double-speed operation of FIG. 37, the doubled speed is realized by converting a one-period duration of the input vertical synchronous signal INVSYNCP to a 2-period duration of the output vertical synchronous signal OUTVSYNCP.

In the 2.5-time-speed operation of FIG. 38, the 2.5-time speed is realized by converting a 2-period duration of the input vertical synchronous signal INVSYNCP to a 5-period duration of the output vertical synchronous signal OUTVSYNCP.

In the triple-speed operation of FIG. 39, the triple speed is realized by converting a one-period duration of the input vertical synchronous signal INVSYNCP to a 3-period duration of the output vertical synchronous signal OUTVSYNCP.

Explanation will next be made as to the indicate period control circuit 512.

Figure 41:
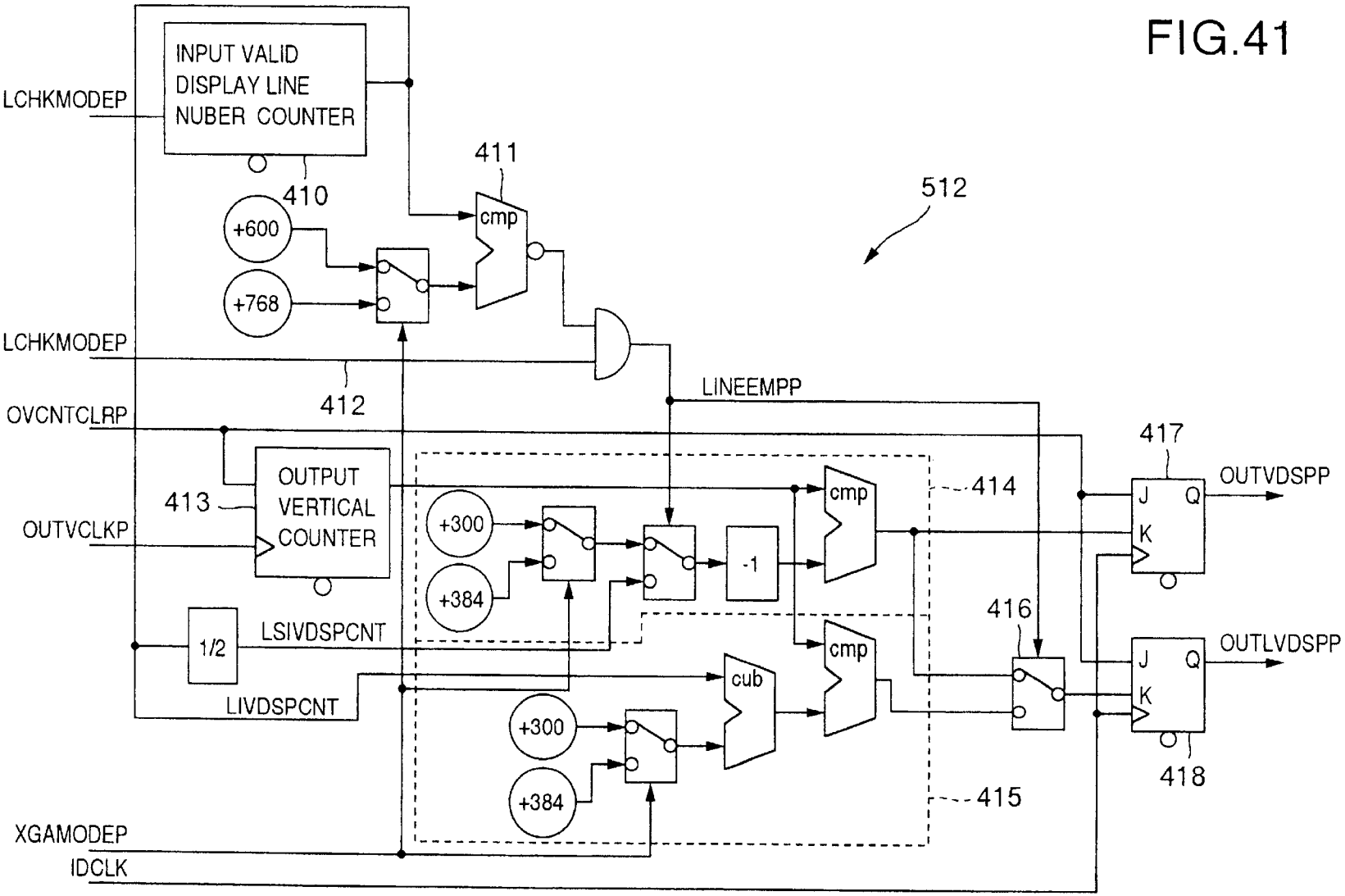
FIG. 41 is a schematic configuration of an upper/lower display separation prevention control circuit.
Figure 42:
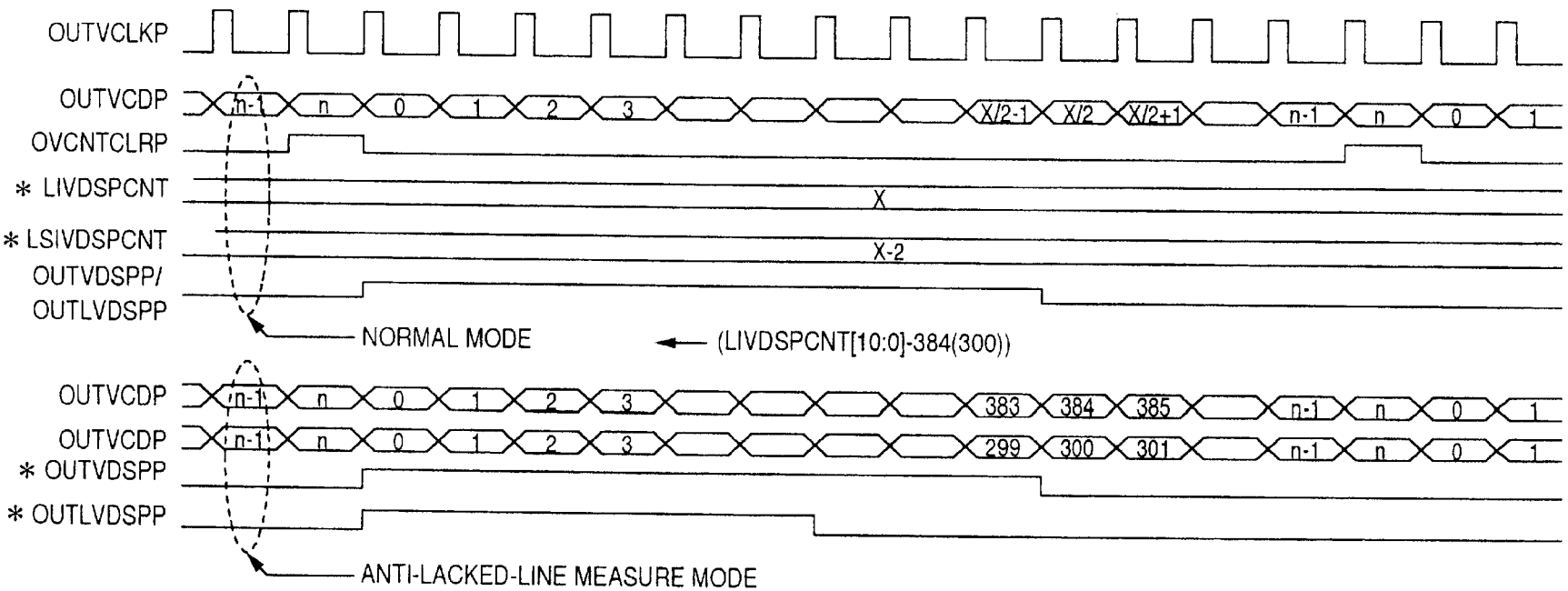
FIG. 42 is a timing chart of operation of a display division control circuit.

Referring to FIGS. 41 and 42, there are shown a schematic arrangement of the indicate period control circuit 512 and a timing chart of signals appearing therein. In FIG. 41, reference numeral 410 denotes an input valid display line number counter for counting the number of valid display lines of video data in one input frame, numeral 411 denotes a comparator for comparing a count value (LIVDSPCNT) OF THE input valid display line number counter 410 with the number of prescribed lines (768 for the XGA mode and 600 for the SVGA mode) for each display mode, 412 denotes an enable signal for enabling a circuit for prevention of display screen separation caused by lacked lines, 413 denotes an output vertical counter for counting with the output horizontal period, 414 denotes an upper display indicate pulse width generator in a lacked line mode, 415 denotes a lower display indicate pulse width generator in the lacked line mode, 416 denotes a selector circuit for selecting the lower display indicate pulse width generation signal, 417 and 418 denote upper and lower display indicate pulse latches respectively.

The mode set at the time of starting the system causes the display screen separation preventing circuit to be set in its valid state (LCHKMODEN="L"). Thus, the comparator 411 compares the count value (LIVDSPCNT) of the input valid display line number counter 410 based on the input display line signal (DSPTMG) with "768 (XGA mode)" or "600 (SVGA mode)". When the count value is smaller, a signal (LINEEMPP="H") indicative of the lacked line mode becomes valid. Whether the display mode is XGA or SVGA is determined by the mode set at the time of starting the system. In the illustrated example, it is assumed that the display mode is the XGA mode (XGAMODEP="H") and the number of lines is smaller than the necessary line number of 768. Assertions of the upper and lower display indicate pulses (OUTVDSPP and OUTLVDSPP) are equal to each other at the timing of clearing the output vertical counter 413. The clear timing of the upper display indicate pulse is controlled by the upper display indicate pulse width generator 414 at the timing when the count value of the output vertical counter 413 becomes 384; whereas the clear timing of the lower display indicate pulse is controlled by the upper display indicate pulse width generator 414 selected by the selector circuit 416 at the timing when the count value of the output vertical counter 413 becomes a value (corresponding to a subtraction of the upper display indicate line number from the total input indicate line number) obtained by subtracting 384 from the count value (LIVDSPCNT) of the input valid display line number counter 410. In this way, data of 384 lines as the full indicate lines are displayed on the upper display, while remaining data corresponding to a subtraction of the upper display indicate line data from the total input line data are displayed on the lower display, starting from the uppermost part thereof. As a result, there can be displayed a video image without any separation of the upper and lower display screens. In the case where the display screen separation preventing circuit is set in its invalid state (LCHKMODEN="H") at the time of starting the system; control becomes common to the upper and lower display indicate pulses and the upper display indicate pulse width generator 414 is not used. The fixed value (384) was compared with the count value of the output vertical counter 413 in the upper display indicate pulse width generator 414. In the present mode, the upper and lower display indicate pulses (OUTVDSPP and OUTLVDSPP) are both cleared at the timing when the value (LSIVDSPCNT) corresponding to the division of the total input indicate line number (LIVDSPCNT) of the input valid display line number counter 410 by 2 coincides with the count value of the input valid display line number counter 410. Accordingly, when the number of indicate lines of input video data is a prescribed value (of 768), pulses of 384 lines corresponding to half of the prescribed 768 lines are generated as the upper and lower display indicate pulses, thus providing such a normal display as shown in FIG. 40A. When the number of indicate lines in the input video data is smaller than the prescribed value, half of the prescribed value is also smaller than 384. As a result, the upper and lower display indicate pulse widths become both smaller than 384 lines and thus such a separated display of the upper and lower display screens as shown in FIG. 40B. Waveforms given by marks * are already explained above and the other waveforms correspond to the counterpart signals of FIG. 41.

The present embodiment also has a function of forcibly increasing the number of output lines when the number of input lines is lacking.

Table 2 shows a list of operational modes in the XGA mode as an example when the number of input lines is lacking, for explaining the above function. More in detail, when the display screen separation preventing circuit is set in its valid state (LCHKMODEN="L") and the number of input valid display lines is smaller than 768, output horizontal synchronous signal generation control in the double-speed mode is carried out in the 2.5-time-speed mode faster by one rank than the double-speed mode; output horizontal synchronous signal generation controls in the 2.5-time- and triple-speed modes are carried out in the modes slower by one rank respectively, thus increasing the number of output lines in one output frame period. As a result, the number of lines can satisfy the prescribed minimum number of input lines of the liquid panel and therefore the connectable scope of the liquid panel can be expanded.

TABLE 2

| lacked line mode detection setting | input valid display period, line number | mode setting | output horizontal synchronous | output vertical synchronous | output upper display, DSP | output lower display, DSP |
|---|---|---|---|---|---|---|
| invalid, LCHKMODEP = "L" | 768 lines or more | double-speed | double-speed | double-speed | LSIVDSPCNT | LSIVDSPCNT |
| | | 2.5-time-speed | 2.5-time-speed | 2.5-time-speed | ↑ | ↑ |
| | | triple-speed | triple-speed | triple-speed | ↑ | ↑ |
| | less than 768 lines | double-speed | double-speed | double-speed | ↑ | ↑ |
| | | 2.5-time-speed | 2.5-time-speed | 2.5-time-speed | ↑ | ↑ |
| | | triple-speed | triple-speed | triple-speed | LSIVDSPCNT | LSIVDSPCNT |
| valid, LCHKMODEP = "H" | 768 lines or more | double-speed | double-speed | double-speed | 384 lines | 383 lines |
| | | 2.5-time-speed | 2.5-time-speed | 2.5-time-speed | ↑ | ↑ |
| | | triple-speed | triple-speed | triple-speed | ↑ | 384 lines |
| | less than 768 lines | double-speed | 2.5-time-speed | double-speed | ↑ | IVDSP-384 lines |
| | | 2.5-time-speed | 2.5-time-speed | double-speed | ↑ | ↑ |
| | | triple-speed | triple-speed | 2.5-time-speed | 384 lines | IVDSP-384 lines |

Explanation will next be made as to the FRC access control circuit 510 in connection with FIG. 43.

It is assumed in the present embodiment that 116 registers of an 8 bit type are provided as the FRC control data setting registers and a serial memory of a type of 64 words×16 bits is provided as a memory for storing data set in all the registers. Use of the serial memory enables reduction of the number of terminals necessary when the apparatus is made in the form of an LSI, contributing to a high density of mounting.

Figure 43:
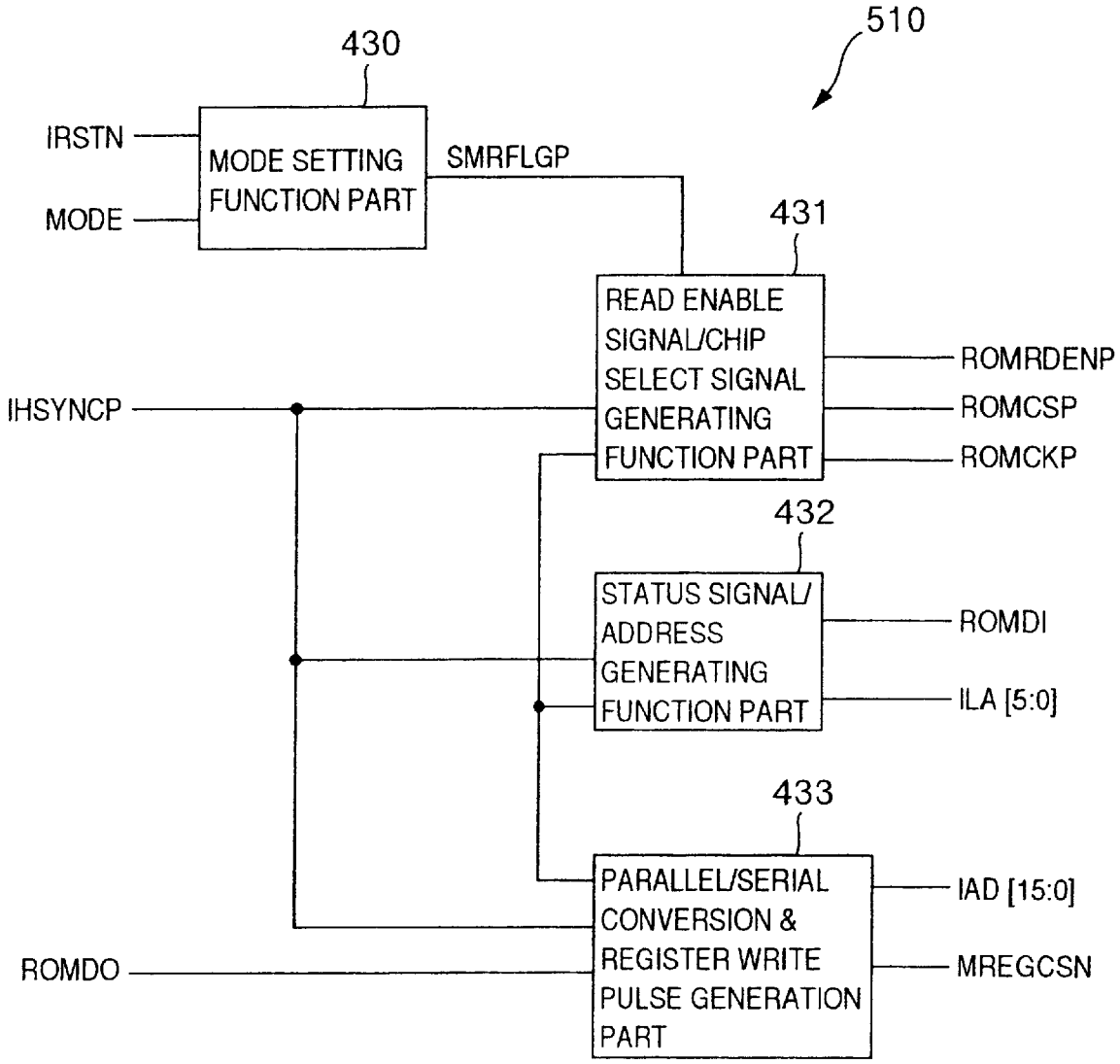
FIG. 43 schematically shows a configuration of a serial memory control circuit for setting of an FRC controller register.

FIG. 43 shows a schematic arrangement of the FRC access control circuit 510. In FIG. 43, reference numeral 430 denotes a mode setting function part for controlling whether or not to set in the FRC access circuit 511 data from an external serial memory at the time of starting the system, numeral 431 denotes a read enable signal/chip select signal generating function part to the external serial memory when the external serial memory is set to be valid, 432 denotes a status signal/address generating function part to the serial memory, and 433 denotes a parallel/serial conversion & register write pulse generation part including a data converting function of converting serial data read out from the serial memory into parallel data and also including a register write pulse generating function of taking it into the FRC control register at the timing of completion of the conversion.

Figure 44:
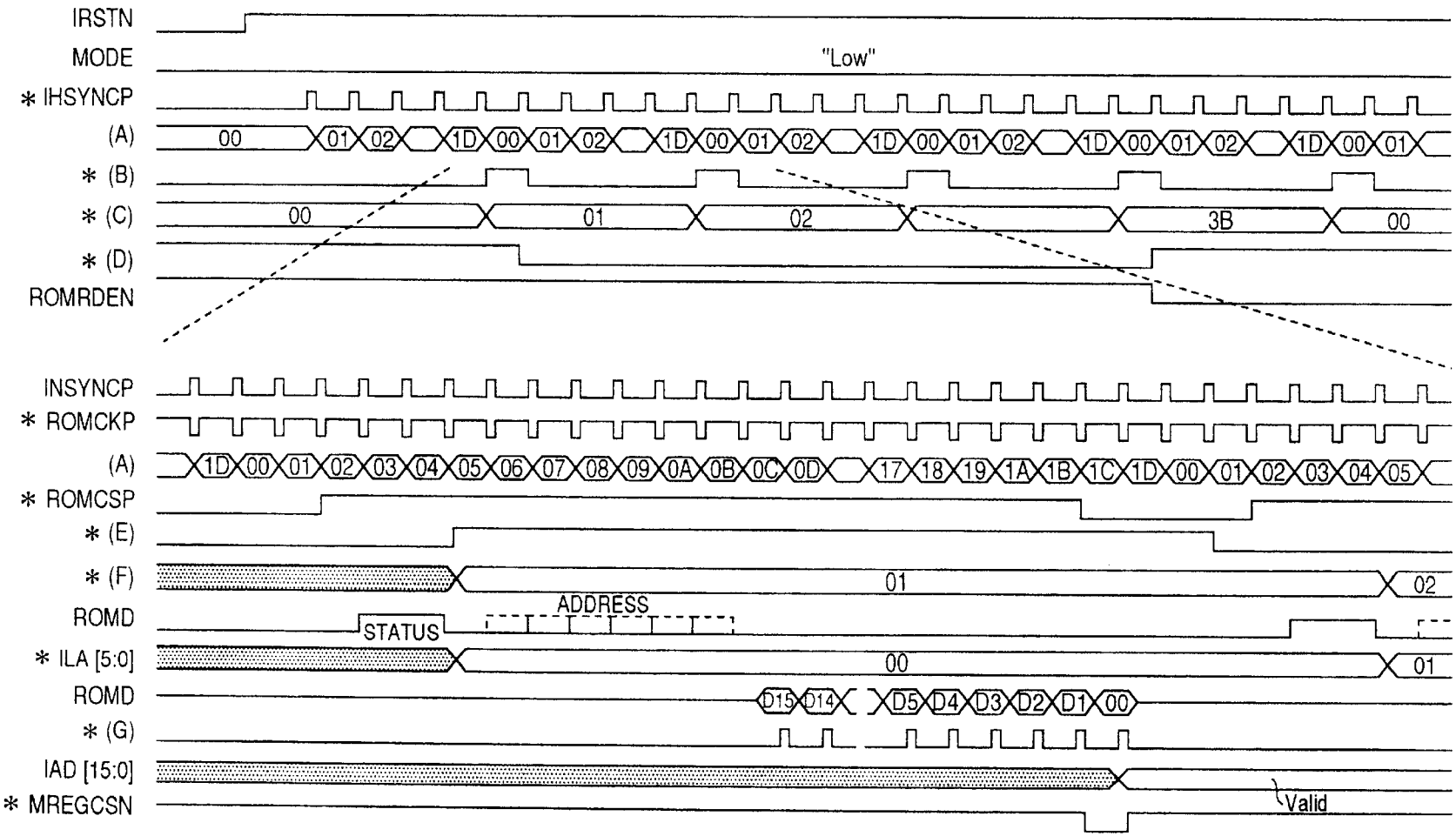
FIG. 44 is a timing chart of operation of the serial memory control circuit of the FRC controller register.

Referring to FIG. 44, when the read mode of the external serial memory is made valid (SMEMRDENP) in the mode setting at the time of starting the system, a serial memory read flag of the mode setting function part 430 becomes valid (SMRFLGP="H"). Under the valid state of the flag signal, an 8-bit counter 1 is initiated in the read enable signal/chip select signal generating function part 431. The counter 1 is cleared whenever the count value (A) of the counter 1 counted by the input horizontal synchronous signal (IHSYNCP) also used as an external serial memory control clock (ROMCKP) counts 30 (1 Dh). More specifically, at the same time when 30 cycles of the input horizontal synchronous signal (IHSYNCP) become equal to the number of cycles necessary for one external serial memory access, the 30 cycles are divided into 26 and 4 cycle durations to thereby generate a chip select signal (ROMCSP) of a 4-cycle precharge duration (4×IHSYNCP). Further, on the basis of a decode result of a count value (C) of an 8-bit counter 2 counted up by a clock (B) of each decode value 30 (1 Dh), a read enable signal (ROMRDENP) is generated. In other words, the read enable signal (ROMRDENP) is asserted at the timing when the serial memory read flag of the mode setting function part 430 becomes valid (SMRFLGP="H"), and is negated at the timing when the count value (C) of the 8-bit counter 2 become 59 (3 Bh) indicative of end of the data setting from the serial memory. In addition, at the negation timing, a counter mask signal (D) for stopping counting of the 8-bit counter 2 becomes valid. By making the mask signal (D) valid, the operation of the present control circuit is thereafter stopped, thus preventing erroneous operation of the system. Further, the read enable signal (ROMRDENP) indicates that control over the external serial memory is being carried out during the valid duration. Thus, when the control signal is utilized, distinction can be made between the external serial memory control duration at the time of starting the system and the normal operation duration thereafter, thus enabling realization of terminal joint. The status signal/address generating function part 432 next triggers the serial memory chip select signal (ROMCSP) and outputs a status signal (110) indicative of read operation, followed by a serial memory address (ROMDI). At the same time, the status signal/address generating function part 432 also generates a register address (ILA[5:0]) for the FRC controller. The parallel/serial conversion & register write pulse generation part 433 takes in its parallel/serial conversion circuit a count value (F) of an 8-bit counter 3 counted up by a clock (E) of the chip select signal (ROMCSP), and thereafter serially outputs (ROMDI) the status signal (110) and serial memory address in this order at the timing of the serial memory control clock (ROMCKP). At the same time, the parallel/serial conversion & register write pulse generation part 433 outputs a signal corresponding to a subtraction of 1 from the count value (F) of the 8-bit counter 3 as the address (ILA[5:0]) for the FRC controller register. Through the above control, FRC controller setting data (ROMDO) of a serial type issued from the external serial memory is converted by the parallel/serial conversion & register write pulse generation part 433 to 16-bit parallel data according to a shift clock (G). In this connection, the 16-bit parallel data mean data corresponding to 2 registers because the FRC controller register is of an 8-bit type. That is, an identical address is assigned to the 2 registers. Further, since the parallel/serial conversion & register write pulse generation part 433 writes the data in the 2 associated registers at the time of completion of the conversion to the 16-bit parallel data, the part 433 outputs a register write pulse (MREGCSN). Under the aforementioned control, the system can provide arbitrary FRC controller setting data from the external serial memory at the time of being started and can control the gray-scale display according to the state of the input video data. When the set mode became invalid at the time of starting the system, the system can operate based on the initial data possessed by hardware.

Figure 45:
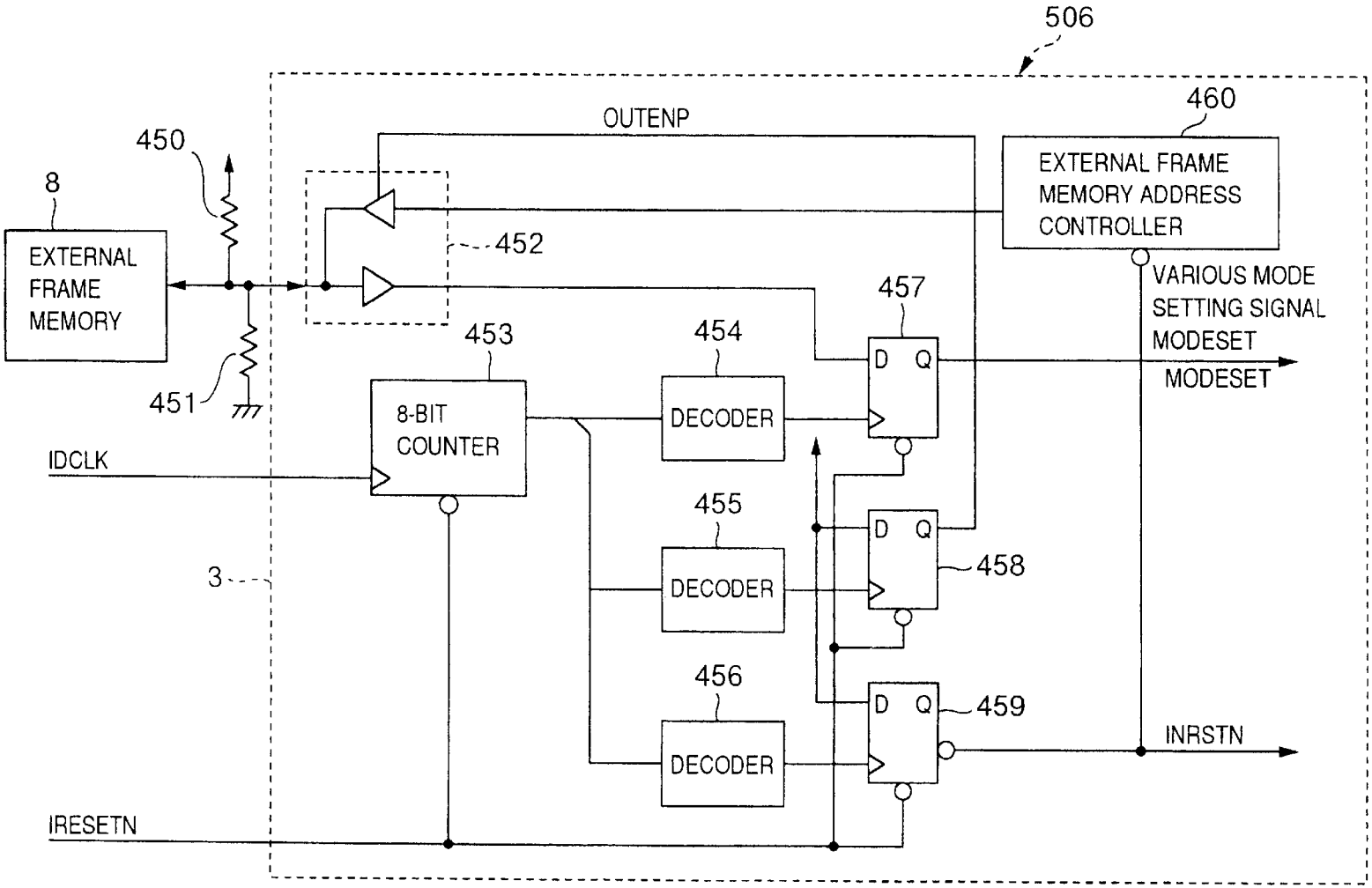
FIG. 45 is a schematic configuration of an LSI-mode setting function control circuit.

Explanation will then be made as to the mode setting by the mode establish circuit 506 shown in FIG. 45.

The mode establish circuit 506 is connected to address signal terminals of the frame memory 8. Table 3 shows contents of mode setting at terminals of the liquid crystal controller 3. As given in Table 3, terminals for address signals A[0] to A[5] are used also to take mode setting data MODE[0] to MODE[5] of each one bit. When the external serial memory read mode is assigned, the read operation of the FRC access control circuit 510 is carried out.

TABLE 3

| signal name | | function | set value | | set mode |
|---|---|---|---|---|---|
| A[0] | MODE[0] | input serial/ parallel setting | 1 | | input data serial |
| | | | 0 | | input data parallel |
| A[1] | MODE[1] | XGA/SVGA mode setting | 1 | | XGA mode |
| | | | 0 | | SVGA mode |
| A[2] | MODE[2] | multiple-speed mode setting | MODE[2] | MODE[3] | |
| A[3] | MODE[3] | | 1 | 1 | 2.5-time-speed |
| | | | 1 | 0 | 2.5-time-speed |
| | | | 0 | 1 | double-speed |
| | | | 1 | 1 | triple-speed |
| A[4] | MODE[4] | XGA 16-bit setting (valid when MODE[1]=1) | 1 | | 16-bits (OUT16BITP) |
| | | | 0 | | 12 bits (OUT12BITP) |
| A[5] | MODE[5] | operational specification selection | MODE[5] | TESTN | |
| | | | 1 | 1 | normal operation |
| | | | 0 | 1 | external serial memory read mode |
| | | | 0 | 0 | external serial memory write mode |
| | | | 1 | 0 | test mode |

FIG. 45 shows a configuration of the mode establish circuit 506. In FIG. 45, reference numeral 450 denotes a pull-up resistor for setting of H level mode, numeral 451 denotes a pull-down resistor for setting of L level mode, 452 denotes a bi-directional buffer, 453 denotes an 8-bit counter, 454 to 456 denote decoders, 457 to 459 denote latches, and 460 denotes an external frame memory address controller included in the indicate access control circuit 509. In reality, either one of the pull-up resistor 450 and pull-down resistor 451 is connected.

Figure 46:
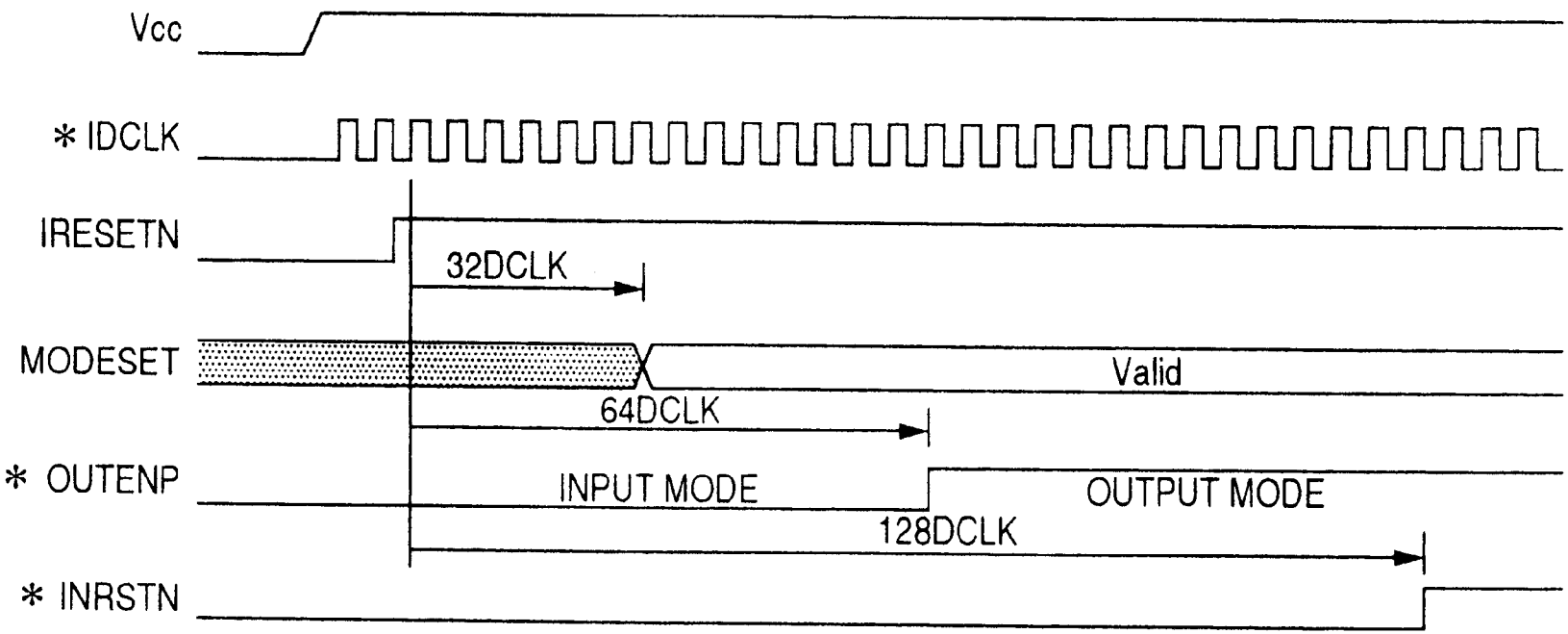
FIG. 46 is a timing chart of operation of the LSI-mode setting function control circuit.

The operation of the mode establish circuit 506 will be explained by referring to a timing chart of FIG. 46. At the time of starting the system, an output (OUTENP) of the latch 458 has a low (L) level and thus the bi-directional buffer 452 is put in its input state. Thereby applied to the latch 457 is a voltage level from the pull-up resistor 450 or pull-down resistor 451. At the time when supply of the data synchronous signal IDCLK is started and the count value of the 8-bit counter 453 counting the data synchronous signal becomes "32" (decimal), the decoder 454 outputs a latch clock to the latch 457 to hold the mode setting data. Thereafter, the count value becomes "64", the decoder 455 sets an output of the latch 458 at its high (H) level and thereafter the bi-directional buffer 452 is put in its output state. When the count value becomes "128", the decoder 456 changes an output (INRSTN) of the latch 459 to its H level to release the reset states of the respective parts in the liquid crystal controller 3. This causes the external frame memory address controller 460 to start output of the address signal, and the terminal applied with the mode setting data becomes an output terminal for the address signal. In this connection, the mode establish circuit 506 may be connected to an output terminal other than the address signal terminal.

In this way, when the mode establish circuit 506 is used, one terminal of the liquid crystal controller 3 can be used for taking in the mode setting data and also for outputting other data, thereby realizing the reduction of the number of LIS terminals and the miniaturization of the LSI. Of waveforms shown in FIG. 46, waveforms not explained here are given for the sake of reference.

Figure 47:
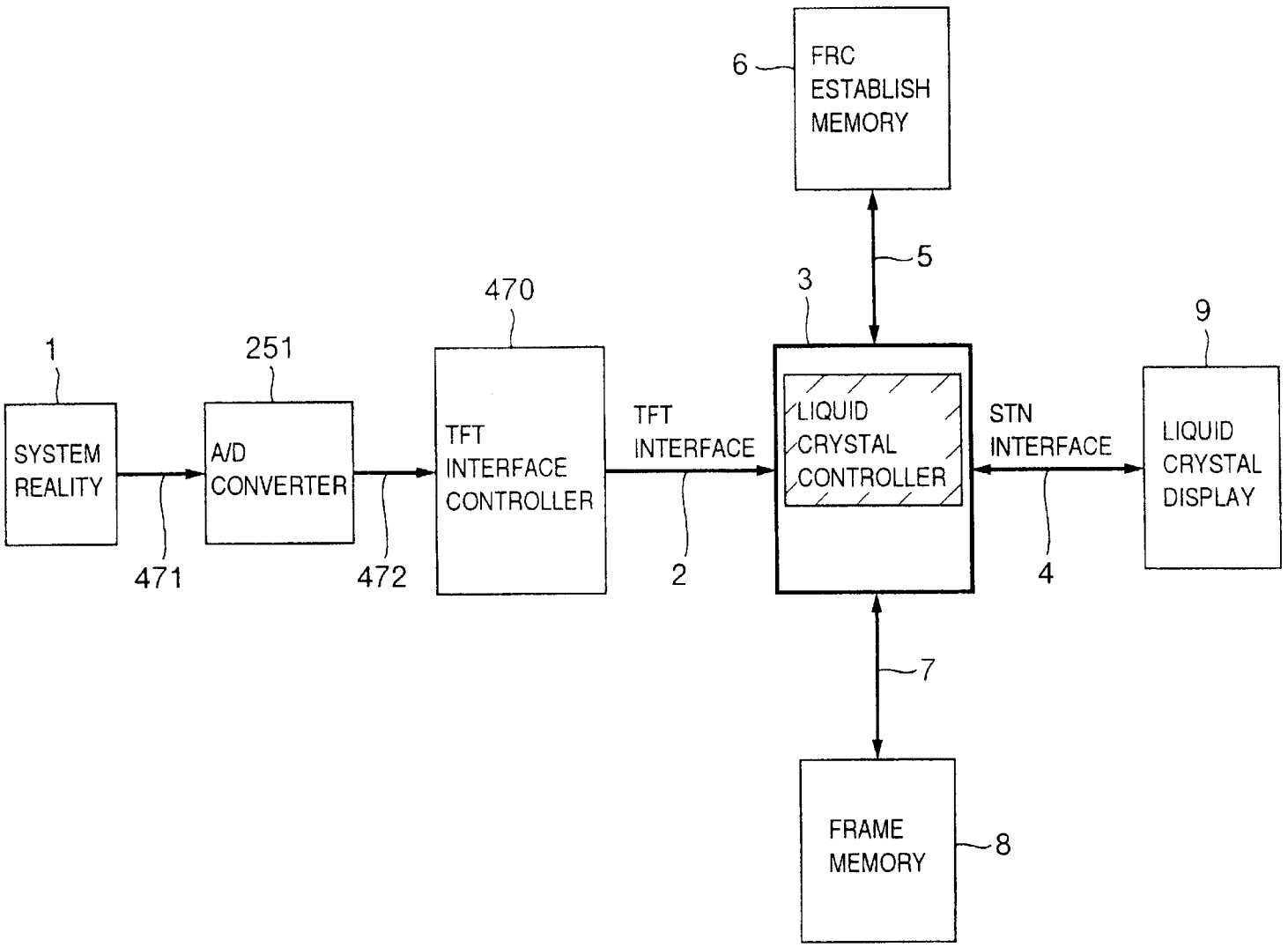
FIG. 47 is a general arrangement of another embodiment of the present invention.

FIG. 47 shows an entire arrangement of a liquid crystal display control apparatus in accordance with a seventh embodiment of the present invention.

The liquid crystal display control apparatus of the present embodiment, which corresponds to an addition of an TFT interface controller 470 to the arrangement explained in FIG. 25, is intended to be capable of receiving analog video data 471 and displaying it. The analog video data 471 is, e.g., a video signal for CRT.

The analog video data 471 issued from the system reality 1 is converted by the A/D converter 251 to digital data 472 and then output to the TFT interface controller 470. The TFT interface controller 470 functions to convert the input digital data 472 to a TFT digital video signal 2 having the same signal format as the signal inputted into the liquid crystal controller 3. The TFT digital video signal 2 subjected to the conversion is output to the liquid crystal controller 3 to be subjected to the same processing as explained in the sixth embodiment.

The arrangement of the fifth embodiment is suitable for such a display system as a notebook size personal computer wherein a system reality is integrated with an STN liquid crystal display; whereas the arrangement of the sixth embodiment is suitable for realizing a liquid crystal display control apparatus of such a type separated from a system reality. In other words, the present embodiment can provide a large capacity and a high quality of image display when combined with, e.g., a desktop personal computer (system reality) which issues only an analog video signal.

What is claimed is:

1. A liquid crystal display control apparatus for generating intermediate gray-scale display data, comprising:

a display on/off data generation circuit which generates plural display on/off data per pixel corresponding to M frame periods of a video output signal outputted from the liquid crystal display control apparatus to a liquid crystal display in N frame periods of a video input signal inputted to the liquid crystal display apparatus on a pixel unit basis in response to gray-scale data of pixel units included in the video input signal (M>N, M and N being integers), the M frame periods of the video output signal being defined by a frame period signal included in the video output signal, the N frame periods of the video input signal being defined by a vertical synchronous signal included in the video input signal, a frequency of the frame period signal being different from a frequency of the vertical synchronous signal;

a write control circuit which writes the plural display on/off data per pixel corresponding to M frame periods of the video output signal generated by the on/off data generation circuit into a frame memory during N frame periods of the video input signal; and a read control circuit which sequentially reads out, from the frame memory, display on/off data corresponding to M frame periods of the video output signal written in the frame memory in synchronism with one display scan period of the video output signal;

wherein the write control circuit and the read control circuit enable displaying the video output signal on the liquid crystal display at a frequency of 2.5 times a frequency of the video input signal.

2. A liquid crystal display control apparatus according to claim 1, wherein the write control circuit includes:

a memory which temporarily stores therein the plural display on/off data sequentially created on a unit pixel basis by the display on/off data generation circuit; and a memory control circuit which controls writing and reading of the display on/off data to and from the memory in such a manner that a reading speed is faster than a writing speed.

3. A liquid crystal display control apparatus according to claim 1, further comprising a conversion circuit which converts display on/off data read out by the read control circuit to data having a data width determined by the liquid crystal display.

4. A liquid crystal display control apparatus according to claim 1, wherein the liquid crystal display is of a dual scan type in which a display is divided into an upper display and a lower display to be driven simultaneously; and wherein the liquid crystal display control apparatus further comprises a conversion circuit which converts display on/off data read out by the read control circuit to data having a data width determined by the liquid crystal display so that the display on/off data of pixels to be located in the upper display as well as the display on/off data of pixels to be located in the lower display are synchronously output respectively as upper display data and lower display data, with a data width determined by the liquid crystal display.

5. A liquid crystal display control apparatus according to claim 1, further comprising:

two scan driving circuits and two data driving circuits which individually drive two liquid crystal displays of a passive matrix type; and a synchronization generation circuit which receives a gray-scale data synchronous signal, a horizontal synchronous signal, and a vertical synchronous signal included in the video input signal, and generates a data horizontal synchronous signal for change-over of horizontal synchronization of display data to be output to the two liquid crystal displays, a data synchronous signal synchronized with the display data, and a frame period signal for change-over of vertical synchronization of the display data;

wherein the synchronization generation circuit includes:

a scan signal supply circuit which converts the vertical synchronous signal to a vertical synchronous signal having a frequency corresponding to Y times (Y being a real number of 2.5) a frequency of the vertical synchronous signal, and supplies the converted vertical synchronous signal to the two scan driving circuits commonly; and a data signal supply circuit which reads out from the frame memory the video output signal stored in the memory at such a speed readable by one frame during one period of the converted vertical synchronous signal for each of the two liquid crystal displays, and supplies the read-out video output signal to the associated data driving circuit.

6. A liquid crystal display control apparatus according to claim 5, wherein the synchronization generation circuit includes a horizontal synchronous signal generation circuit which converts the horizontal synchronous signal to a horizontal synchronous signal having a relatively short retrace period and a relatively high frequency.

7. A liquid crystal display control apparatus according to claim 6, wherein the data synchronous signal is used as an internal reference clock and as a transfer timing signal of the display data to the data driving circuits.

8. A liquid crystal display control apparatus according to claim 6, wherein the synchronization generation circuit further includes a vertical synchronous signal generation circuit which generates a vertical synchronous signal higher in frequency than the vertical synchronous signal included in the video input signal; and wherein the generated vertical synchronous signal has a frequency corresponding to 2.5 times the frequency of the vertical synchronous signal included in the video input signal.

9. A liquid crystal display control apparatus according to claim 6, wherein the converted horizontal synchronous signal produced by the horizontal synchronous signal generation circuit has a frequency corresponding to 2.5 times a frequency of the horizontal synchronous signal included in the video input signal.

10. A liquid crystal display control apparatus according to claim 5, wherein the synchronization generation circuit includes a display period control circuit which detects a number of display lines in the video input signal based on the gray-scale data synchronous signal, the horizontal synchronous signal, and the vertical synchronous signal, determines a number of display lines to be assigned to each of the two liquid crystal displays based on the detected number of display lines, and controls a display period of each of the two liquid crystal displays in such a manner that the two liquid crystal displays can provide a continuous normal display.

11. A liquid crystal display control apparatus according to claim 5, further comprising:

an external memory which stores therein various types of gray-scale pattern data for gray-scale display control;

a storage which holds gray-scale pattern data read out from the external memory;

a circuit which autonomously reads out the various types of gray-scale pattern data from the external memory at a time of turning on a power supply, and writes the data into the storage; and an FRC (Frame Rate Control) processing circuit which changes values of the data stored in the frame memory in a plurality of frames in accordance with the various types of gray-scale pattern data held in the storage.

12. A liquid crystal display control apparatus according to claim 5, wherein the synchronization generation circuit, the scan signal supply circuit, and the data signal supply circuit are included in a one-chip integrated circuit.

13. A liquid crystal display control apparatus according to claim 12, further comprising a release circuit connected to a bidirectional terminal of the integrated circuit which takes therein and holds mode setting data from the bidirectional terminal at a time of turning on a power supply, and thereafter releases the bidirectional terminal for use in data output.

14. A liquid crystal display control apparatus according to claim 1, wherein the display on/off data generation circuit generates three display on/off data per pixel respectively corresponding to three frame periods of the video output signal in response to gray-scale data for one pixel corresponding to one frame period of the video input signal.

15. A liquid crystal display control apparatus according to claim 1, wherein the frequency of the frame period signal is 2.5 times the frequency of the vertical synchronous signal.

16. A liquid crystal display control apparatus for generating intermediate gray-scale display data, comprising:

a display on/off data generation circuit which generates plural display on/off data per pixel corresponding to M frame periods of a video output signal outputted from the liquid crystal display control apparatus to a liquid crystal display in N frame periods of a video input signal inputted to the liquid crystal display apparatus on a pixel unit basis in response to gray-scale data of pixel units included in the video input signal (M>N, M and N being integers), the M frame periods of the video output signal being defined by a frame period signal included in the video output signal, the N frame periods of the video input signal being defined by an vertical synchronous signal included in the video input signal, a frequency of the frame period signal being different from a frequency of the vertical synchronous signal;

a write control circuit which writes the plural display on/off data per pixel corresponding to M frame periods of the video output signal generated by the on/off data generation circuit into a frame memory during N frame periods of the video input signal; and a read control circuit which sequentially reads out, from the frame memory, display on/off data corresponding to M frame periods of the video output signal written in the frame memory in synchronism with one display scan period of the video output signal;

wherein the display on/off data generation circuit includes:

a frame rate control (FRC) processor which generates three types of the display on/off data so as to provide three FRC patterns per pixel in response to respective gray-scale data for the pixel per three successive frame periods of the video output signal such that each pixel is displayed on the liquid crystal display with the three FRC patterns in the three successive frame periods of the video output signal; and a data width converter which generates the display on/off data according to values of the gray-scale data;

wherein the frequency of the frame period signal is 2.5 times the frequency of the vertical synchronous signal.

17. A liquid crystal display control apparatus for generating intermediate gray-scale display data, comprising:

a display on/off data generation circuit which generates plural display on/off data per pixel corresponding to M frame periods of a video output signal outputted from the liquid crystal display control apparatus to a liquid crystal display in N frame periods of a video input signal inputted to the liquid crystal display apparatus on a pixel unit basis in response to gray-scale data of pixel units included in the video input signal (M>N, M and N being integers), the M frame periods of the video output signal being defined by a frame period signal included in the video output signal, the N frame periods of the video input signal being defined by a vertical synchronous signal included in the video input signal, a frequency of the frame period signal being different from a frequency of the vertical synchronous signal;

a write control circuit which writes the plural display on/off data per pixel corresponding to M frame periods of the video output signal generated by the on/off data generation circuit into a frame memory during N frame periods of the video input signal; and a read control circuit which sequentially reads out, from the frame memory, display on/off data corresponding to M frame periods of the video output signal written in the frame memory in synchronism with one display scan period of the video output signal;

wherein the frame memory stores at least two of the plural display on/off data per pixel simultaneously; and wherein the frequency of the frame period signal is 2.5 times the frequency of the vertical synchronous signal.

* * * * *